US009163411B2

(12) United States Patent
Brady

(10) Patent No.: US 9,163,411 B2
(45) Date of Patent: Oct. 20, 2015

(54) EXTERIOR WALL ASSEMBLY SYSTEMS

(71) Applicant: Todd A. Brady, Beverly Hills, CA (US)

(72) Inventor: Todd A. Brady, Beverly Hills, CA (US)

( * ) Notice: Subject to any disclaimer, the term of this patent is extended or adjusted under 35 U.S.C. 154(b) by 0 days.

(21) Appl. No.: 13/842,329

(22) Filed: Mar. 15, 2013

(65) Prior Publication Data

US 2014/0115997 A1 May 1, 2014

Related U.S. Application Data

(63) Continuation-in-part of application No. 13/666,128, filed on Nov. 1, 2012, now abandoned.

(51) Int. Cl.

*E04B 9/00* (2006.01)
*E04F 13/04* (2006.01)
*E04B 1/24* (2006.01)

(52) U.S. Cl.

CPC ..... *E04F 13/045* (2013.01); *E04B 2001/2481* (2013.01)

(58) Field of Classification Search

CPC ..... E04B 1/76; E04B 1/7604; E04B 1/767; E04B 1/7654; E04B 1/7666; E04B 2/7414; E04B 2/58; E04B 1/2608; E04B 2001/2481; E04B 2/7409; E04D 13/1625; E04D 3/3602; E04D 3/3608; E04D 2003/3615; E04F 13/1807

USPC ..... 52/407.4, 404.2, 404.1, 407.3, 700, 52/351, 353, 356, 357, 359, 698, 712

See application file for complete search history.

(56) References Cited

U.S. PATENT DOCUMENTS

| | | | | | |
|---|---|---|---|---|---|
| 963,938 | A | | 7/1910 | Phillips | |
| 1,247,933 | A | | 11/1917 | Colpitts | |
| 1,685,247 | A | * | 9/1928 | Swelway | 52/356 |
| 1,714,411 | A | | 5/1929 | Walter | |
| 1,814,202 | A | * | 7/1931 | Winget | 403/274 |
| 1,918,256 | A | | 7/1933 | Fernstrom | |
| 2,377,169 | A | | 5/1945 | Mohr | |
| 3,683,738 | A | | 8/1972 | Kyriakos | |
| 3,722,166 | A | | 3/1973 | McNerney | |
| 4,047,346 | A | * | 9/1977 | Alderman | 52/407.4 |
| 4,127,975 | A | * | 12/1978 | Judkins | 52/489.2 |
| 4,248,021 | A | * | 2/1981 | Dyer | 52/404.1 |
| 4,435,936 | A | * | 3/1984 | Rutkowski | 52/481.1 |
| 4,495,741 | A | * | 1/1985 | Pasiecznik | 52/404.1 |
| 4,682,925 | A | | 7/1987 | Shields | |
| 4,761,928 | A | * | 8/1988 | Pichette | 52/404.2 |
| 5,060,434 | A | * | 10/1991 | Allison | 52/238.1 |
| 5,060,441 | A | * | 10/1991 | Pichette | 52/404.2 |
| 5,701,709 | A | * | 12/1997 | Dixon, III | 52/404.1 |

(Continued)

*Primary Examiner* — Brian D Mattei
(74) *Attorney, Agent, or Firm* — Trojan Law Offices

(57) ABSTRACT

An attachment strip for attaching lath to a wall and a system for attaching lath to a wall with increased water resistive characteristics. The attachment strip has protruding teeth on an attachment plate that holds the lath in place, and a mounting plate that secures the lath furring strip against the wall and framing. In addition, since attachment strip, instead of the lath directly, is secured to the sheathing, fewer mounting devices are needed compared to when a lath is directly secured to a sheathing, where substantially more mounting devices would be needed. Thus in this arrangement, fewer penetrations are created when installing the lath. Additional water resistive features, such insulation layers, and a drainage space surrounded by two water resistive barriers, create space that not only increases insulation, but protects the inner layers of a wall from damage.

10 Claims, 49 Drawing Sheets

(56) References Cited

U.S. PATENT DOCUMENTS

| | | | | |
|---|---|---|---|---|
| 5,810,303 | A * | 9/1998 | Bourassa et al. | 248/205.1 |
| 6,209,277 | B1 * | 4/2001 | DiGate | 52/514 |
| 7,823,350 | B2 * | 11/2010 | Valle et al. | 52/356 |
| 2005/0076600 | A1 * | 4/2005 | Moody et al. | 52/633 |
| 2006/0096234 | A1 * | 5/2006 | Miller, Jr. | 52/712 |
| 2007/0220821 | A1 | 9/2007 | Omiya | |
| 2010/0107533 | A1 | 5/2010 | Stephan | |
| 2013/0340377 | A1 * | 12/2013 | Shadwell | 52/698 |

* cited by examiner

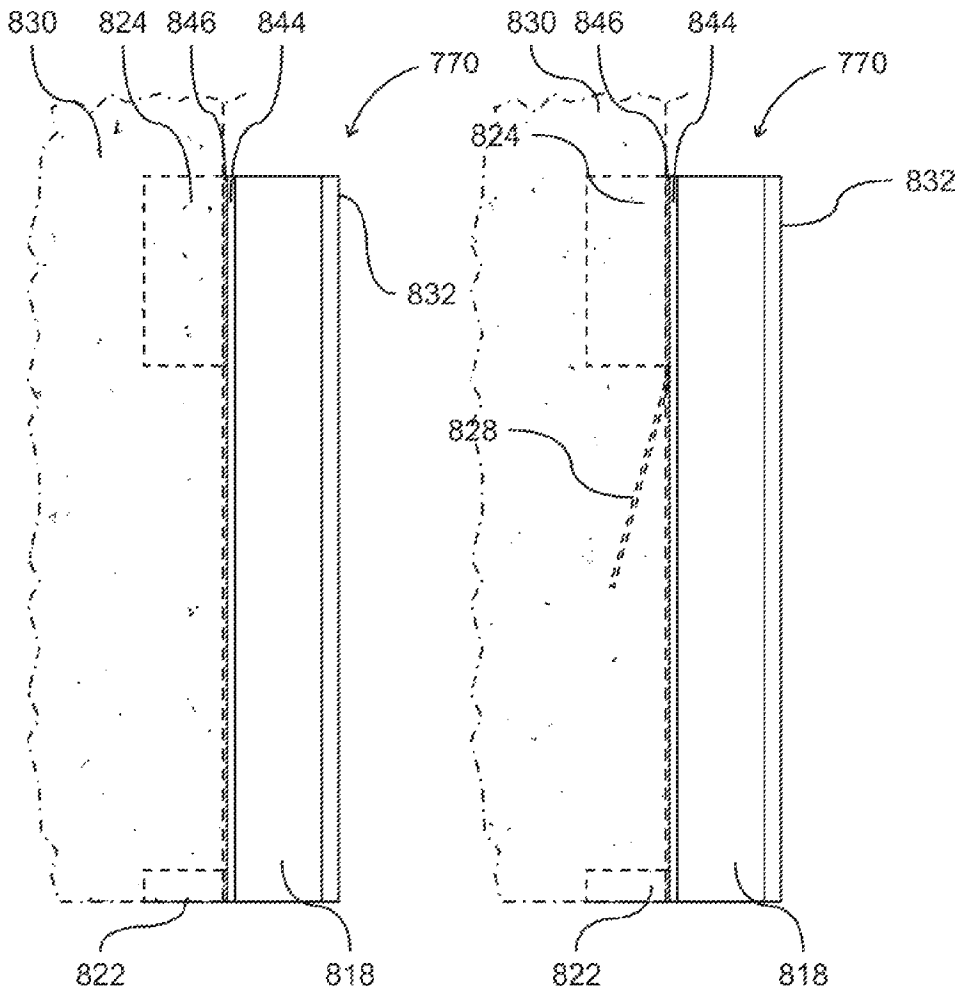
Fig. 31c
Fig. 31b
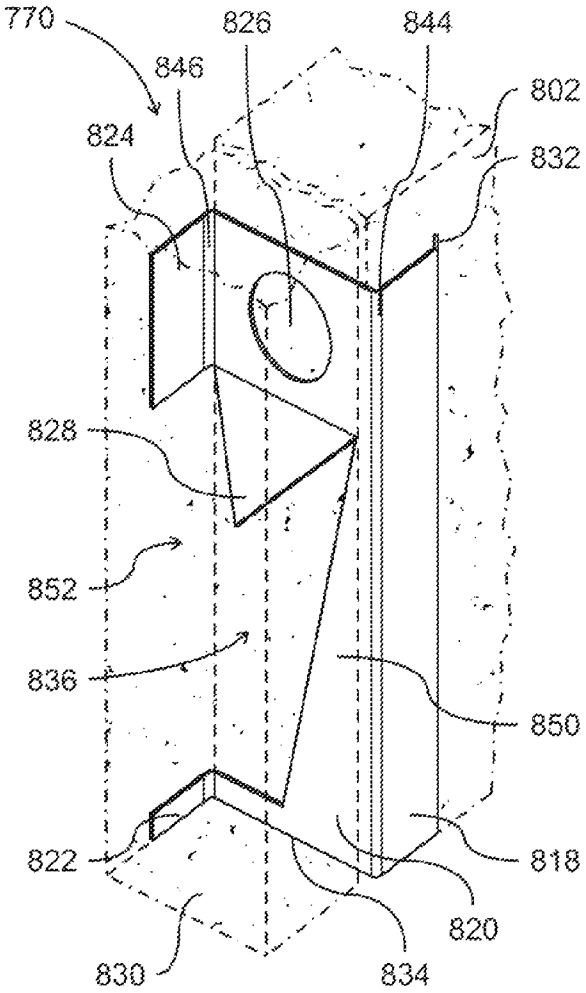
Fig. 31a

EXTERIOR WALL ASSEMBLY SYSTEMS

CROSS-REFERENCE TO RELATED APPLICATIONS

This application is a continuation-in-part of U.S. patent application Ser. No. 13/666,128 filed on Nov. 1, 2012.

FIELD OF THE INVENTION

This invention relates to exterior wall assemblies. In particular, this invention relates to structures for securing lath, insulation, and/or intermediary sheeting in the multi-component construction of exterior walls with the purpose of improving water resistance, improving moisture egress, reducing thermal transfers, adapting wall assemblies to better receive insulation, and reducing labor costs associated with the construction of exterior walls.

BACKGROUND OF THE INVENTION

One of the purposes of the present invention is to overcome problems associated with securing lath to walls. In wall construction, plaster is traditionally applied to a flexible lath material. The sheathing material to which the lath is secured is usually lined with a moisture resistive barrier. The current method of fastening lath to sheathing is either with staples, nails or screws. These traditional methods of attaching the metal lath to the sheathing creates multiple penetrations of the moisture resistive barrier and can cause tearing of the barrier that compromises its water resistant purpose.

A furring strip is traditionally a strip of wood or metal fixed to a wall, floor, or ceiling to provide a surface for the fixing of furring (i.e. the backing surface such as drywall, lath, tiles, etc.). One function of furring strips is to add the function of creating an air space between the sheathing and the lath, which can serve the purpose of creating an air pocket to permit moisture to evaporate when it soaks through the exterior plaster system.

However, there are still problems with current furring strips. Such furring strips still create penetrations of the moisture barrier through which water can seep. Moreover, the attachment of the lath to the furring strip is labor intensive and difficult. Current methods of attaching the lath to the furring strips include using wire ties, staples, screws or nails that are interlaced with the lath and attachment holes on the furring strip. This can be very tedious and time consuming since several attachment points using wire ties, staples, screws or nails are needed to properly secure the lath to the furring strip so that it does not fall off the wall due the weight of the lath, after plaster is applied to it. Traditional metal furring strips have also been an unwanted source of thermal transfer from interior to exterior walls and vice versa. Conventional furring strips are also not designed to accommodate the latest insulation technologies or accommodate improved drainage planes within wall systems.

Therefore, there is a need to replace current furring strips and improve their attachment to the walls, and improve the way the lath is attach to the furring strips with an improved attachment strip design that: (1) minimizes and seals penetrations; (2) more easily permits the attachment of the lath to the wall without the use, and/or the optional use, of ties, staples, screws or nails or other extraneous attachment devices; (3) minimizes thermal transfers; (4) better accommodates drainage planes within walls; and (5) can better accommodate insulation technologies in various thicknesses. These improvements over existing technology are merely illustrative of the benefits of the present invention and are not intended to be an exhaustive list. One skilled in the art will recognize many other benefits of this new attachment strip and method over apparatus and methods used to attach lath to a wall in prior art.

SUMMARY OF THE INVENTION

In view of the foregoing, the present invention is directed to wall assembly system that includes: 1) an improved attachment strips that allow for quick installation of a lath without securing the lath directly to a wall or water resistive barrier/sheathing, thus reducing the number of punctured holes in a water resistive barrier/wall, thereby decreasing moisture penetration in plaster wall construction, 2) an air barrier between the lath and the moisture barrier that also improves water resistance by allowing water to drain in a vertical fashion down a wall, preventing moisture from accumulating within the wall, preventing water from migrating horizontally and entering penetration holes created by screws that secure the attachment strip to the wall and screw penetrations caused by other components mounted on the wall, and 3) An improved attachment strip is that also is designed to reduce thermal transfers and accommodate improved insulation techniques.

In a preferred embodiment, the invention comprises an attachment strip for attaching lath to a wall which has a mounting plate for placement of the attachment strip flush against the wall, a mounting device (such as a screw) for securing the mounting plate to the wall, an attachment plate that is substantially perpendicular to the mounting plate. There are a plurality of protruding teeth or prongs which extend from the vertical edge of the attachment plate. The lath is like a web that has a plurality of strands criss-crossing each other, which may be made of metal. In between the strands are spaces, and it is these spaces that the protruding teeth are inserted between, catch the lath and hold it in place, when a person installs the lath by placing the lath over the lath attachment strip having these teeth. An advantage of this type of lath attachment strip is that the lath is not directly secured to the wall, the water resistive barrier or the sheathing, rather the lath is attached to the lath attachment strip, and the lath attachment strip is secured to the wall via a mounting device such as a screw. Fewer mounting devices are needed to secure the lath attachment strip to the sheathing compared to attaching the lath directly to the wall, and since fewer mounting devices are needed, there are fewer penetrating holes created in the water resistive barrier/sheathing. Fewer penetrating holes means fewer locations where water can seep into the sheathing, thus improving the water resistive characteristics of the wall. It also means far less water resistive barrier remedial work must be done whereas currently caulks and sealants are used through out the wall surface to patch and repair penetrations and tears caused by the installation of the lath to the wall. Furthermore, when perpendicularly mounted cross channels (reglets, flashings and trims) are mounted they too benefit greatly from being mounted to attachment strip by, 1) riding on top of the attachment strip, and 2) being fastened to the attachment strip vs. the wall surface. Once again, fewer penetrations are made into the water resistive barrier.

When the protruding teeth are angled, where the tips of the teeth are pointed outward and upward, the lath can be placed on the lath attachment strip in a horizontal manner and then shifted downward such that the teeth overlap the webbing of the lath, and would prevent the lath from falling down unintentionally or falling off the lath attachment strip in a horizontal manner since the teeth would block the lath from being pulling in a purely horizontal manner. This creates a "self hanging" feature that is unique to the attachment strip. Instead of removing the lath in a purely horizontal direction, to remove the lath on an attachment strip where the teeth are pointed outward and upward, the lath would have to be shifted upward by a person to make the lath not overlap with the teeth, and then remove the lath horizontally. This method secures the lath to the wall, and stabilizes the lath on the lath attachment strip until it can be more securely attached to the lath attachment strip via the mounting devices. Furthermore, this attachment strip allows for the teeth to be hammered shut after the lath has been mounted thus eliminating the need for traditional mounting devices, such as staples, tie wires, screws and nails.

In another embodiment, instead of protruding teeth on the lath attachment strip, a series of spikes along the edge of the lath attachment strip may be used to secure the lath to the lath attachment strip, having individual spikes go through different parts of the webbing of the lath.

In still another embodiment, the lath attachment strip can be secured to the mounting plate via a lath attachment wire coupled at interspaced regions to the vertical edge of the attachment plate, forming a plurality of wire loops. These loops can be inserted within the holes of the mesh and folded over the strands of the mesh to secure the mesh to the attachment plate. The lath can also be secured to the attachment plate via clamps the secure the lath to the attachment.

In still another embodiment, the attachment strip includes a space located on the rear side of the attachment strip wherein foam core insulation is inserted. This provides extra water resistive characteristics when the lath is secured to the attachment strip after a mounting device secures the lath to the attachment strip. The same mounting device penetrates the foam core insulation layer before penetrating the sheathing. By locating the insulation layer adjacent to the penetration hole, the insulation layer blocks the entrance of water. Increased water resistive features also include using attachment strips with multiple sections and a long vertical leg that separates the multiply connected attachment strips. By having multiply connected attachment strips, one attachment strip can be secured to the sheathing, then a large piece of insulation can be placed on top of the attachment strip connected directly to the sheathing while the second connected attachment strip can be secured to the thick insulation without penetrating the sheathing. This is advantageous because it creates several layers of protection between the lath itself, and the sheathing with the penetration holes created by the mounting device.

There is provided a system for securing lath to a wall, the system comprising one or more framing members, a sheathing secured to the framing members, a water resistive barrier adjacent to the sheathing, a lath, an attachment strip for securing, an insulation layer between the attachment strip and the moisture resistive barrier, a mounting device that secures the lath, the attachment strip, the framing and sheathing together. The system also has outer layers of plaster coats, which can be a scratch coat, a brown coat, and a finishing coat. To further increase water resistive properties of the system, the attachment strip can have multiple portions having different heights. This allows for an increased space between the lath and the sheathing, where an insulation layer can be placed, and which further prevents water from seeping in from the out layers of the system into the sheathing. This extra space also creates an air barrier/water drainage region, which allows for water to migrate down a wall, instead of into the sheathing.

In another embodiment, there are provided two water resistive barriers, a first water resistive barrier attached to the sheathing, and a second water resistive barrier adjacent to the lath. Between the first and second water resistive barriers is the air barrier/water drainage region, the air barrier created by the depth of the attachment strip. Any moisture that enters from the outside wall through the lath and into the second water resistive barrier would be prevented from seeping back to the outer wall, and also be prevented from seeping further into the inner walls by the first water resistive barrier on the sheathing. The air barrier/water drainage region provides a vertical escape route for any moisture that enters the air barrier/water drainage space.

In still a further embodiment, there is provided gaps or spaces between sheets of water resistive barriers adjacent to the lath. These water resistive barriers run vertical on a lath when placed on a wall, and the vertical spaces between each sheet of the water resistive barrier allow wet stucco to seep through the spaces in the lath and contact the inner wall or sheathing directly, without being blocked by the water resistive barrier. When the plaster reaches the inner wall through the spaces between the sheets of the water resistive barriers, they create additional support in the form a vertical plaster rib or a vertical line of smaller openings (e.g. holes) that helps prevent bowing of the plaster wall between the attachment strips. To further aid in keying, the water resistive barrier does not cover the attachment strip so that when the wet plaster is applied, the attachment strips are encased with plaster.

In still a further embodiment an attachment strip with an open space to allow the wet plaster to integrate and key with the strip has return legs that, 1) have minimal contact with the water resistive barrier/sheathing which further reduces thermal transfer, 2) the return legs are radiused metal that create a soft touch feature as not to dig-in or tear the water resistive barrier, and 3) are designed to create a gasket like seal, vertically on both sides of the screw feature to protect the screw penetration from water intrusion. Furthermore, the return legs control horizontal water migration by keeping water controlled within the vertical stud bay, and allowing it to escape only vertically to the bottom of the wall.

In still a further embodiment of an attachment strip, the attachment strip has an insulation plate for transecting insulation panels. Projecting from the insulation plate is a mounting flange on one edge, and a retention flange on the opposite edge, the mounting flange and retention flange extending in substantially parallel but opposite directions. One piece of insulation panel fits against one side of the insulation plate and a second piece of insulation panel fits against the other side of the insulation plate. An insulation retention arm projects away one side of the insulation plate to hold (by piercing or other method) an insulation panel when an insulation panel pressed against the retention arm and insulation plate by an installer. The retention flange and insulation retention arm assist in retaining insulation on both sides of the insulation plate.

BRIEF DESCRIPTION OF THE DRAWINGS

The above and various other objects and advantages of the invention will be described and understood from the following description of the preferred embodiments of the invention, the same being illustrated in the accompanying drawings.

FIG. 31*a* is a perspective view of an attachment strip having an insulation retention arm assembled with two insulation panels.

FIG. 31*b* is a front view of an attachment strip having an insulation retention arm flush with the insulation plate, assembled with a first insulation panel not yet retained by the insulation retention arm.

FIG. 31*c* is a front view of an attachment strip having an insulation retention arm projecting into a first piece of insulation after the insulation retention arm has been hammered out to retain the first insulation panel.

Figures 33A, 33B, 33C:
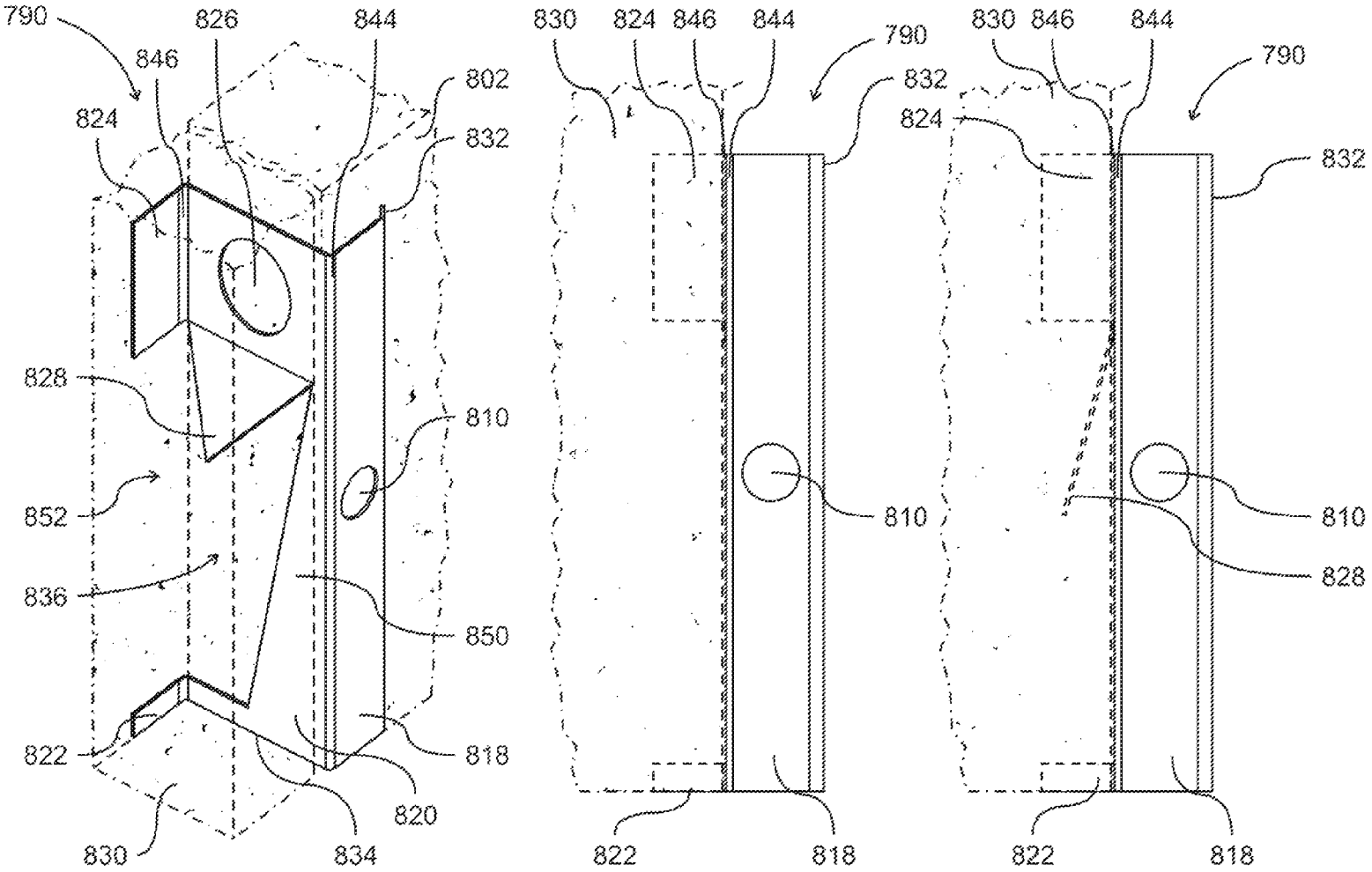
FIG. 33*a* is a perspective view of an attachment strip having a retention flange aperture and an insulation retention arm, assembled with two insulation panels.
FIG. 33*b* is a front view of an attachment strip having a retention flange aperture, and an insulation retention arm flush with the insulation plate, and first insulation panel not yet been retained by the insulation retention arm.
FIG. 33*c* is a front view of an attachment strip having a retention flange aperture and an insulation retention arm projecting into a first insulation panel, after the insulation retention arm has been hammered out to retain the first piece of insulation.
Figure 33F:
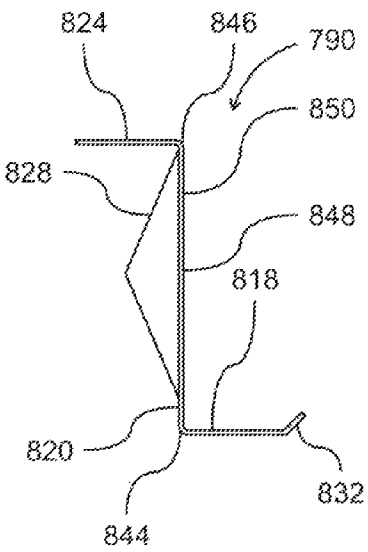
Figure 33E:
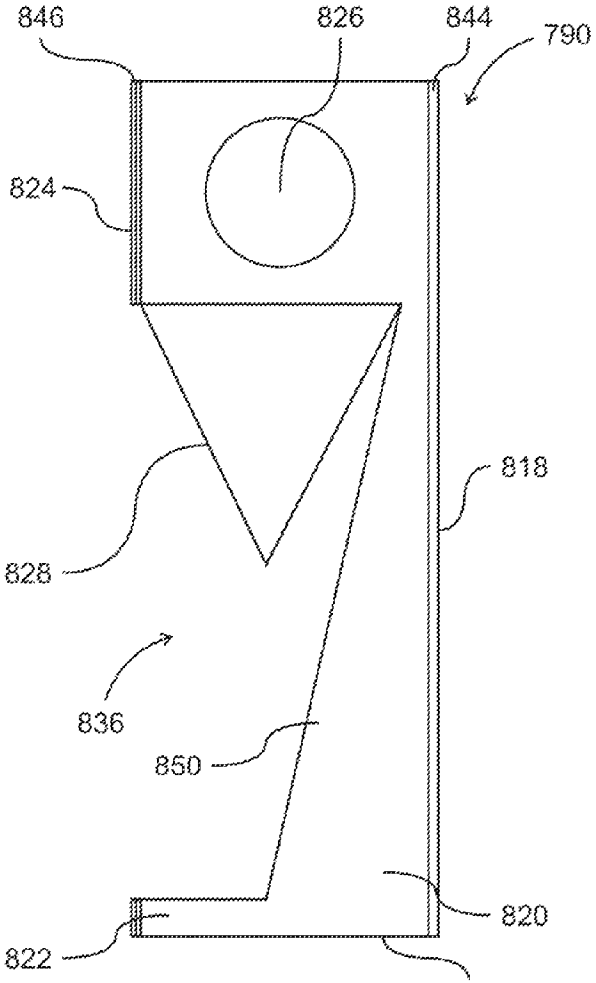
Figure 33D:
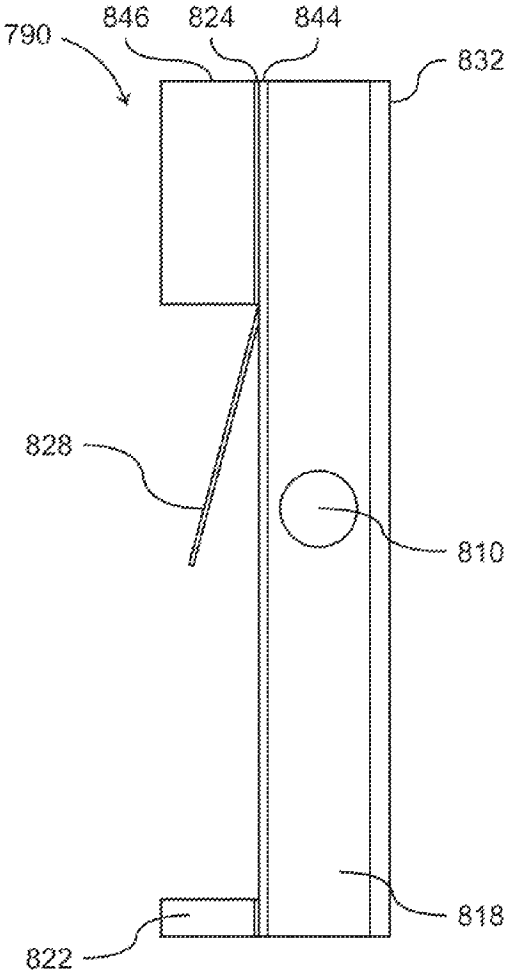

FIG. 33*d* is a front view of an attachment strip having a retention flange aperture and an insulation retention arm projecting from the insulation plate.

FIG. 33*e* is a side view of an attachment strip having a retention flange aperture and an insulation retention arm projecting from the insulation plate.

FIG. 33*f* is a top view of an attachment strip having a retention flange aperture and an insulation retention arm projecting from the insulation plate.

Figure 34C:
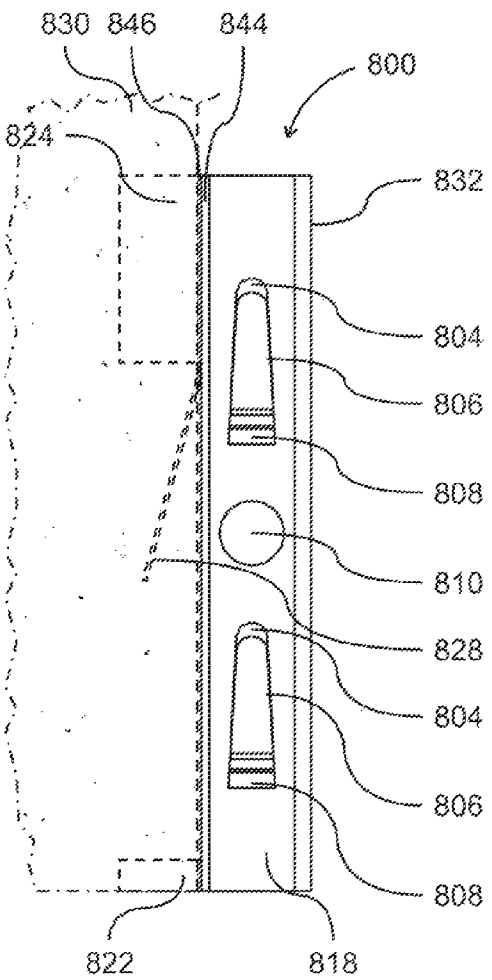
Figure 34B:
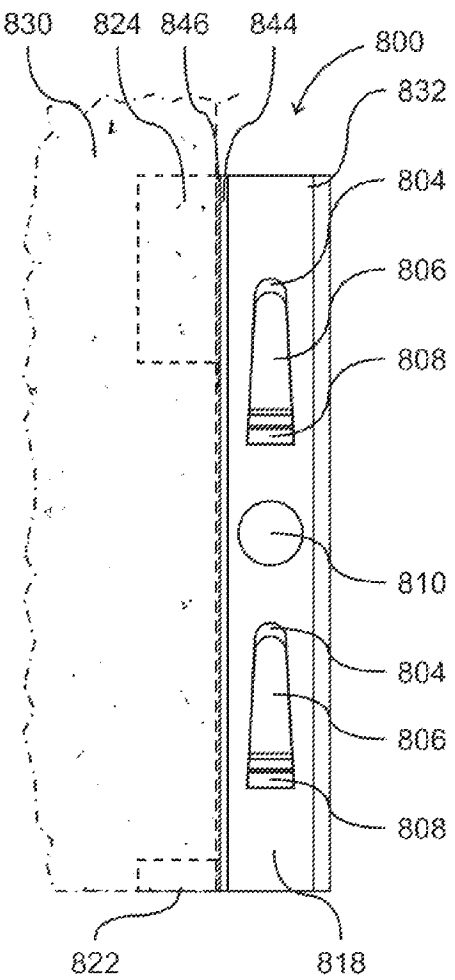
Figure 34A:
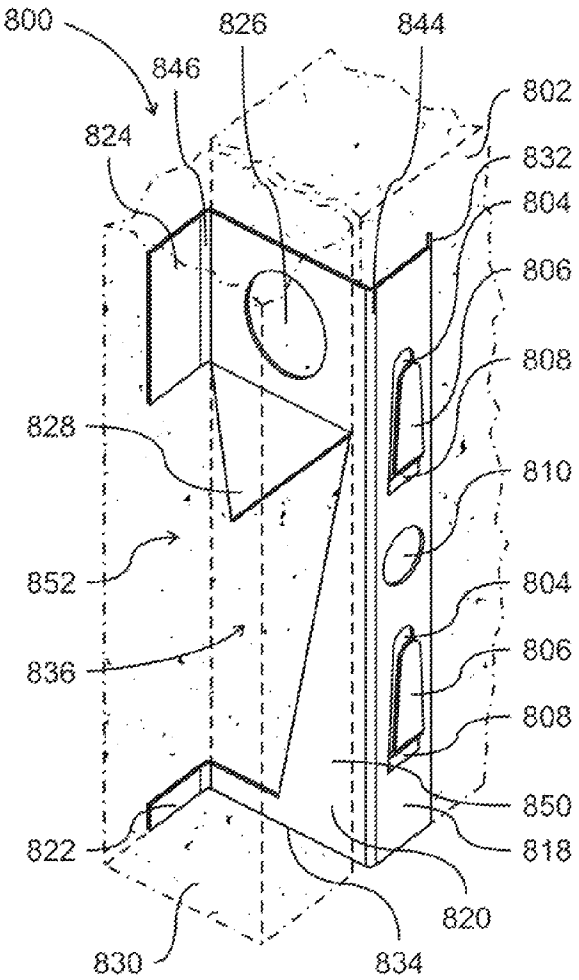

FIG. 34*a* is a perspective view of an attachment strip having lath retention arms, a retention flange aperture, and an insulation retention arm assembled with two insulation panels.

FIG. 34*b* is a front view of an attachment strip having lath retention arms, a retention flange aperture, and an insulation retention arm not yet retaining a first insulation panel.

FIG. 34*c* is a front view of an attachment strip having lath retention arms, a retention flange aperture, and an insulation retention arm projecting into a first insulation panel after the insulation retention arm has been hammered out to retain the first insulation panel.

Figure 34F:
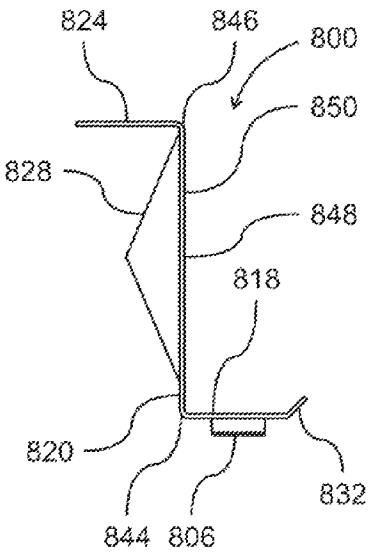
Figure 34E:
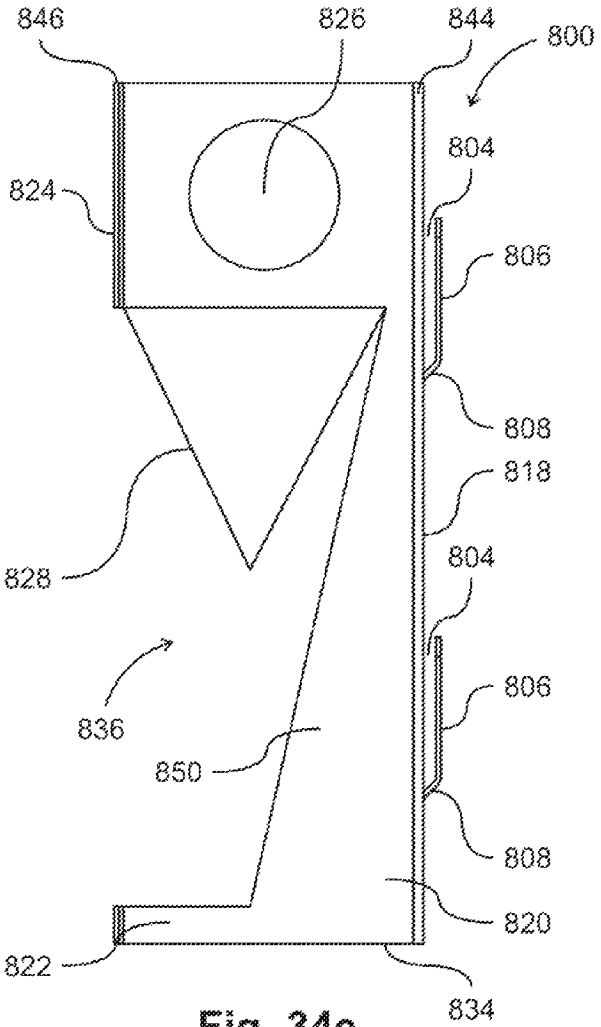
Figure 34D:
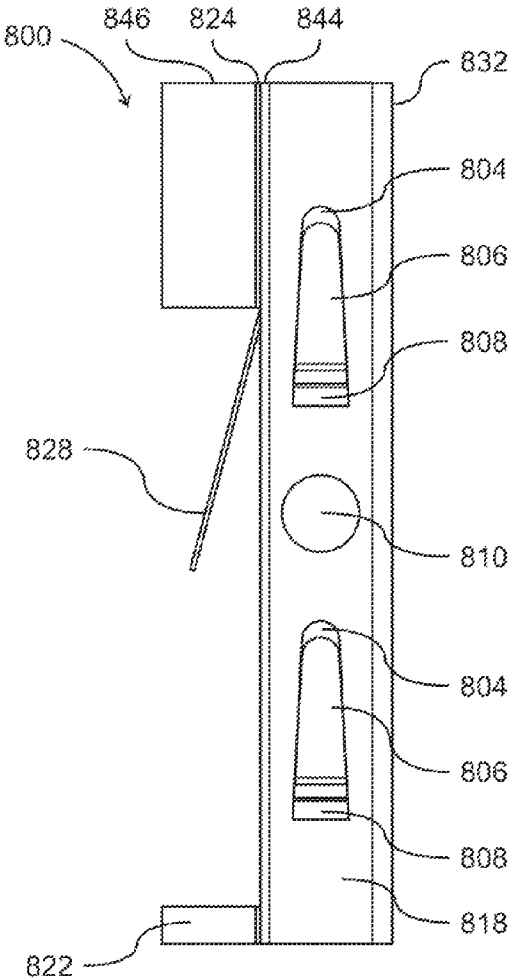

FIG. 34*d* is a front view of an attachment strip having lath retention arms, a retention flange aperture, and an insulation retention arm projecting from the insulation plate.

FIG. 34*e* is a side view of an attachment strip having lath retention arms, a retention flange aperture, and an insulation retention arm projecting from the insulation plate.

FIG. 34*f* is a top view of an attachment strip having lath retention arms, a retention flange aperture, and an insulation retention arm.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims. Preferable embodiments of the present invention are described with reference to the FIGS. 1-30.

FIGS. 1*a-e* depicts an embodiment of an attachment strip 10 having teeth able to secure a lath to the attachment strip without the use of any separate attachment device. The attachment strip 10 has a mounting plate 12 that secures the attachment strip 10 to a wall 28 via a screw 26 that enters the mounting plate 12 via a mounting plate screw hole 16. The mounting plate 12 has additional holes 14 for securing the mounting plate 12 to a wall, as well as keying holes 20 where plaster can seep into and bond the lath 25 to the attachment strip 10. Extending substantially perpendicular from mounting plate 12 is an attachment plate 18. Extending angularly from the attachment plate 18 is a protrusion plate 22 having a series of protrusion teeth 24 to secure a lath 25. The protrusion teeth 24 are formed by a series of diagonal separations originating from the top edge 27 of the protrusion plate 22 toward the attachment plate 18. The separated top edges 27 of the protrusion plate 22 is angled toward the plane of the attachment plate 18, which forms the series of angled protrusion teeth 24 substantially planar with the attachment plate 18.

The lath 25 can be secured to the attachment strip 10 by placing the protrusion teeth 24 in the lath spaces 33 and shifting the lath 25, once inserted onto the protrusion teeth 24 such that the lath 25 stays in place, and cannot be pulled from the attachment strip 10 except by manually shifting the lath 25 upward by the lath installer.

FIGS. 2*a-e* illustrates various perspectives of another embodiment of an attachment strip having teeth to secure a lath 62 to an attachment strip 40. The attachment strip 40 has a mounting plate 42 that secures the attachment strip 40 to a wall 70 via a screw 68 that enters the mounting plate 42 via a mounting plate screw hole 46. The mounting plate has addition holes 44 for securing the mounting plate 12 to a wall. Extending substantially perpendicular from mounting plate 42 is an attachment plate 48. The attachment plate has a series of protrusion teeth 56. The protrusion teeth 56 are rectangular and extend substantially in the same plane as the attachment plate 48. The rectangular protruding tooth 56 has a top edge 54 and bottom edge 58, each of which may be straight, curved, or have recesses within the edges 54, 58.

The lath 62 can be secured to the attachment strip 40 by placing the protrusion teeth 56 in the lath spaces 64. This placement allows that lath 62 to rest on the protrusion teeth 56 without falling off of the attachment strip 40. The lath 62 can be more securely attached to the attachment strip 40 when wet plaster is placed on the lath 99 and seeps through the lath spaces 64 and into one or more keying holes 100. This allows the plaster to mechanically bond the lath 99 to the attachment plate 90 via a keying hole 100.

FIGS. 3*a-e* illustrates various perspectives of another embodiment of an attachment strip 80 having teeth to secure a lath 99 to an attachment strip 80. The attachment strip 80 has a mounting plate 82 that secures the attachment strip 80 to a wall 102 via a screw 88 that enters the mounting plate 82 via a mounting plate screw hole 88. The mounting plate 82 has additional holes 84 for securing the mounting plate 82 to the wall. Extending substantially perpendicular from mounting plate 82 is an attachment plate 90. The attachment plate 90 has a series of protrusion teeth 94. The protrusion teeth 94 are rectangular and extend substantially in the same plane as the attachment plate 90. Each protrusion tooth 94 has a top edge 92 and a bottom edge with a recessed notch 96 where the lath 99 can rest when the lath hole 98 inserted over the protrusion tooth 94.

The lath 99 can be secured to the attachment strip 80 by placing the protrusion teeth 94 in the lath spaces 98. This placement allows that lath 99 to rest on the protrusion teeth 94 without falling off of the attachment strip 80, and cannot easily pulled off of the attachment strip 80 because the lath 99 is nestled in the notch protrusion 96 which would prevent the lath from being pulled off horizontally from the attachment strip 80. In order for the lath 99 to be taken off of the attachment strip 80, the installer would have to lift the lath 99 vertically so that the metal on the lath 99 is not within the notched region 96. Only then could the lath be removed by pulling the lath 99 horizontally away from the attachment strip 80.

FIGS. 4*a-e* illustrates various perspectives of another embodiment of an attachment strip 110 having teeth to secure a lath 130 to an attachment strip 110. The attachment strip 110 has a mounting plate 112 that secures the attachment strip 100 to a wall 134 via a screw 115 that enters the mounting plate 112 via a mounting plate screw hole 116. The mounting plate 112 has additional holes 114 for securing the mounting plate 112 to the wall. Extending substantially perpendicular from mounting plate 112 is an attachment plate 120. The attachment plate 120 has a series of protrusion teeth 124. The protrusion teeth 124 are rectangular and extend substantially in the same plane as the attachment plate 120. Each protrusion tooth 124 has a top edge 122 and a bottom edge having a recessed region shown as a first notch 126 and second notch 128 where the lath 130 can rest when the lath hole 132 is inserted over the protrusion tooth 124.

The lath 130 can be secured to the attachment strip 110 by placing the protrusion teeth 124 in the lath spaces 132. This placement allows that lath 130 to rest on the protrusion teeth 124 without falling off of the attachment strip 110, and cannot easily pulled off of the attachment strip 100 because the lath 130 is nestled in either the first notched 126 or second notch 128 on the protrusion teeth 124 which would prevent the lath 130 from being pulled off horizontally from the attachment strip 110. In order for the lath 130 to be taken off of the attachment strip 110, the installer would have to lift the lath 130 vertically so that the metal on the lath 130 is no longer within each notched region 126, 128. Only then could the lath be removed by pulling the lath 99 horizontally away from the attachment strip 80.

FIGS. 5*a-e* illustrates various perspectives of another embodiment of an attachment strip 130 having teeth to secure a lath 146 to an attachment strip 130. The attachment strip 130 has a mounting plate 132 that secures the attachment strip 130 to a wall 154 via a screw 152 that enters the mounting plate 136 via a mounting plate screw hole 136. The mounting plate 132 has additional holes 134 for securing the mounting plate 132 to the wall. Extending substantially perpendicular from mounting plate 132 is an attachment plate 138. The attachment plate 138 has a series of hooked crescent-like shaped teeth 142. The hooked crescent-like shaped teeth 142 are substantially in the same plane as the attachment plate 138. Each hooked crescent-like shaped tooth 142 has a notch 150 that can secure a lath 146. The lath 146 is placed over the hooked crescent-like shaped teeth 142 so that the hooked crescent-liked shaped teeth go through a lath space 148. The lath 146 rests in the notch 150 and cannot be pulled away from the attachment strip 130 once placed onto the crescent-like shaped teeth 142, and can only be removed from the attachment strip 130 if lifted vertically up and out of the notch 150, and then pulled away from the last attachment strip 130. The attachment plate 138 has a series of holes 140 where the lath 146 can be additionally secured to the attachment strip 130. Once plaster is placed on the lath 146, the plaster keys on the lath and attachment holes 140 to secure the lath 146 to the attachment strip 130.

FIGS. 6*a-e* illustrates various perspectives of another embodiment of an attachment strip 160 having teeth to secure a lath 182 to an attachment strip 160. The attachment strip 160 has a mounting plate 162 that secures the attachment strip 160 to a wall 184 via a screw 168 that enters the mounting plate 162 via a mounting plate screw hole 166. The mounting plate 162 has additional holes 164 for securing the mounting plate 162 to the wall. Extending substantially perpendicular from mounting plate 162 is an attachment plate 172. The attachment plate 172 has a series of attachment holes 170 to aid in keying plaster once it has been applied to the lath 182. Extending substantially perpendicular from the attachment plate 172 is a pronged tooth plate 174 having a series of triangular-shaped pronged teeth 176. Each pronged tooth 176 has a notch 178 to further grasp the lath 160. Each pronged tooth 176 is formed from a cut-out from the pronged tooth plate 174 and extends away from the plane formed by the pronged tooth plate 174. A lath 182 can be secured to the attachment strip 160 by placing the lath 182 over the pronged teeth 176 such that the pronged teeth 180 hold the lath in place when the lath 182 is shifted down in between the space created by the protruding pronged tooth 180 and the pronged tooth plate 174. This prevents the lath 182 from falling off of the attachment strip 160, and an only be removed when the installer lifts the lath 182 up out of the pronged tooth 180 space on the pronged tooth plate 174. The attachment plate 172 has a series of attachment holes 170 where the lath 146 can be additionally secured to the attachment strip 130 with an attachment device, and also aids in keying the plaster to the lath 182 and attachment strip 160.

FIGS. 7*a-e* depict various perspectives of another embodiment of an attachment strip 190 having pronged spikes 206 to secure a lath 208 to an attachment strip 190. The attachment strip 190 has a mounting plate 192 that secures the attachment strip 190 to a wall 210 via a screw 198 that enters the mounting plate 192 via a mounting plate screw hole 198. The mounting plate 192 has additional holes 164 for securing the mounting plate 192 to the wall. Extending substantially perpendicular from mounting plate 192 is an attachment plate 202. The attachment plate 202 has a series of holes 200 to aid in keying plaster once it has been applied to the lath 182. Extending outward from the attachment strip and attachment plate 202 are a series of multipronged spikes 206, which form the tooth, and are physically attached to the attachment plate 202 by a welding attachment 204. The pronged spikes 206 are spaced such that when the lath 208 is pressed horizontally, substantially in the same plane as the mounting plate 192, the pronged spikes 206 surround the lath 208 at several places in close proximity to each other, thereby preventing the lath from falling off of the attachment strip. Plaster is placed on the lath 208 and attachment holes 200 on the attachment plate aid in keying the plaster to the lath 208 and attachment plate 202. The set-up has the advantage of preventing the lath 208 from moving vertically off of the attachment strip 190 and can only be removed when the installer pulls the lath 208 horizontally away from the pronged spikes 206.

FIGS. 8*a-e* illustrate various perspectives of another embodiment of an attachment strip 210, this attachment strip 210 lath securing wire 222 to secure a lath 224 to an attachment strip 210. The attachment strip 210 has a mounting plate 212 that secures the attachment strip 210 to a wall 226 via a screw 224 that enters the mounting plate 212 via a mounting plate screw hole 216. The mounting plate 210 has additional holes 214 for securing the mounting plate 210 to the wall. Extending substantially perpendicular from mounting plate 212 is an attachment plate 218. The attachment plate 218 has a vertical edge 221 where a lath securing wire 222 is substantially in the same plane as the attachment plate 218. The securing wire 222 is fastened to the attachment plate 218 at several welded points 223, and between each welded point 223 the securing wire 223 extends beyond the vertical edge 221 of the attachment plate 218 and then back toward the vertical edge 221 of the attachment plate 218. The attachment plate 218 has a series of attachment holes 220 to aid in keying plaster once the plaster has been applied to the lath 224. To secure the lath 224 to the attachment strip 210, the securing wire 222 is folded in between the spaces 227 of the lath 224 and against the metal on the lath 224. This secures the lath at several points thereby preventing the lath from moving vertically or horizontally from the attachment strip 210.

FIGS. 9*a-e* illustrates various perspectives of another embodiment of an attachment strip 230 having teeth to secure a lath 246 to an attachment strip 230. The attachment strip 230 has a mounting plate 232 that secures the attachment strip 230 to a wall 248 via a screw 238 that enters the mounting plate 232 via a mounting plate screw hole 236. The mounting plate 232 has additional holes 234 for securing the mounting plate 232 to the wall. Extending substantially perpendicular from mounting plate 244 is an attachment plate 244. The attachment plate 244 has a series of protrusion teeth 240. The protrusion teeth 240 are rectangular and extend substantially in the same plane as the attachment plate 244. The attachment plate 244 has a series of attachment holes 242 to aid in keying the plaster once it has been placed on the lath 246 and attachment plate 244. The protrusion teeth 240 are narrowly spaced from each other such that when the lath 246 is pressed toward the plane of the mounting plate 230, the metal all on the lath becomes wedged between the protrusion teeth 240. This placement stabilizes the lath 246 on the attachment strip 230 such that the lath 246 cannot easily fall off the attachment strip 230. In order to remove the lath 246 from the attachment strip 230, the installer would have to pull the attachment strip horizontally away from the attachment strip 230.

FIGS. 10*a-e* illustrates various perspectives of another embodiment of an attachment strip 250 having teeth to secure a lath 262 to an attachment strip 250. The attachment strip 250 has a mounting plate 252 that secures the attachment strip 250 to a wall 268 via a screw 266 that enters the mounting plate 252 via a mounting plate screw hole 256. The mounting plate 252 has additional holes 254 for securing the mounting plate 252 to the wall. Extending substantially perpendicular from mounting plate 252 is an attachment plate 258. The attachment plate 258 has a series of protrusion teeth 262 with a hook 263. The protrusion teeth 262 are rectangular in shape and extend substantially in the same plane as the attachment plate 258. The attachment plate 258 has a series of attachment holes 260 to aid in keying the plaster once the plaster has been placed on the lath 264 and attachment plate 258. The protrusion teeth 262 are narrowly spaced from each other such that when the lath 264 is pressed toward the plane of the mounting plate 252, the metal all on the lath becomes wedged between the protrusion teeth 262. When the lath 264 is pressed into the spaces between the protrusion teeth 262, the lath 264 becomes wedged in the attachment strip 250. The lath 264 is prevented from falling off of the attachment strip because the lath 264 is wedged within the protrusion teeth 262, and additionally, the hooks 263 on the protrusion teeth 262 also make it more unlikely that the lath 264 would fall off the attachment strip 250 without the installer physically pulling the lath 264 away form the attachment strip 250 to pry the lath 262 off of protrusion teeth 262 having hooks 263.

FIGS. 11*a-e* illustrates various perspectives of another embodiment of an attachment strip 270, this attachment strip 270 having C-clamps secure a lath 288 to an attachment strip 270. The attachment strip 270 has a mounting plate 272 that secures the attachment strip 270 to a wall 290 via a screw 278 that enters the mounting plate 272 via a mounting plate screw hole 276. The mounting plate has keying holes 282 for plaster to key to, which bonds the lath 284 to the attachment plate 280. Extending substantially perpendicular from mounting plate 272 is an attachment plate 280. The attachment plate 280 has a series of c-clamp holes 286 near the top edge of the attachment plate 280. A series of C-clamps 284 secures the lath 288 to the attachment plate 280. The C-clamps 284 are not a closed structure. There is a space in the C-clamp that allows the C-clamp to surround a portion of the lath 288 and couple the lath 288 to the attachment plate 280 by having the open ends of the C-clamp 284 go through the C-clamp holes 286. The C-clamps 284 may be squeezed such that the open space in each C-clamp 284 is reduced, thereby preventing the lath 284 from being easily being removed from the attachment strip 270 either by falling off of the attachment strip 270 or even when pulled away from the attachment strip 270. The attachment plate 280 has a series of attachment holes 282 to aid in keying the plaster once the plaster has been placed on the lath 288 and attachment plate 280.

FIGS. 12*a-e* illustrates various perspectives of another embodiment of an attachment strip 300 having pronged teeth 306 to secure a lath 311 to an attachment strip 300. The attachment strip 300 has two mounting plates 302 substantially in the same plane that can be secured to a wall 312 with one or more mounting devices 310. Extending substantially perpendicular, or obtusely from each mounting plate 302 are two side attachment plates 304, and connected each side attachment plate 304 is a front attachment plate 312 substantially parallel to the mounting plates 302. The side attachment plates 304 and front attachment plate 312 are configured to form a trapezoidal shape for the attachment strip 300. On the front attachment plate 312 are a series of triangular shaped pronged teeth 306, each formed from a cut portion from the front attachment plate 312, and the pronged tooth 306 is bent an angle such that the point of the tooth extends out from the plane formed by the front attachment plate 312. In between each pronged tooth 306 are mounting holes 308 where a screw 310 can be inserted through the mounting hole 308 and into a wall 312. The side attachment plates 304 have a series of holes to aid in keying plaster once the plaster has been applied to the lath 311. The lath 311 can be secured to the attachment strip 300 by placing the lath 311 over the pronged teeth 306 such that the pronged teeth 306 hold the lath in place when the lath 311 is shifted in a downward direction and rests in between the pronged teeth 306 and the front attachment plate 312. This arrangement prevents the lath 311 from falling off of the attachment strip 300, and the lath 311 can only be removed when the installer lifts the lath 311 upwards out of the notched region formed the pronged teeth 306 and the front attachment plate 312. The two attachment plates 304 and pronged tooth plate 304 form three walls of an insulating region 305 (the framing/sheathing forming the fourth wall), where insulation can be inserted within the attachment strip 300.

FIGS. 13*a-e* illustrates various perspectives of another embodiment of an attachment strip 320, the attachment strip 320 having C-clamps 330 secure a lath 334 to an attachment strip 320. The attachment strip 320 has two mounting plates 322 that can be secured to a wall 338 via a screw 336 inserted through a mounting plate screw hole 328. Extending obtusely from each mounting plate 322 are two side attachment plates 324 that form that connect to each other at a point, forming an open triangular shaped attachment strip 320. The side attachment plates 324 have a series of attachment holes 326 where C-clamps can secure a lath 334 to the attachment strip 320. The C-clamps 330 are an open structure, i.e. there here is a space in the C-clamp 330 that allows the C-clamp 330 wrap around the mesh of the lath 334 through the open spaces of the lath 334 and then secure the lath 334 to the attachment strip 320 by inserting the C-clamp 330 through the attachment holes 326. Once the lath 330 is secured by the C-clamps 330 The C-clamps 330 may be squeezed such that the open space in each C-clamp 330 is reduced, thereby preventing the lath 334 from being easily being removed from the attachment strip 320 either by falling off of the attachment strip 320 or even when pulled away from the attachment strip 320.

FIGS. 14*a-e* illustrates various perspectives of another embodiment of an attachment strip 340 having pronged teeth 358 to secure a lath 360 to an attachment strip 340. The attachment strip 340 has two mounting plates 342 that can be secured to a wall 354 with a mounting device such as a screw 350, 352. Extending obtusely from each mounting plate 342 are two side attachment plates 346, and connected to each side attachment plate 346 is a front attachment plate 347 substantially parallel to the mounting plates 344. The side attachment plates 346 and front attachment plate 347 are configured to form a trapezoidal shaped attachment strip 340. On the front attachment plate 347 are a series of triangular shaped pronged teeth 358, each formed from a cut portion from the front attachment plate 347. The pronged tooth 358 is bent an angle such that the point of the tooth extends out from the plane formed by the front attachment plate 347. The base of the triangular shaped pronged tooth 358 extends is on the edge of the pronged tooth hole 349. The pronged tooth hole 349 circumscribes the pronged tooth 358, which extends out from the plane formed by the front attachment plate 347. The pronged tooth hole 349 aids in keying the plaster to the lath 360 and attachment strip 340 since the plaster, when wet, molds itself into the pronged tooth hole 349, providing extra connection support when the plaster keys. The side attachment plates 360 have a series of attachment holes 360 to aid in keying plaster once the plaster has been applied to the lath 360. The lath 360 can be secured to the attachment strip 340 by placing the lath 360 over the pronged teeth 358 such that the pronged teeth 358 hold the lath in place when the lath 360 is shifted in a downward direction and rests in between the pronged teeth 358 and the front attachment plate 347. This arrangement prevents the lath 360 from falling off of the attachment strip 340, and the lath 360 can only be removed when the installer lifts the lath 360 upwards out of the notched region formed the pronged teeth 358 and the front attachment plate 347. In between each pronged tooth 358 and pronged tooth hole 349 are attachment plate mounting holes 348 where a screw wall mounting screw 352 can be inserted through the attachment plate mounting hole 348, through insulation 356, and mount the lath 360, attachment strip 340 to the wall 354. By using a piece of insulation that fits into the trapezoidal shaped attachment strip 340, an barrier is created that prevents seepage of water from the lath 360 into a hole created by the screw 352 into the wall 354. As the attachment strip 340 is secured to the wall 354, the insulation 356 is squeezed into any holes created by the penetration, thus reducing water seepage. A lath mounting screw 350 may also be used that can help to secure the lath 360 to the attachment strip 340 and insulation 356, but not penetrate into a wall 354.

FIGS. 15-19 depict embodiments of an attachment strip 370 configured to envelope one or more pieces of cylindrical piece of insulation 378 adjacent to a wall 380. With specific reference to FIG. 15, the attachment strip 370 has a pair of mounting plates 372 integral with a pair of side attachment plates 374 connected via a front mounting plate 376 where a lath can be attached. The attachment strip 370 is trapezoidal in shape. The insulation 378 functions not only as an insulator, but will fill in any holes created by mounting devices such as a screw that penetrates a wall 380, thus increasing the water resistance of the attachment strip assembly 370.

Figure 1B:
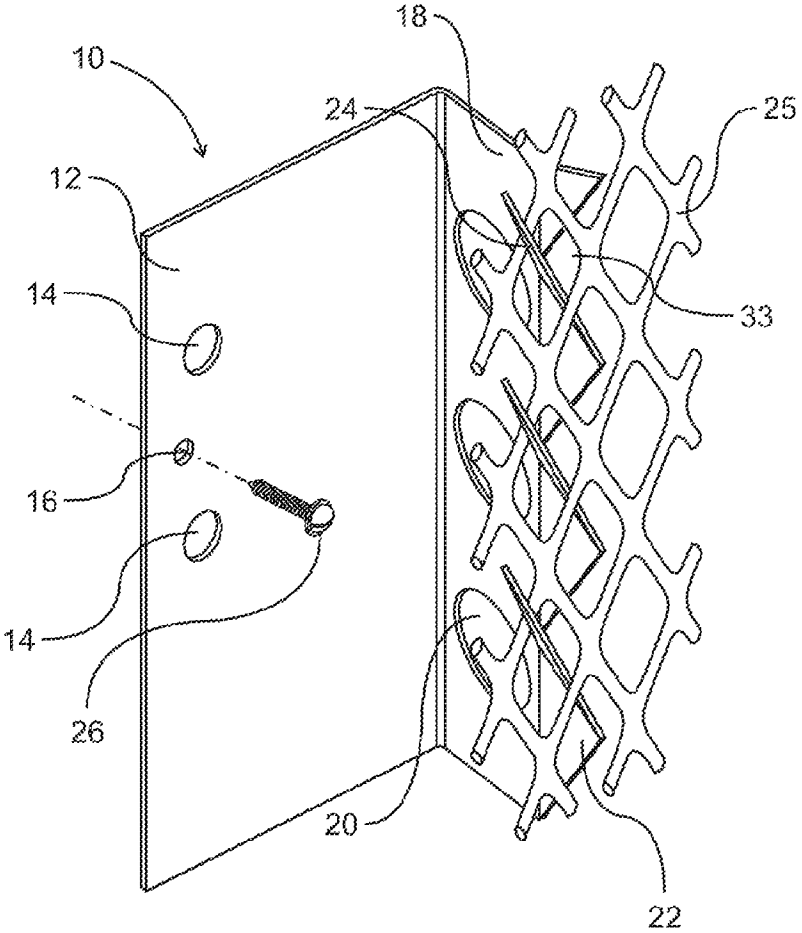
FIG. 1*b* is a perspective view of an attachment strip having slanted teeth assembled with a lath.
Figure 1A:
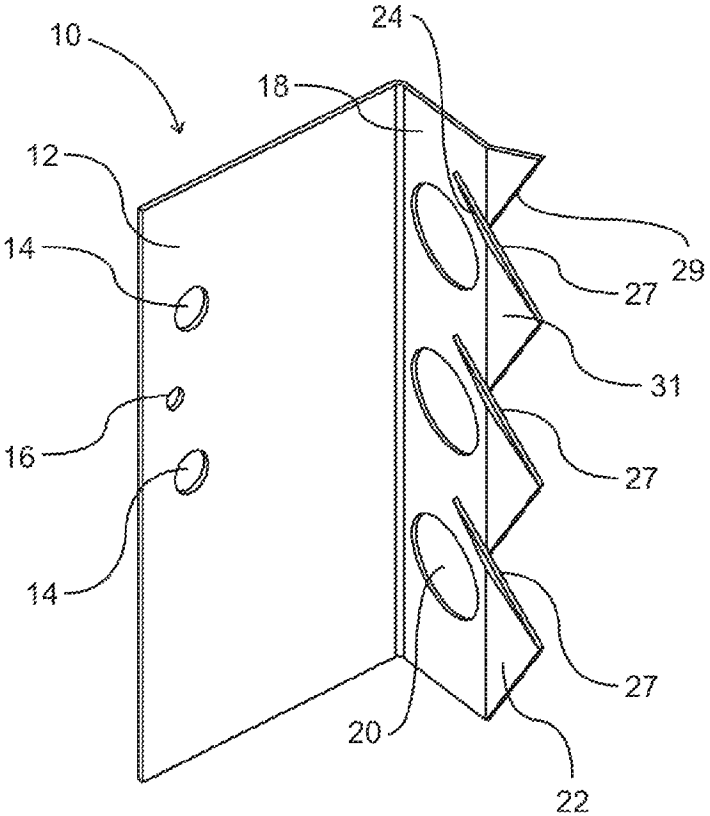
FIG. 1*a* is a perspective view of an attachment strip having slanted teeth.
Figure 1E:
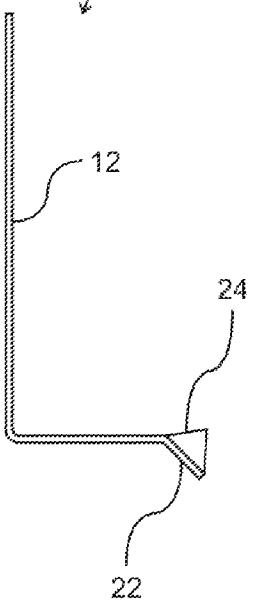
FIG. 1*e* is a top view of an attachment strip having slanted teeth.
Figure 1D:
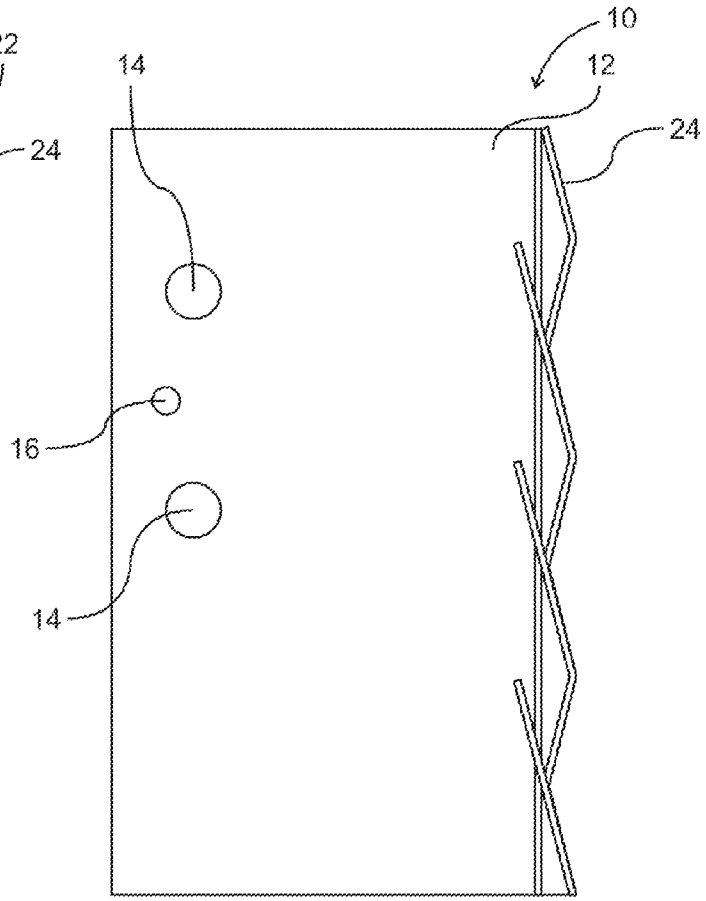
FIG. 1*d* is a side view of an attachment strip having slanted teeth.
Figure 1C:
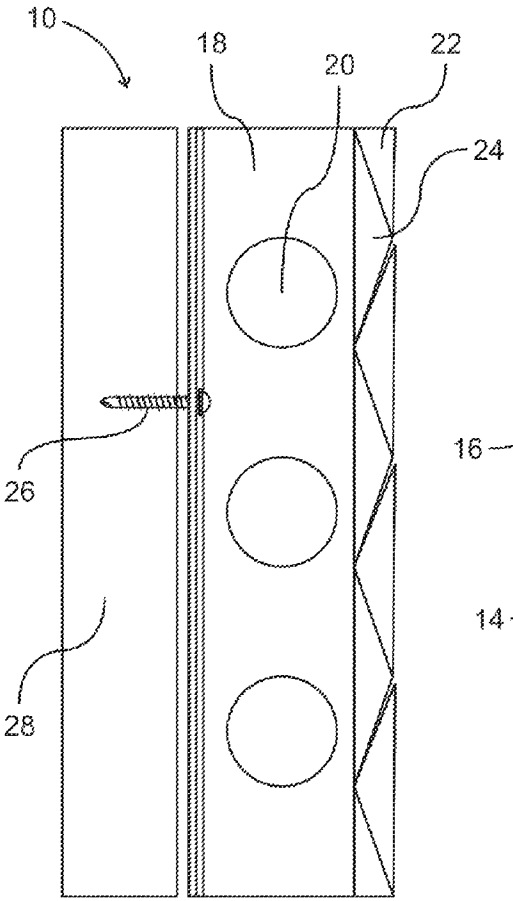
FIG. 1*c* is a front view of an attachment strip having slanted.
Figure 2B:
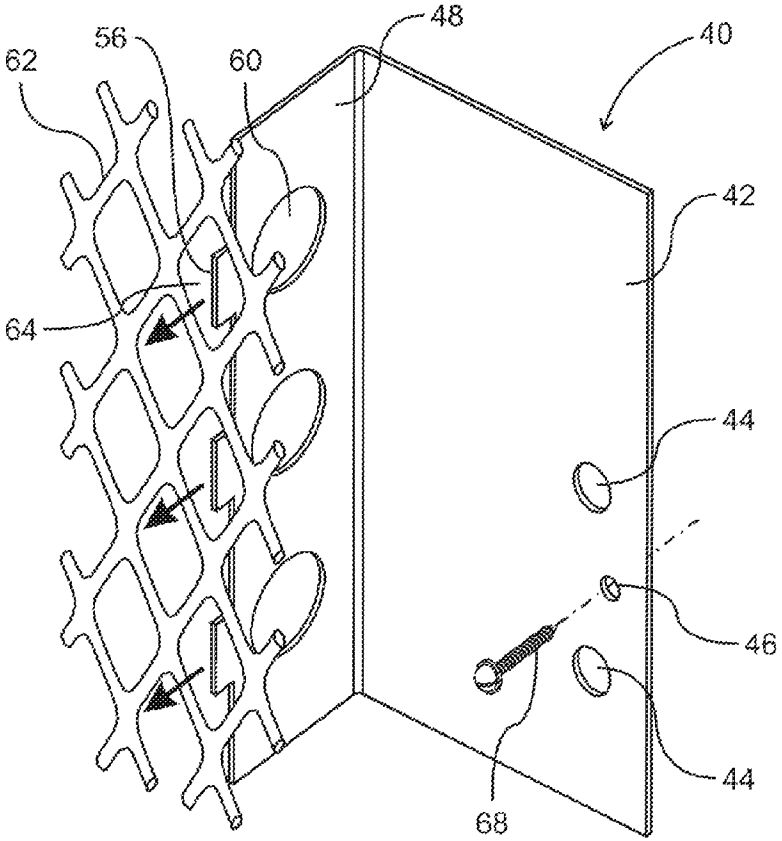
FIG. 2*b* is a perspective view of an attachment strip having rectangular teeth assembled with a lath.
Figure 2A:
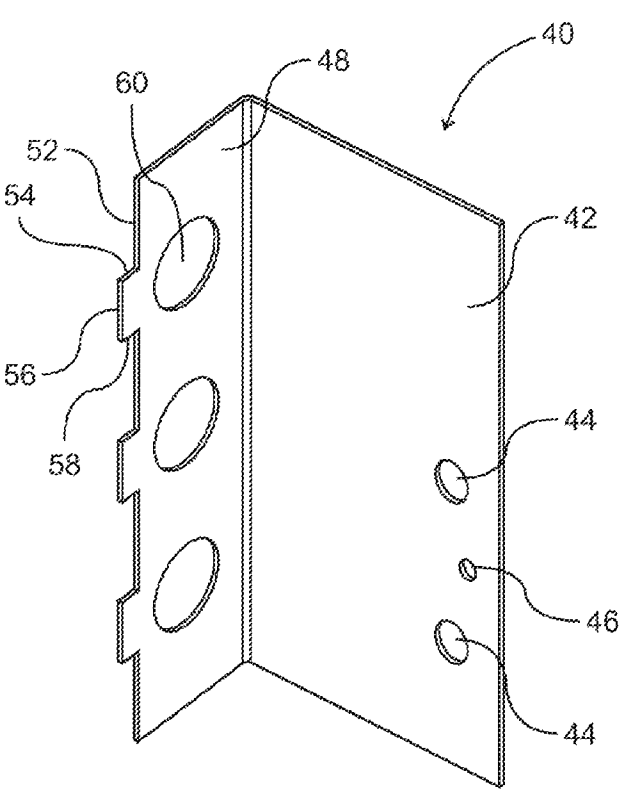
FIG. 2*a* is a perspective view of an attachment strip having rectangular teeth.
Figure 2E:
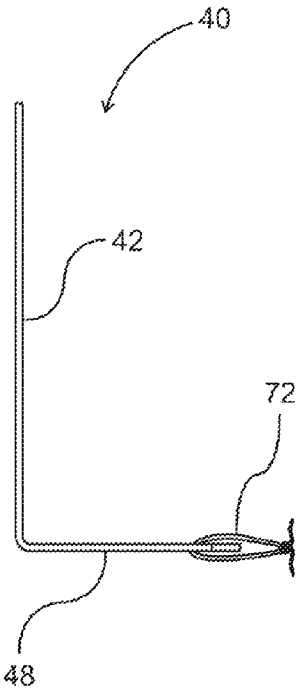
FIG. 2*e* is a top view of an attachment strip having rectangular teeth.
Figure 2D:
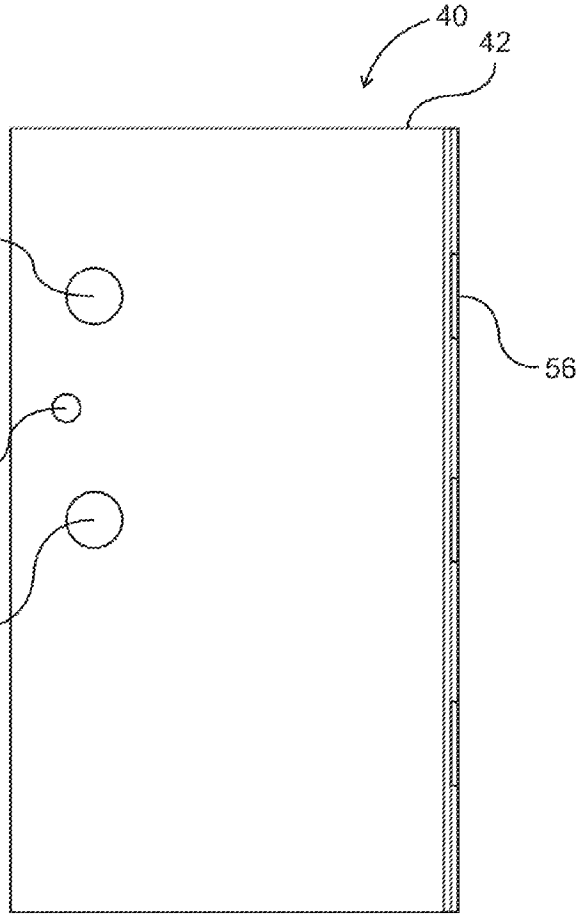
FIG. 2*d* is a side view of an attachment strip having rectangular teeth.
Figure 2C:
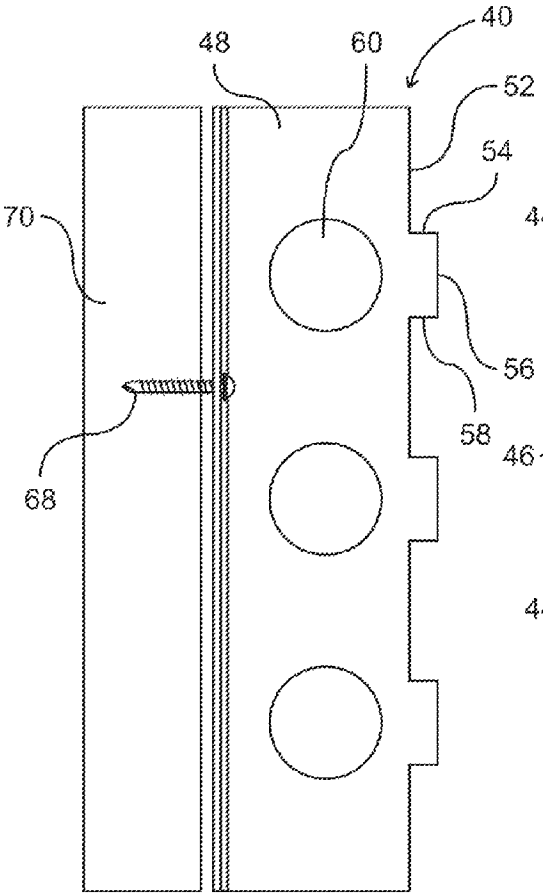
FIG. 2*c* is a front view of an attachment strip having rectangular teeth.
Figure 3B:
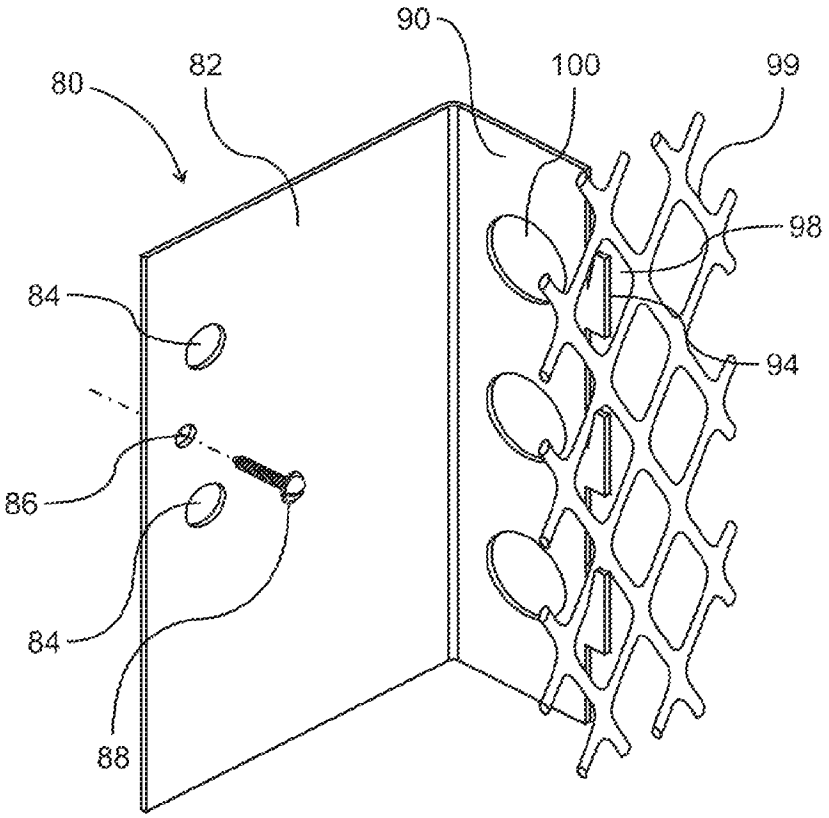
FIG. 3*b* is a perspective view of an attachment strip having rectangular notched teeth assembled with a lath.
Figure 3A:
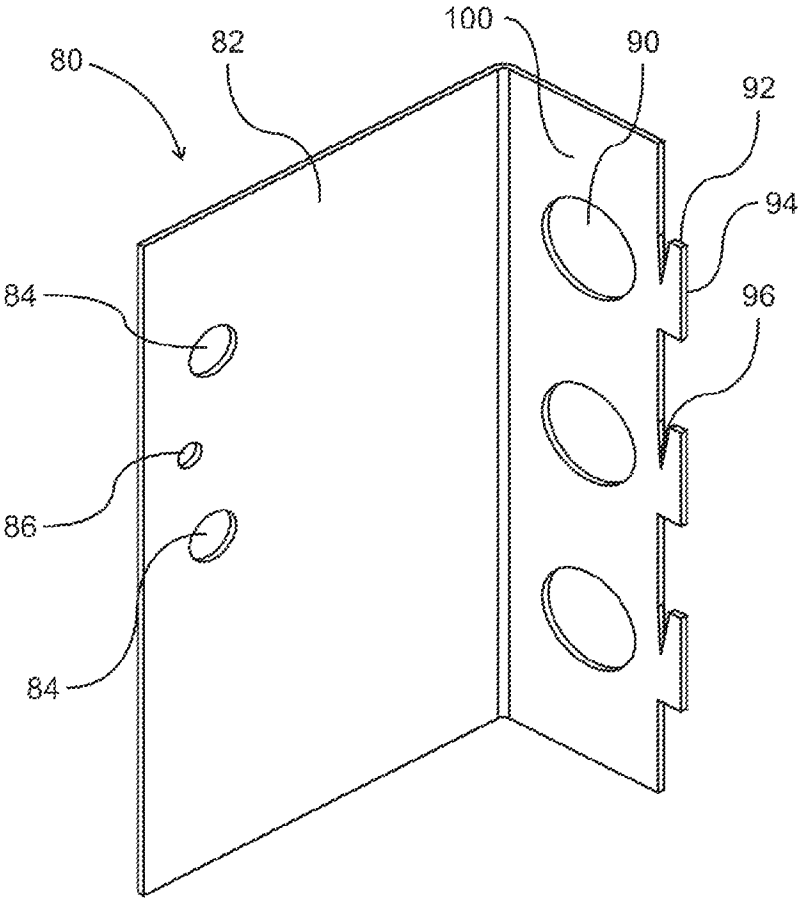
FIG. 3*a* is a perspective view of an attachment strip having rectangular notched teeth.
Figure 3E:
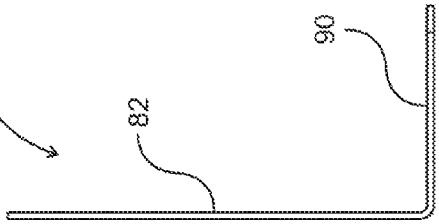
FIG. 3*e* is a top view of an attachment strip having rectangular notched teeth.
Figure 3D:
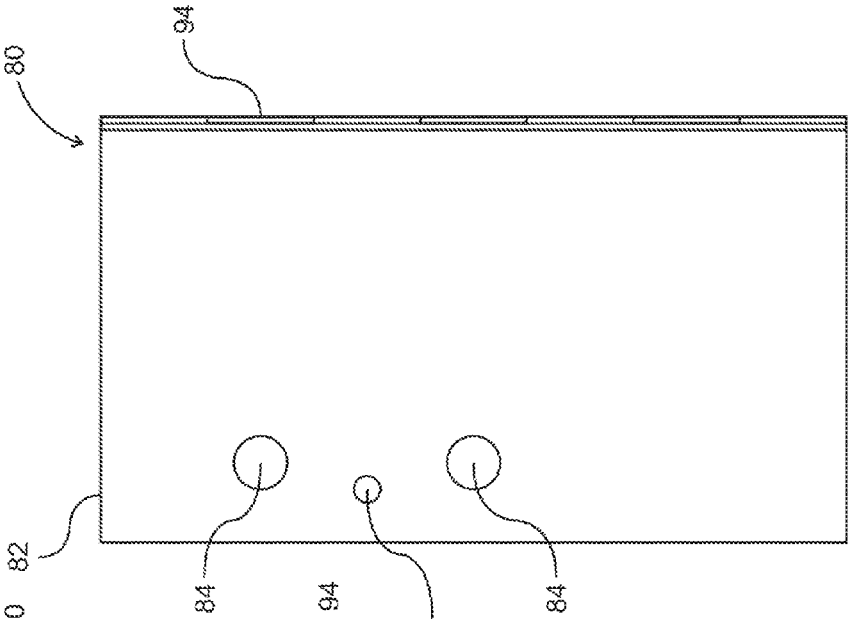
FIG. 3*d* is a side view of an attachment strip having rectangular notched teeth.
Figure 3C:
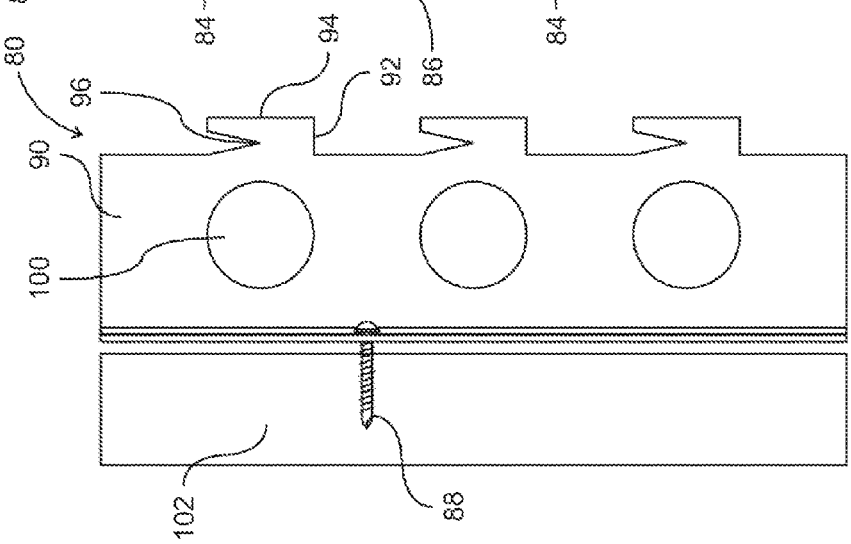
FIG. 3*c* is a front view of an attachment strip having rectangular notched teeth.
Figure 4B:
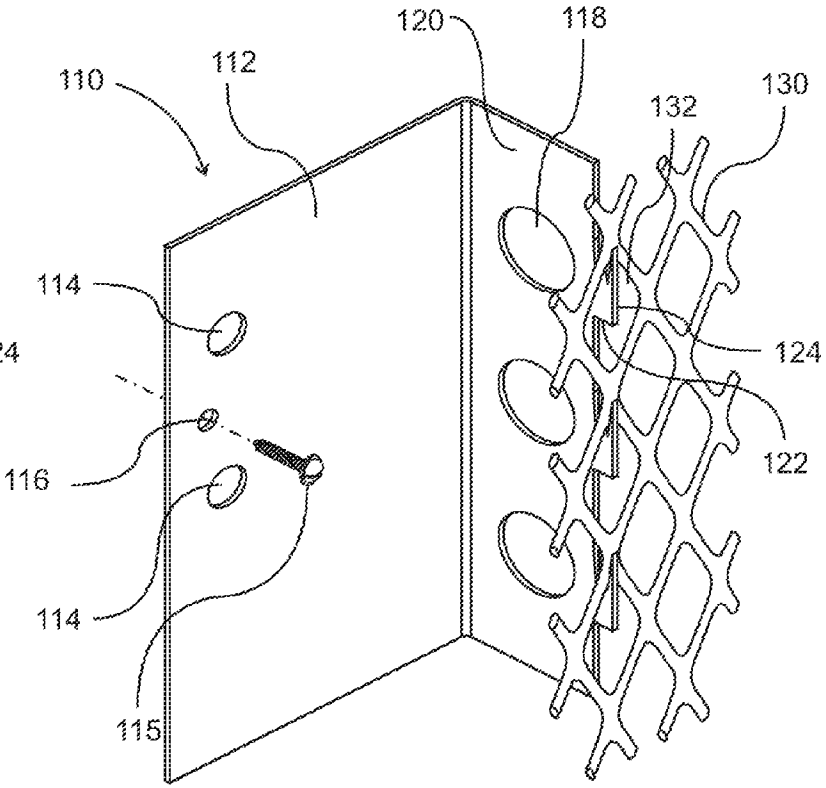
FIG. 4*b* is a perspective view of an attachment strip having rectangular double notched teeth assembled with a lath.
Figure 4A:
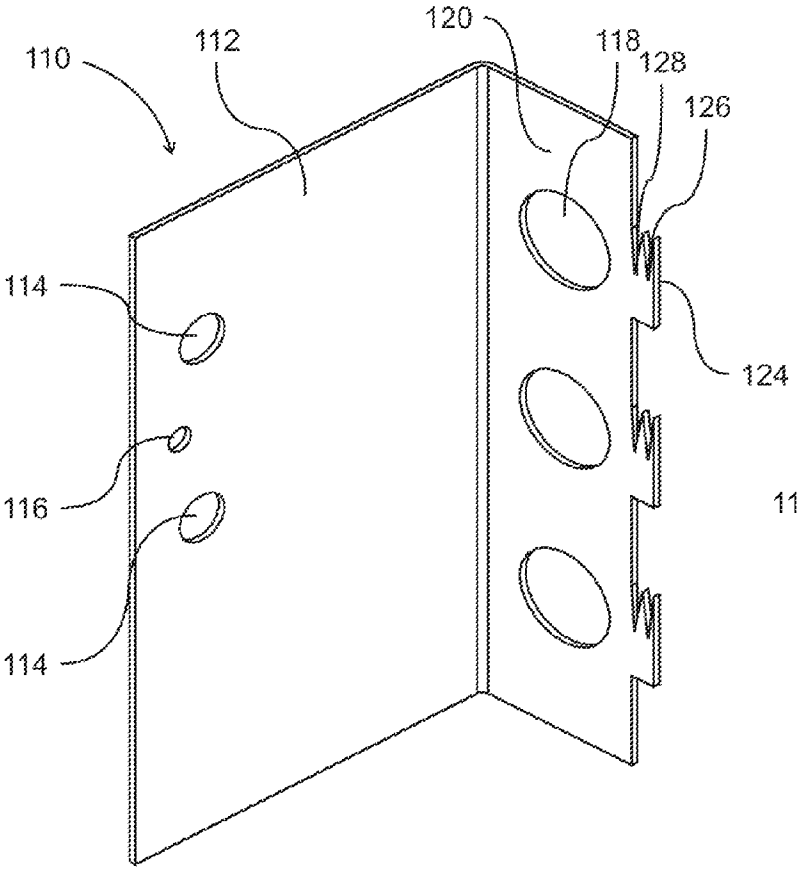
FIG. 4*a* is a perspective view of an attachment strip having rectangular double notched teeth to secure a lath.
Figure 4E:
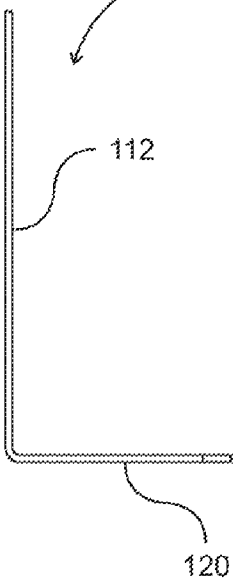
FIG. 4*e* is a top view of an attachment strip having rectangular double notched teeth.
Figure 4D:
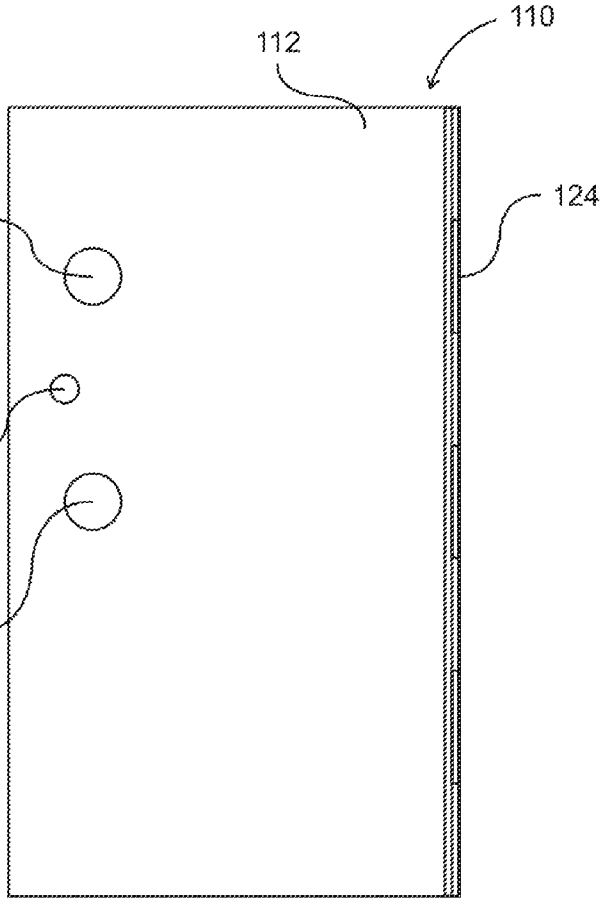
FIG. 4*d* is a side view of an attachment strip having rectangular double notched teeth.
Figure 4C:
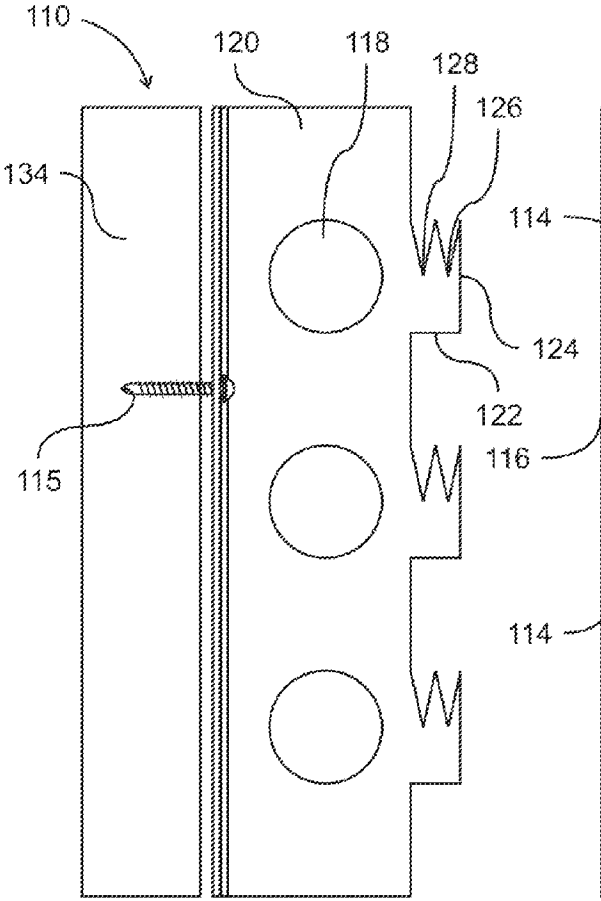
FIG. 4*c* is a front view of an attachment strip having rectangular double notched teeth.
Figure 5B:
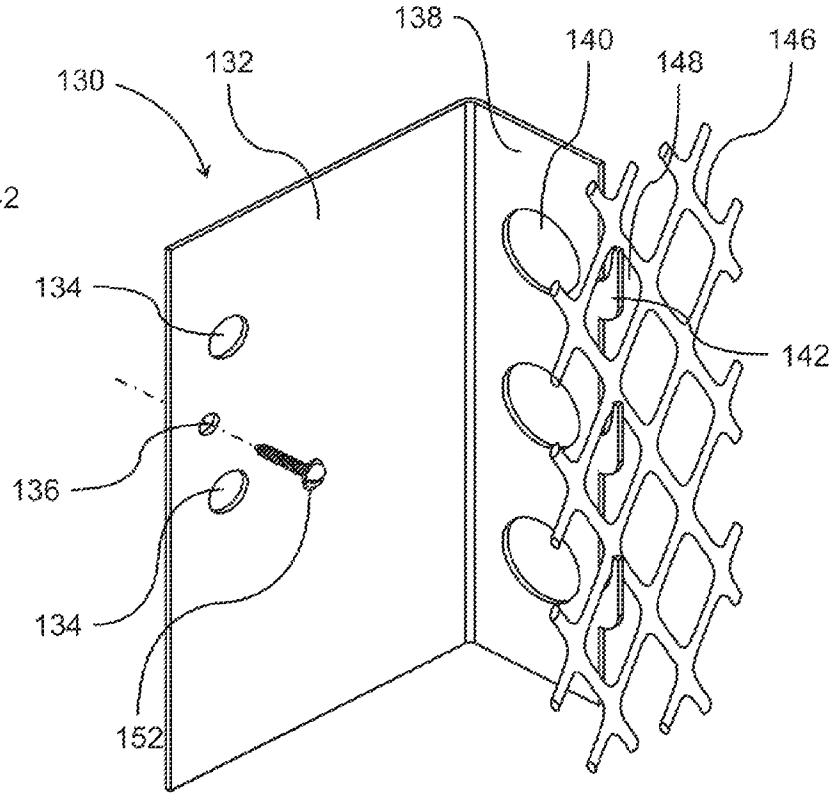
FIG. 5*b* is a perspective view of an attachment strip having curved teeth assembled with a lath.
Figure 5A:
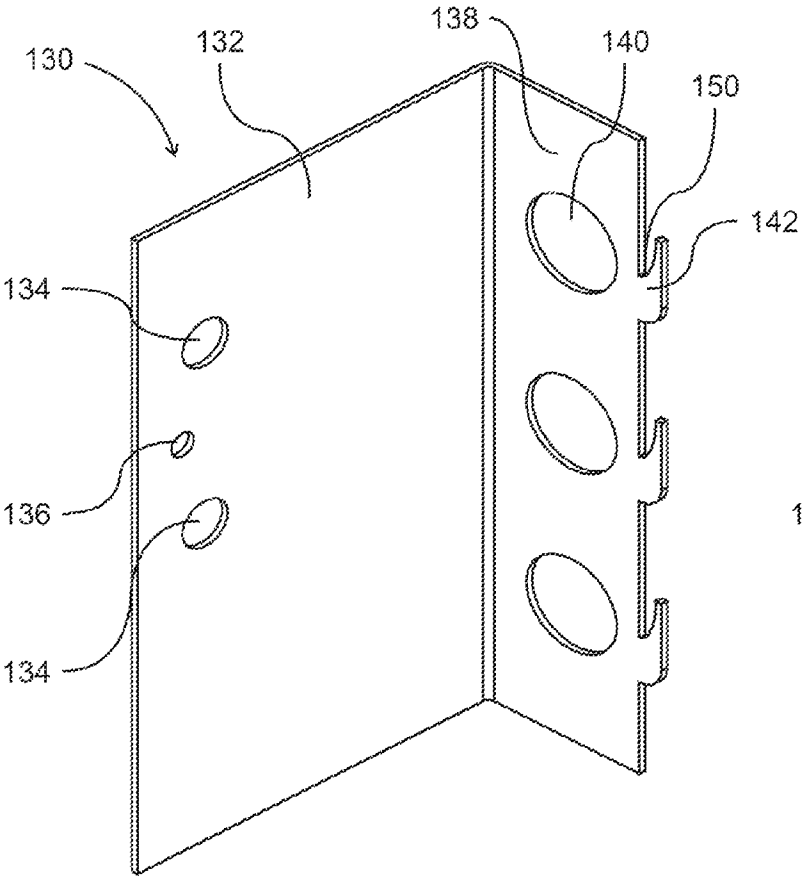
FIG. 5*a* is a perspective view of an attachment strip having curved teeth.
Figure 5E:
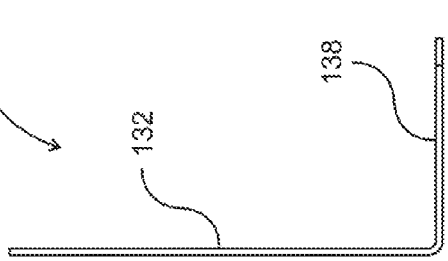
FIG. 5*e* is a top view of an attachment strip having curved teeth.
Figure 5D:
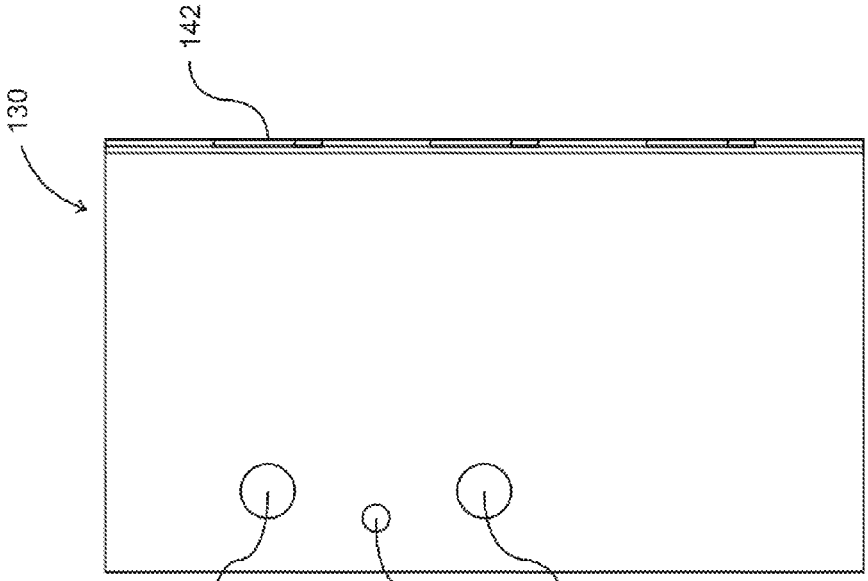
FIG. 5*d* is a side view of an attachment strip having curved teeth.
Figure 5C:
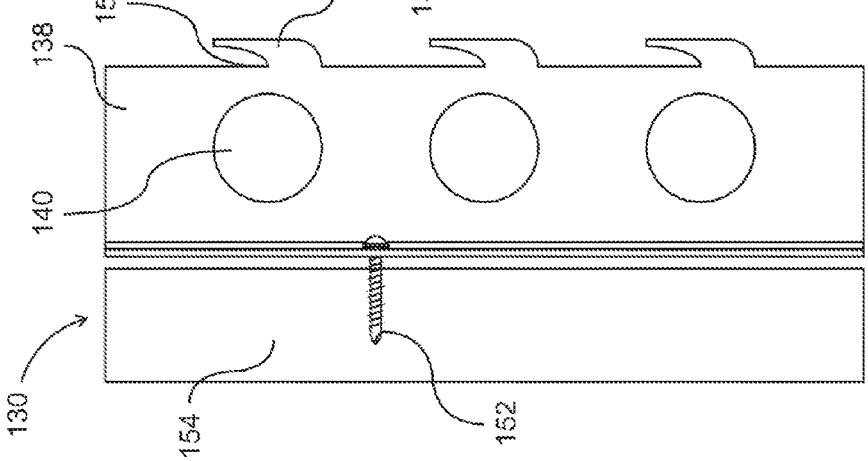
FIG. 5*c* is a front view of an attachment strip having curved teeth.
Figure 6B:
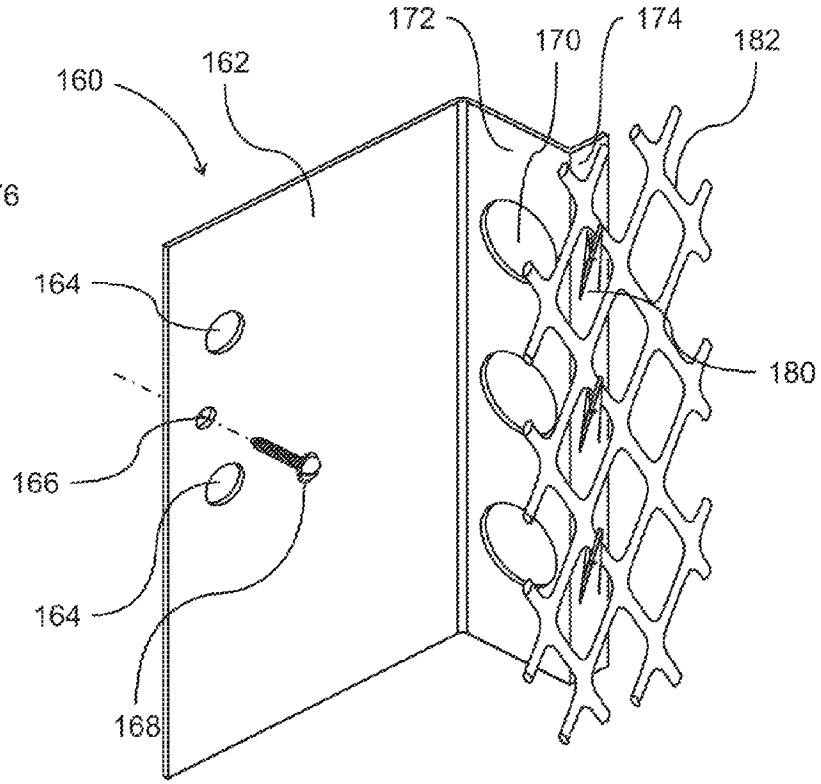
FIG. 6*b* is a perspective view of an attachment strip having teeth on teeth plate assembled with a lath.
Figure 6A:
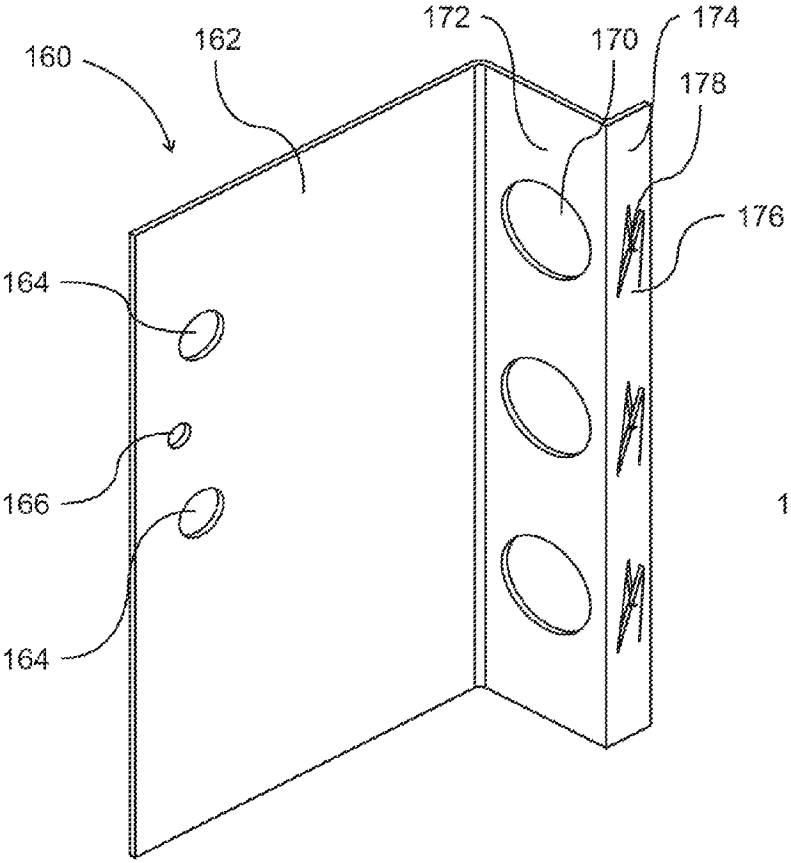
FIG. 6*a* is a perspective view of an attachment strip having teeth on a teeth plate.
Figure 6E:
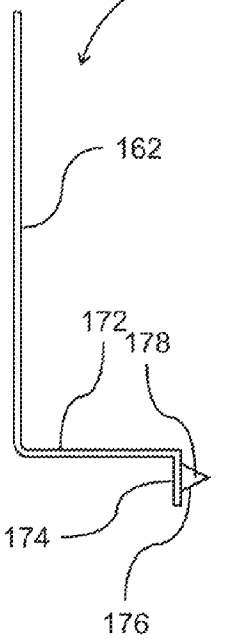
FIG. 6*e* is a top view of an attachment strip having teeth on a teeth plate.
Figure 6D:
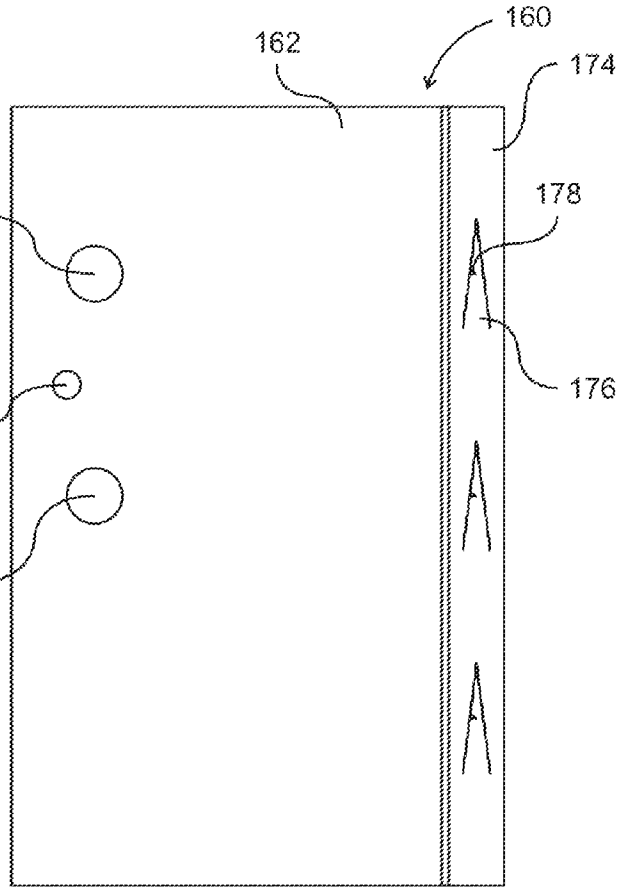
FIG. 6*d* is a side view of an attachment strip having teeth on a teeth plate.
Figure 6C:
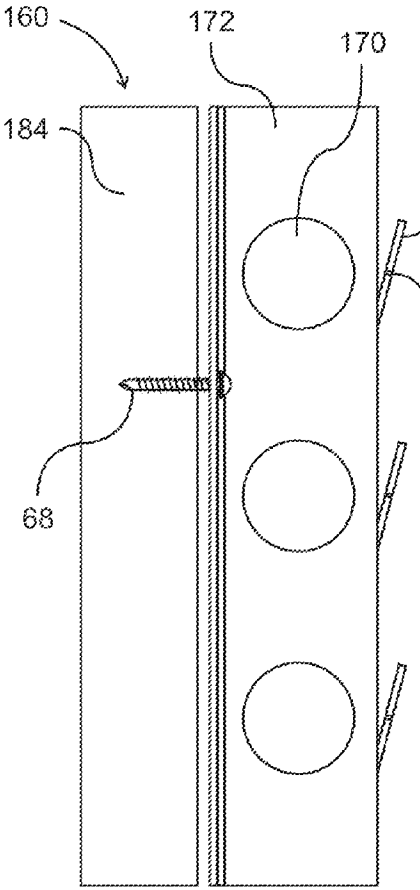
FIG. 6*c* is a front view of an attachment strip having teeth on a teeth plate.
Figure 7B:
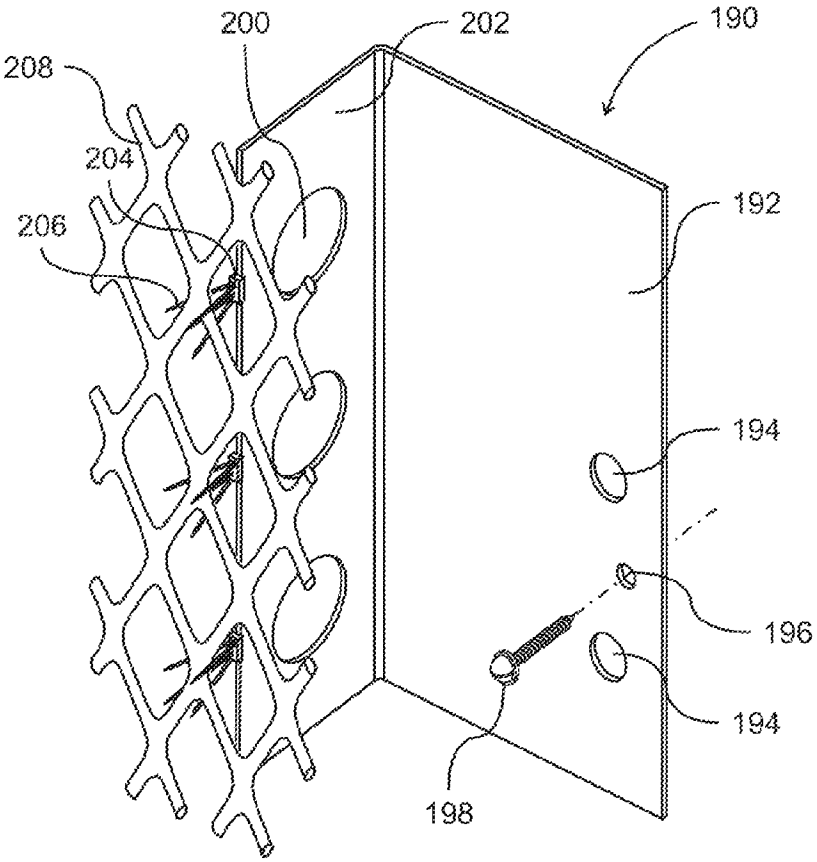
FIG. 7*b* is a perspective view of an attachment strip having prongs assembled with a lath.
Figure 7A:
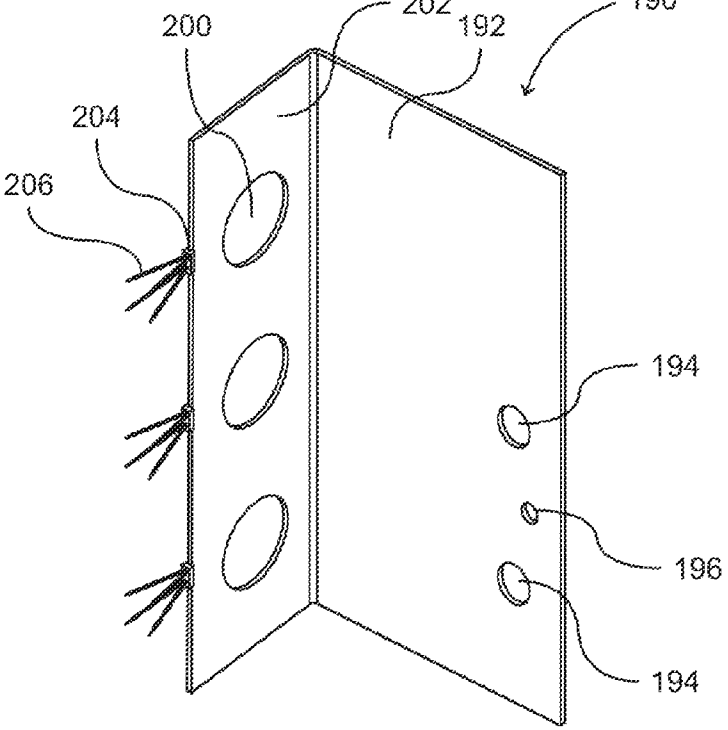
FIG. 7*a* is a perspective view of an attachment strip having prongs.
Figures 7C, 7D, 7E:
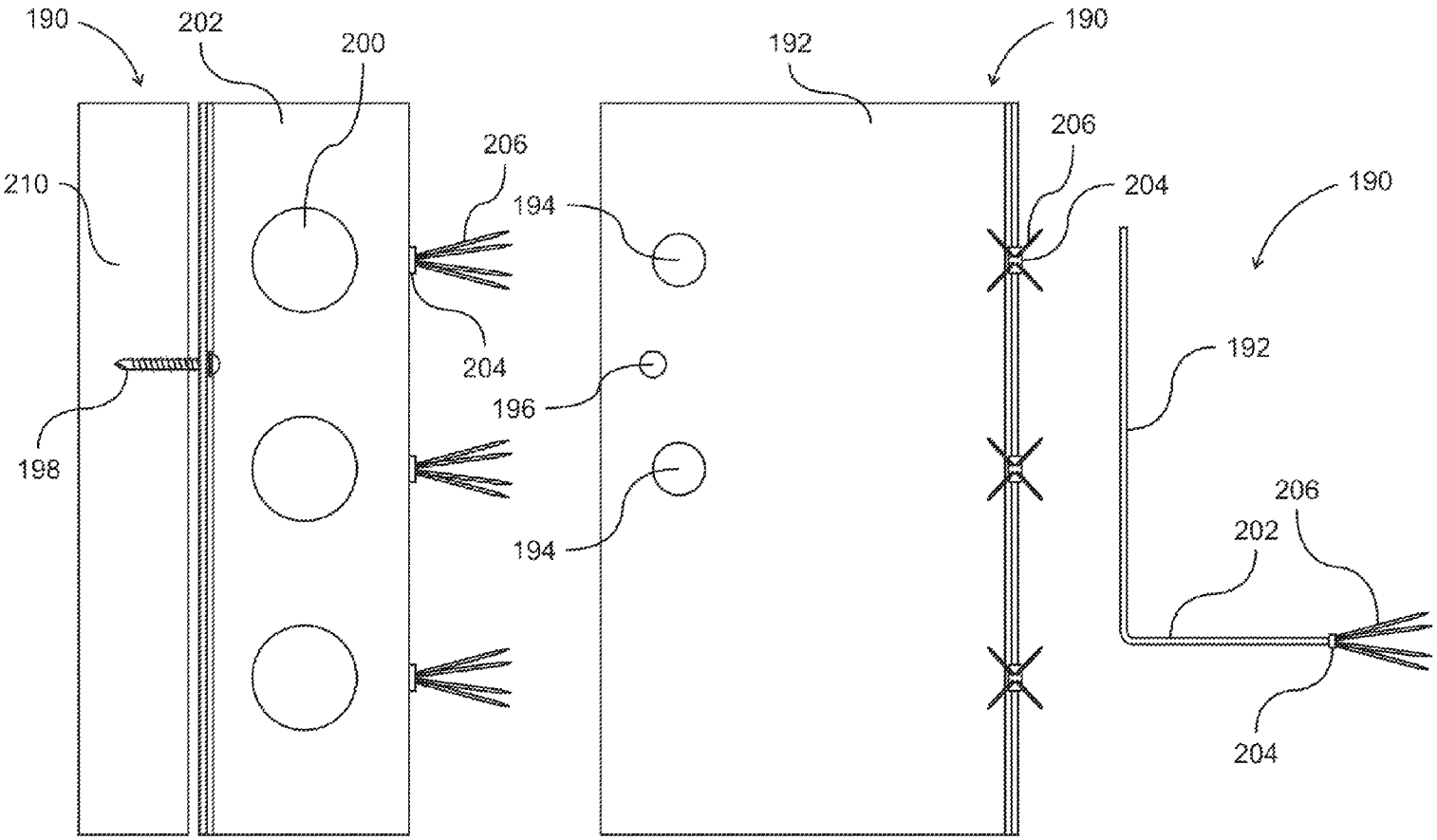
FIG. 7*c* is a front view of an attachment strip having prongs.
FIG. 7*d* is a side view of an attachment strip having prongs.
FIG. 7*e* is a top view of an attachment strip having prongs.
Figure 8B:
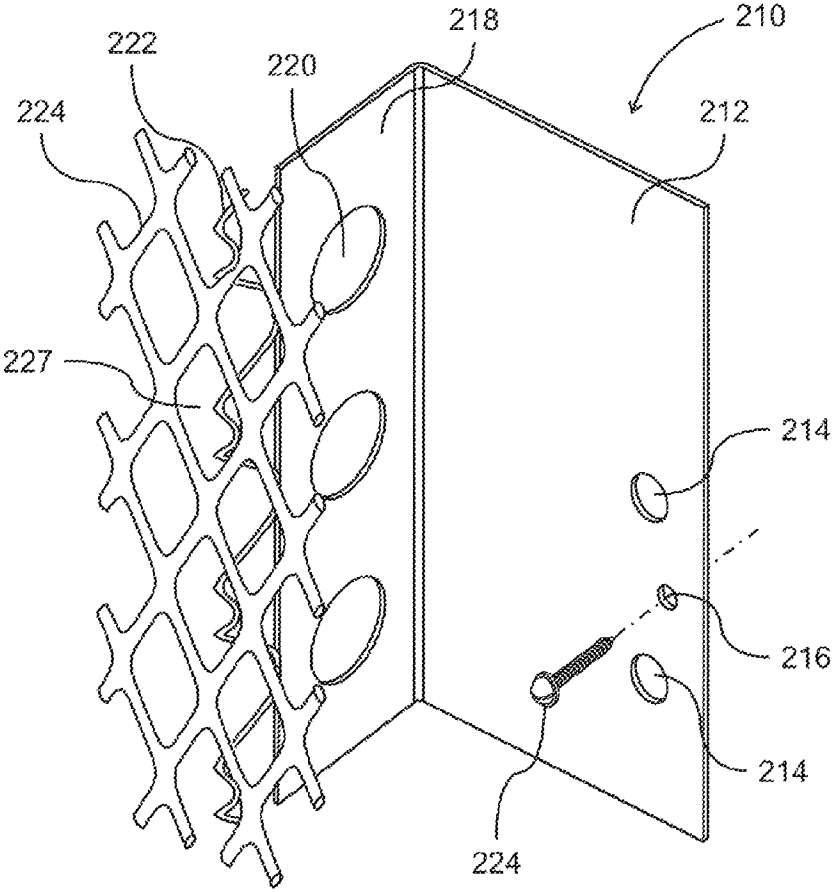
FIG. 8*b* is a perspective view of an attachment strip having a metal foldable lath securing wire assembled with a lath.
Figure 8A:
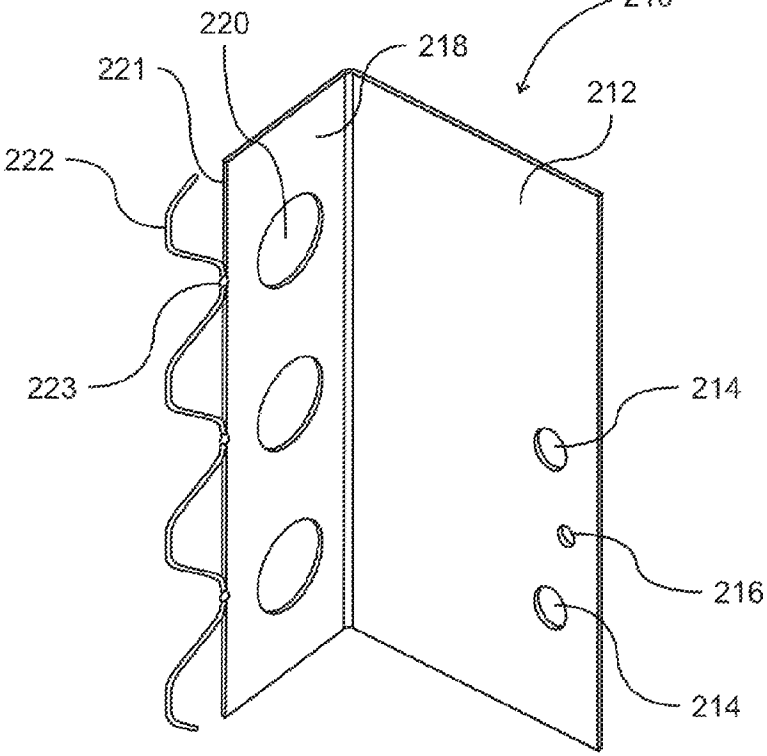
FIG. 8*a* is a perspective view of an attachment strip having a metal foldable lath securing wire.
Figure 8E:
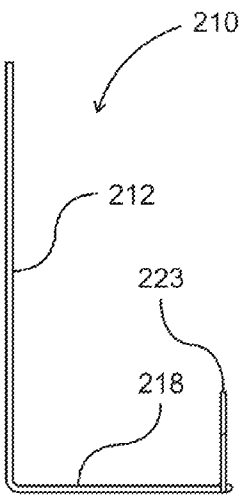
FIG. 8*e* is a top view of an attachment strip having a metal foldable lath securing wire.
Figure 8D:
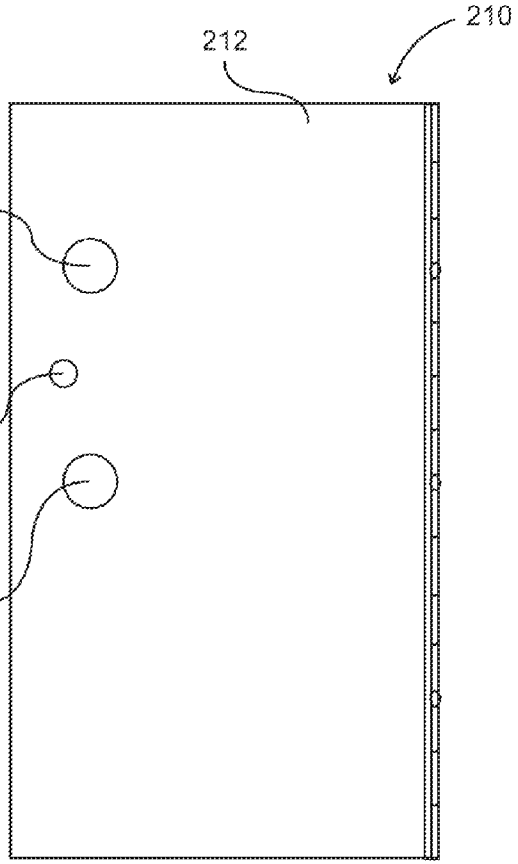
FIG. 8*d* is a side view of an attachment strip having a metal foldable lath securing wire.
Figure 8C:
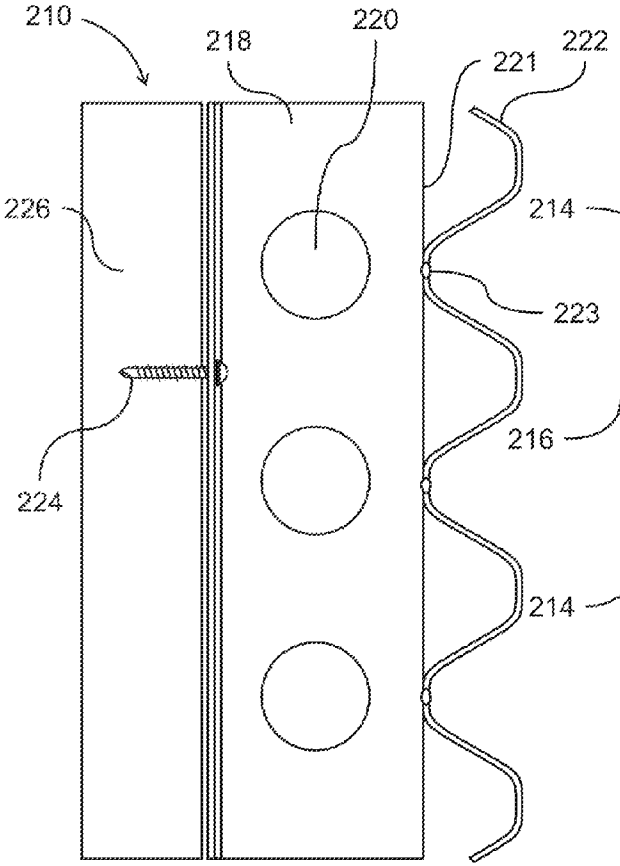
FIG. 8*c* is a front view of an attachment strip having a metal foldable lath securing wire.
Figure 9B:
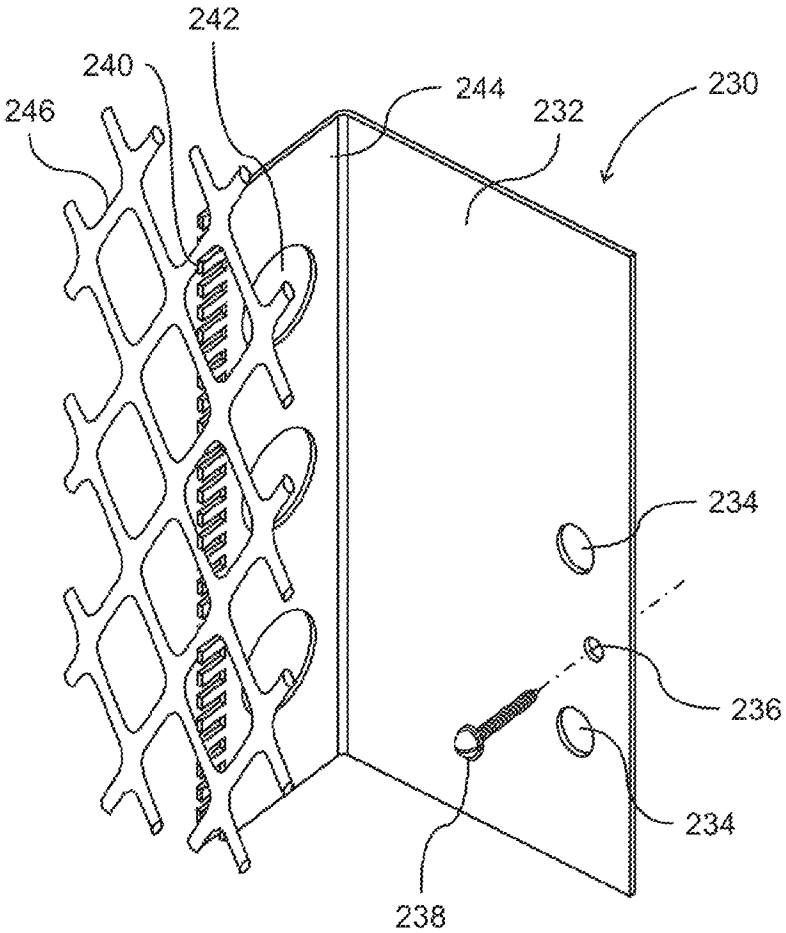
FIG. 9*b* is a perspective view of an attachment strip having a series of small rectangular teeth assembled with a lath.
Figure 9A:
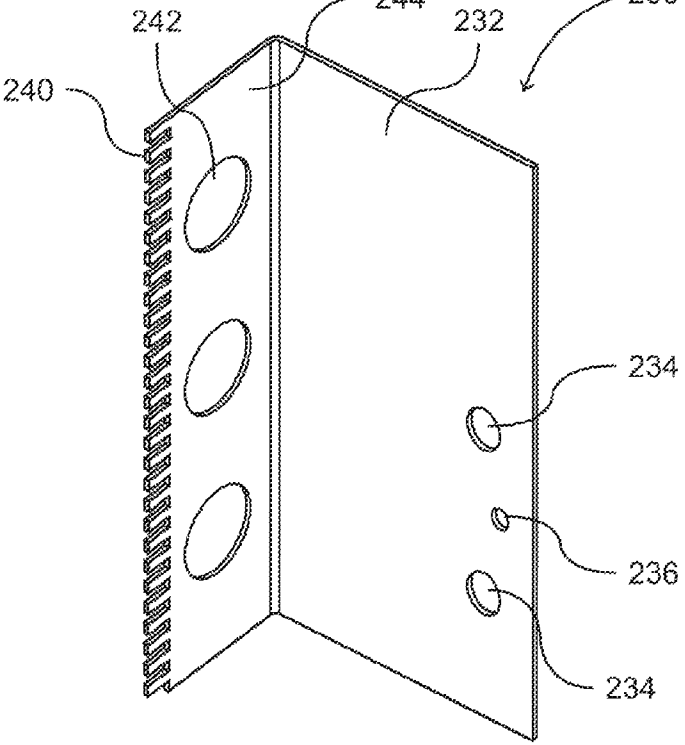
FIG. 9*a* is a perspective view of an attachment strip having a series of small rectangular teeth.
Figure 9E:
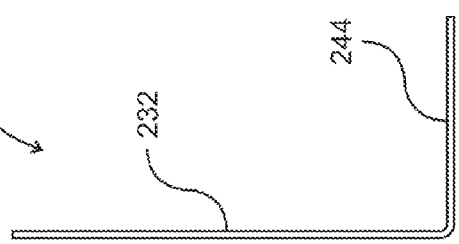
FIG. 9*e* is a top view of an attachment strip having a series of small rectangular teeth.
Figure 9D:
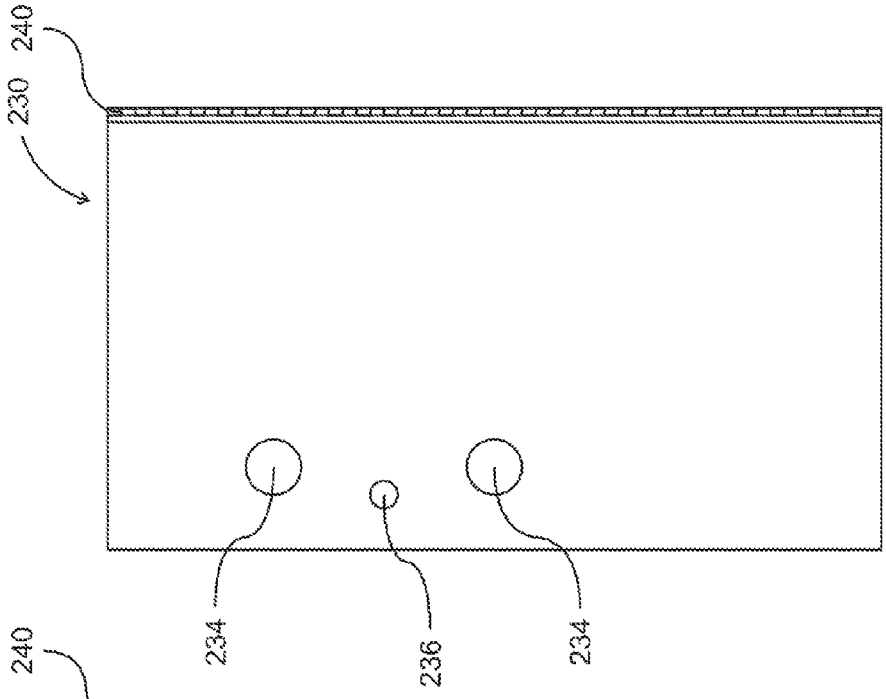
FIG. 9*d* is a side view of an attachment strip having a series of small rectangular teeth.
Figure 9C:
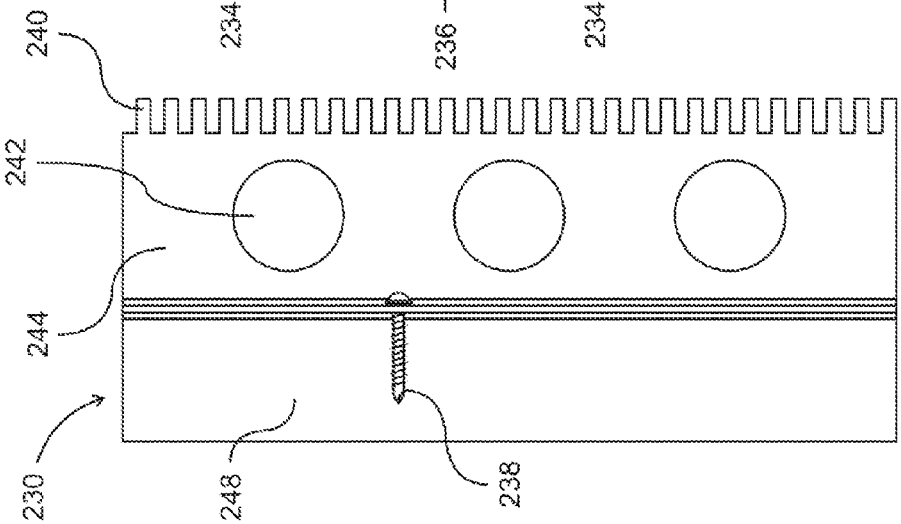
FIG. 9*c* is a front view of an attachment strip having a series of small rectangular teeth.
Figure 10B:
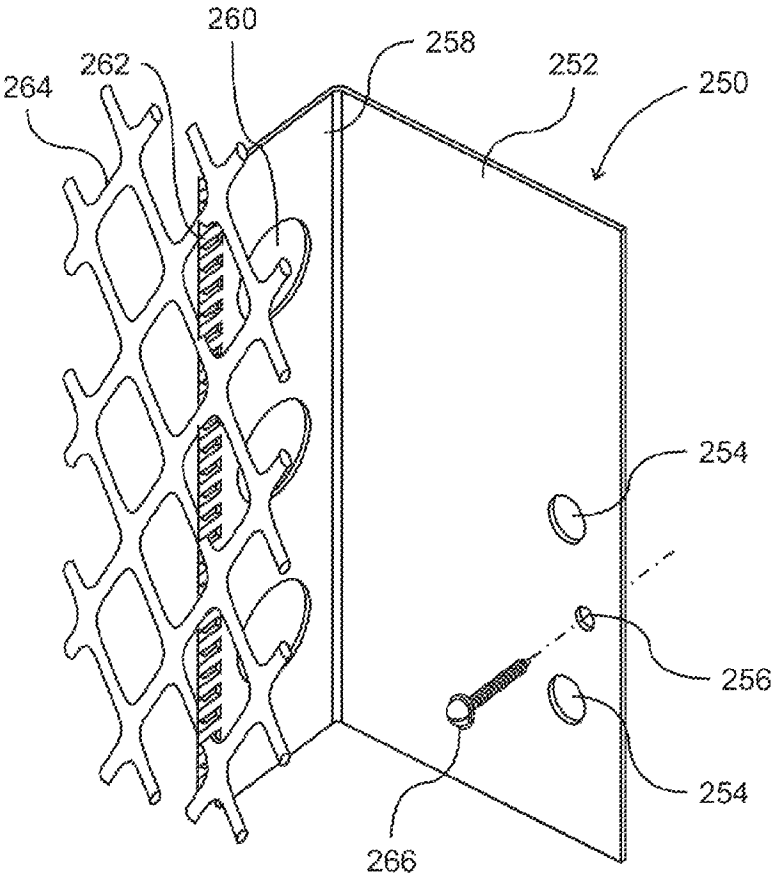
FIG. 10*b* is a perspective view of an attachment strip having a series of small rectangular hooked teeth assembled with a lath.
Figure 10A:
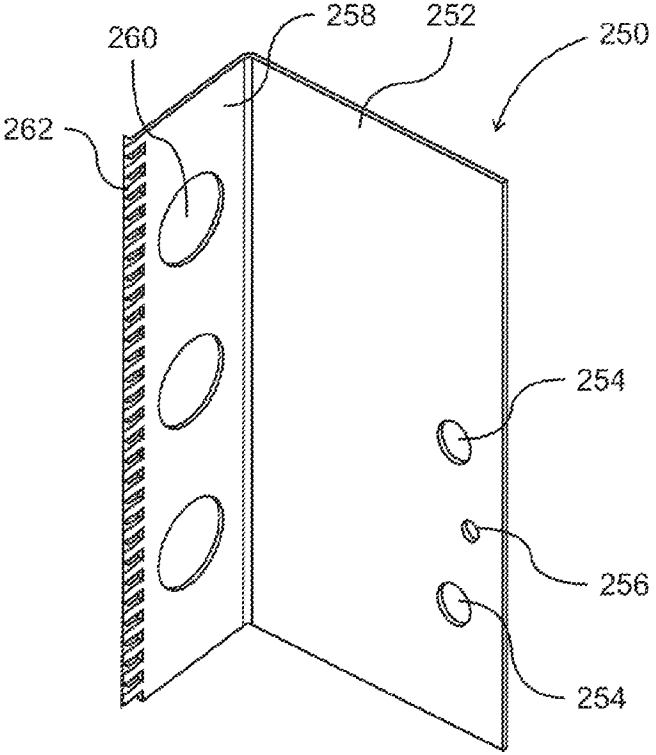
FIG. 10*a* is a perspective view of an attachment strip having a series of small rectangular hooked teeth.
Figure 10E:
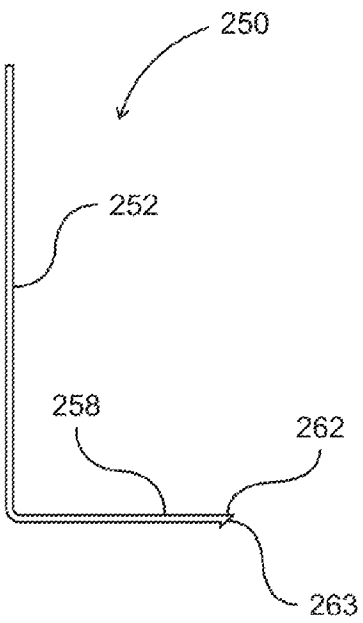
FIG. 10*e* is a top view of an attachment strip having a series of small rectangular hooked teeth.
Figure 10D:
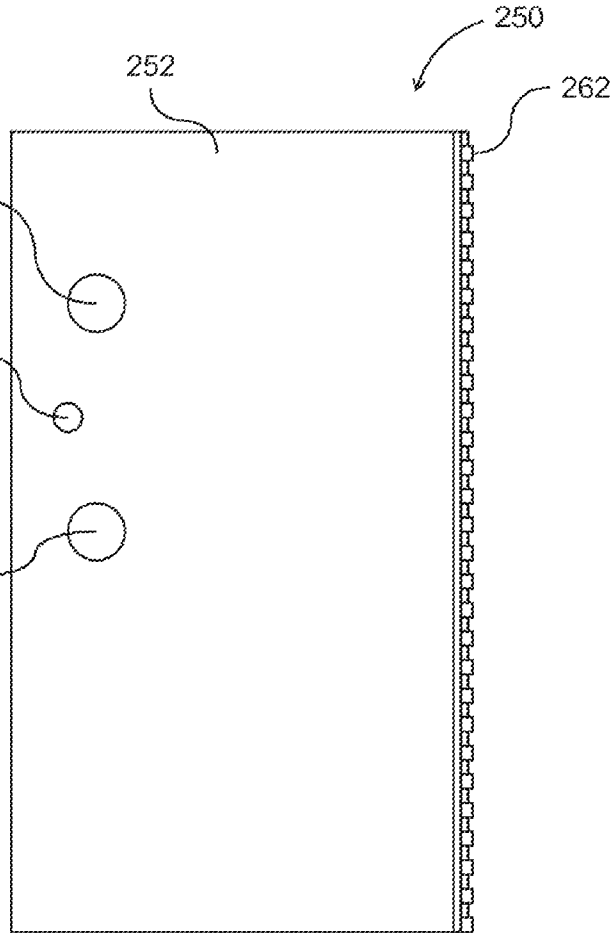
FIG. 10*d* is a side view of an attachment strip having a series of small rectangular hooked teeth.
Figure 10C:
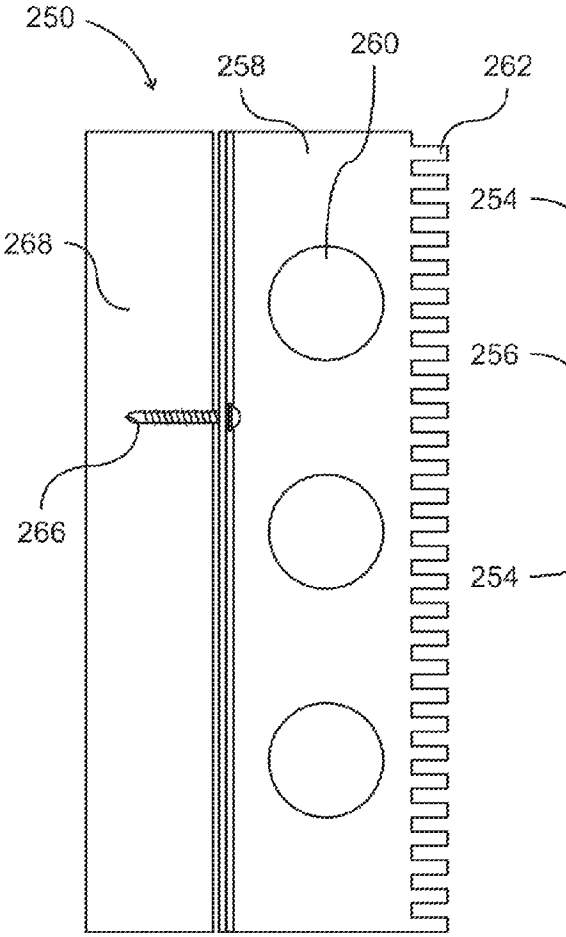
FIG. 10*c* is a front view of an attachment strip having a series of small rectangular hooked teeth.
Figure 11B:
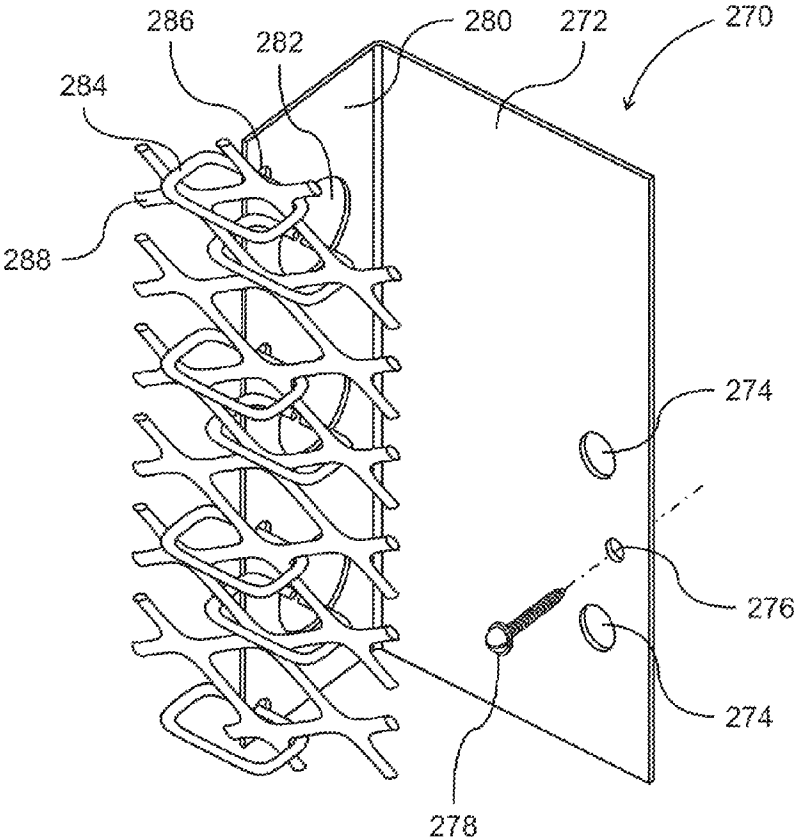
FIG. 11*b* is a perspective view of an attachment strip having C-clamps assembled with a lath.
Figure 11A:
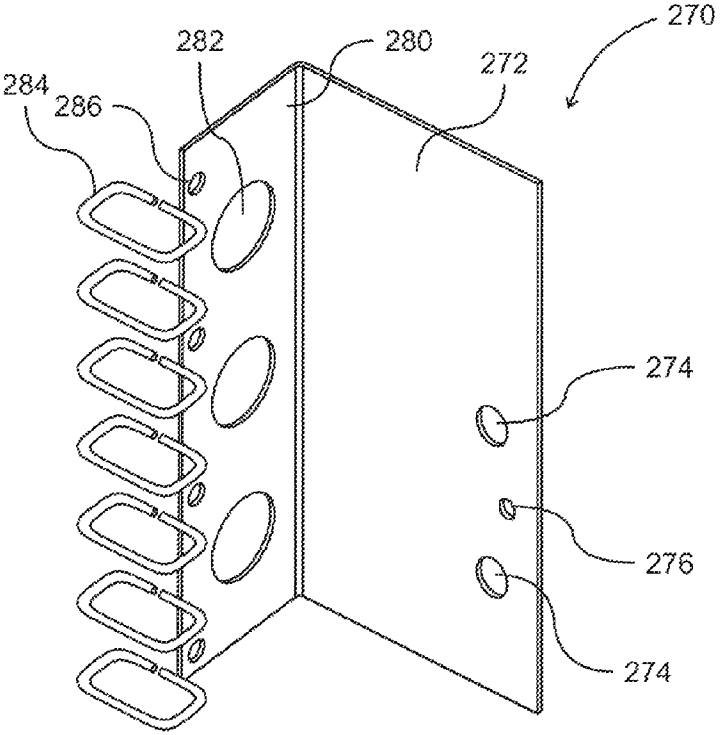
FIG. 11*a* is a perspective view of an attachment strip having C-clamps.
Figure 11E:
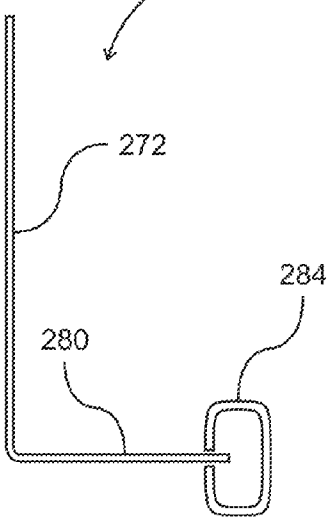
FIG. 11*e* is a top view of an attachment strip having C-clamps.
Figure 11D:
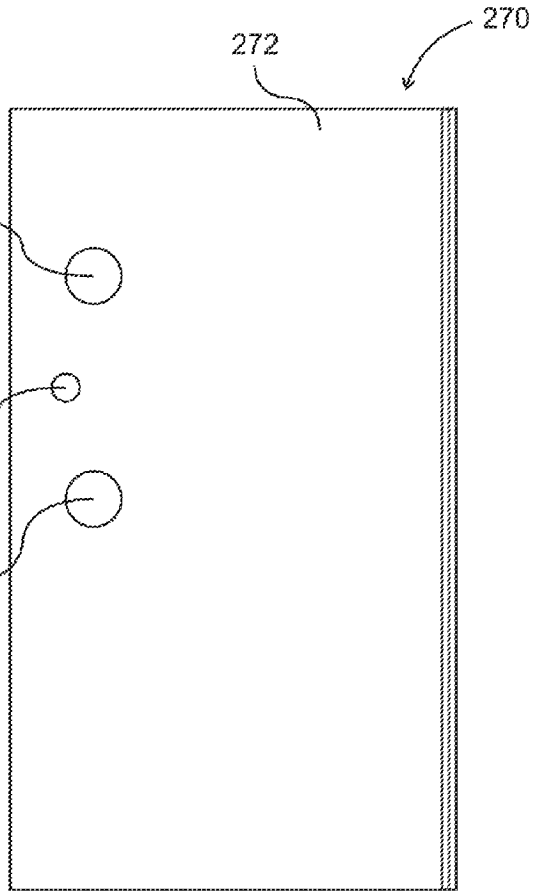
FIG. 11*d* is a side view of an attachment strip having C-clamps.
Figure 11C:
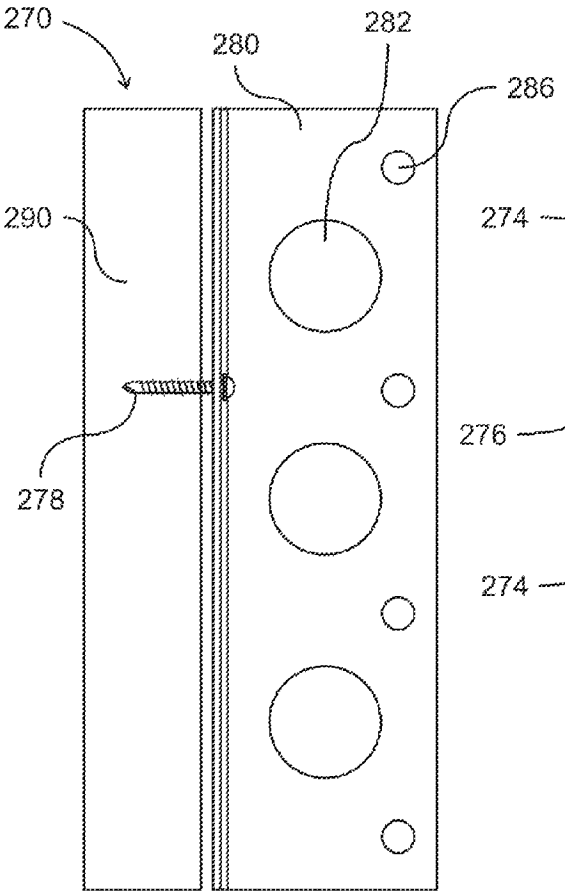
FIG. 11*c* is a front view of an attachment strip having C-clamps.
Figure 12B:
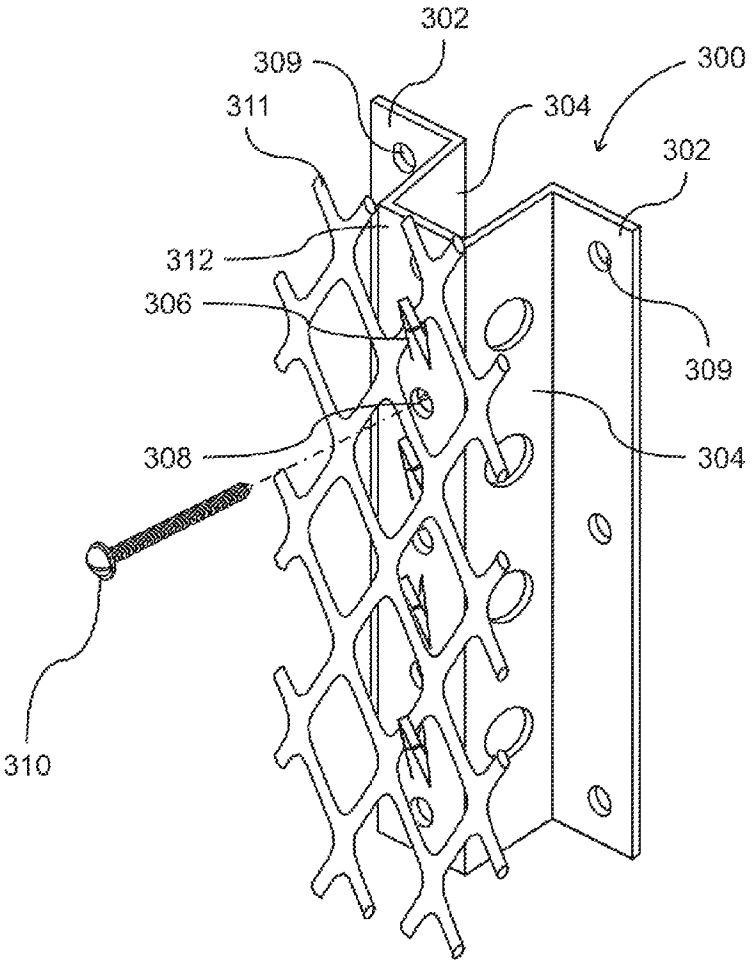
FIG. 12*b* is a perspective view of a trapezoidal attachment strip having teeth assembled with a lath.
Figure 12A:
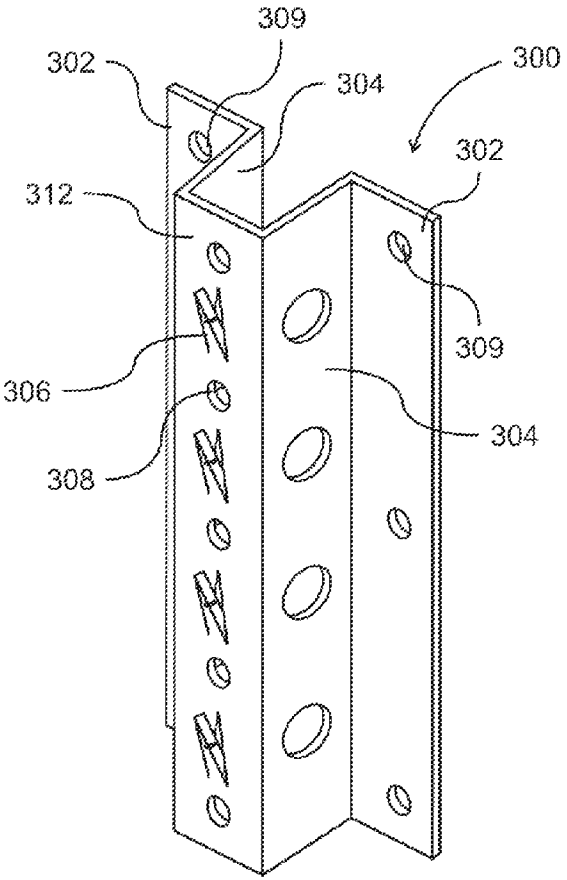
FIG. 12*a* is a perspective view of a trapezoidal attachment strip having teeth.
Figure 12E:
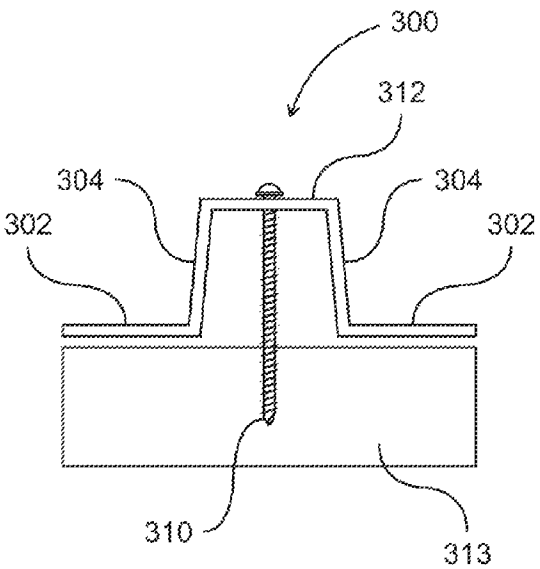
FIG. 12*e* is a top view of a trapezoidal attachment strip having teeth.
Figure 12D:
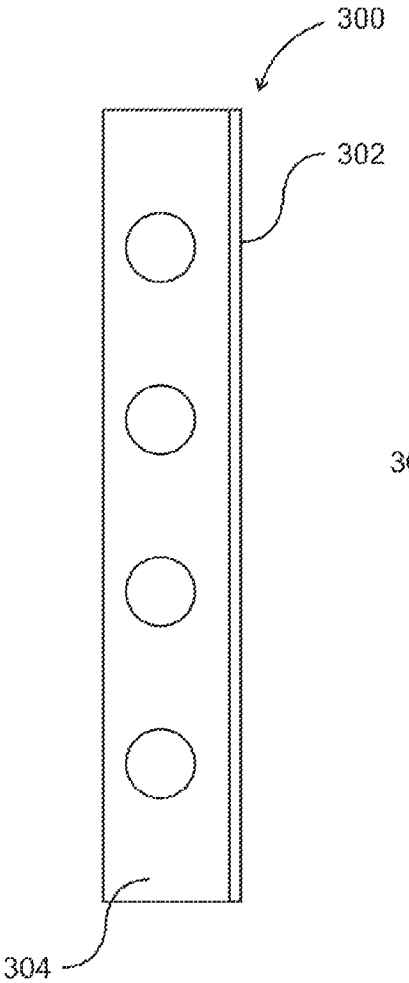
FIG. 12*d* is a side view of a trapezoidal attachment strip having teeth.
Figure 12C:
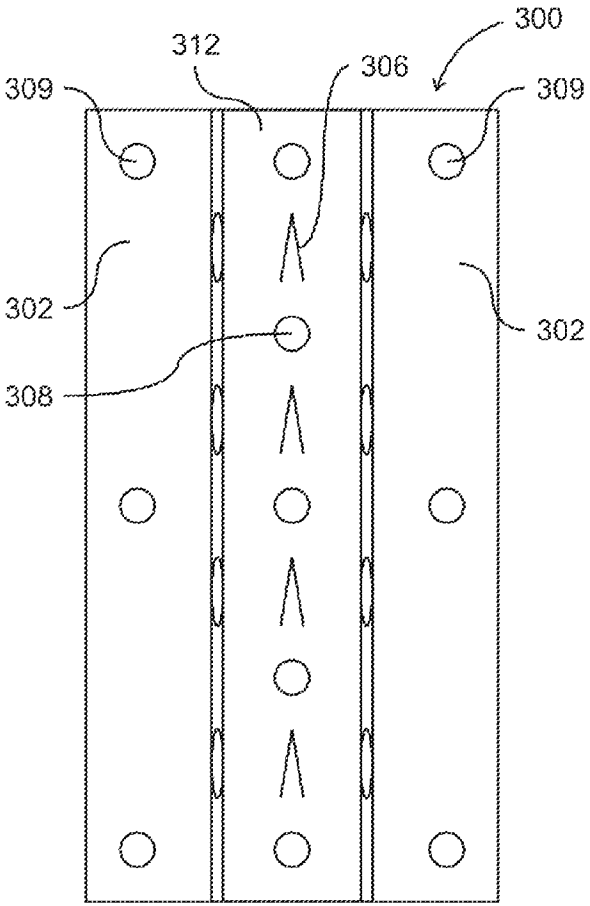
FIG. 12*c* is a front view of a trapezoidal attachment strip having teeth.
Figure 13B:
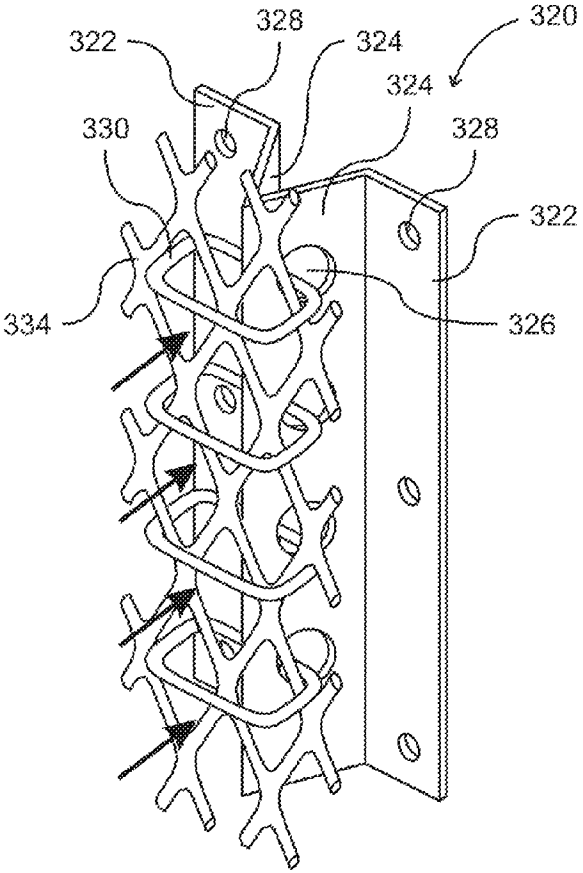
FIG. 13*b* is a perspective view of a triangular attachment strip having C-clamps assembled with a lath.
Figure 13A:
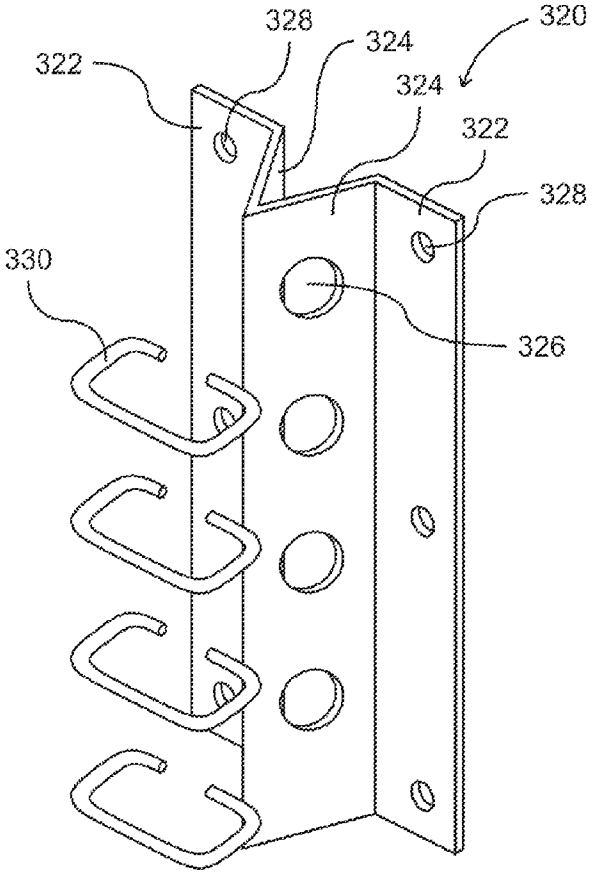
FIG. 13*a* is a perspective view of a triangular attachment strip having C-clamps.
Figures 13C, 13D, 13E:
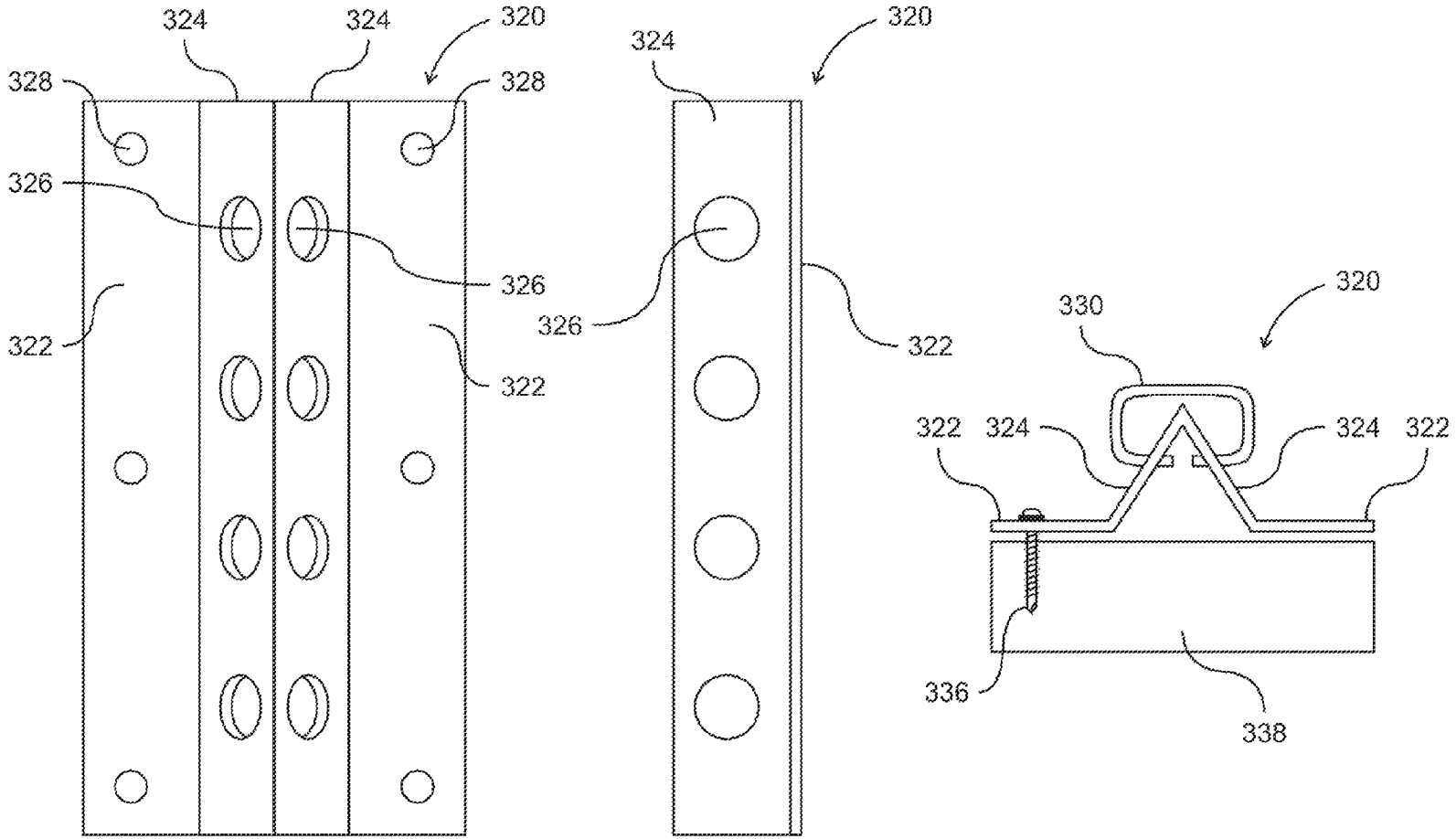
FIG. 13*c* is a front view of a triangular attachment strip having C-clamps.
FIG. 13*d* is a side view of a triangular attachment strip having C-clamps.
FIG. 13*e* is a top view of a triangular attachment strip having C-clamps.
Figure 14B:
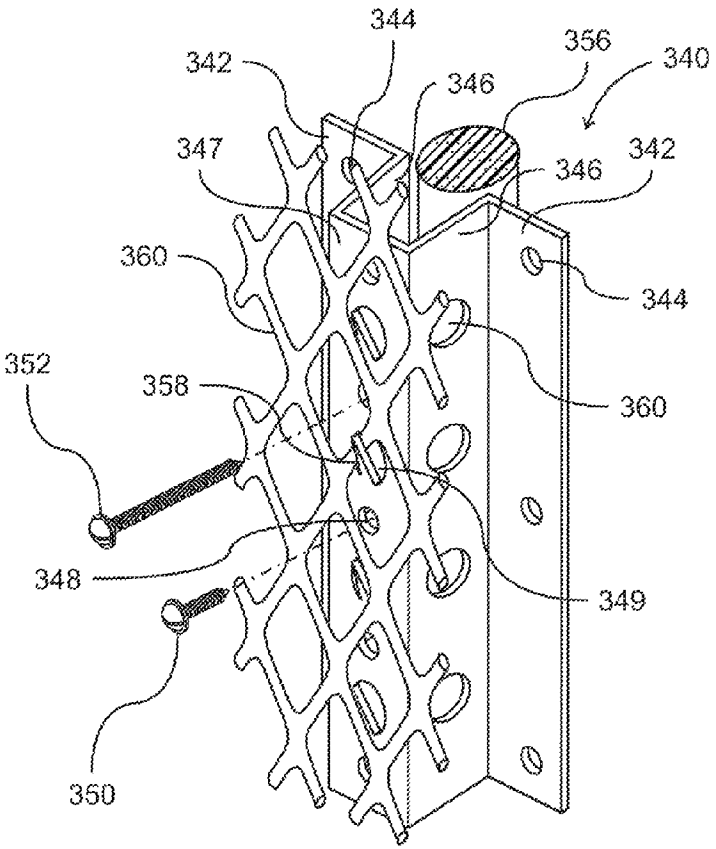
FIG. 14*b* is a perspective view of a trapezoidal attachment strip with teeth for use with cylindrical insulation assembled with a lath.
Figure 14A:
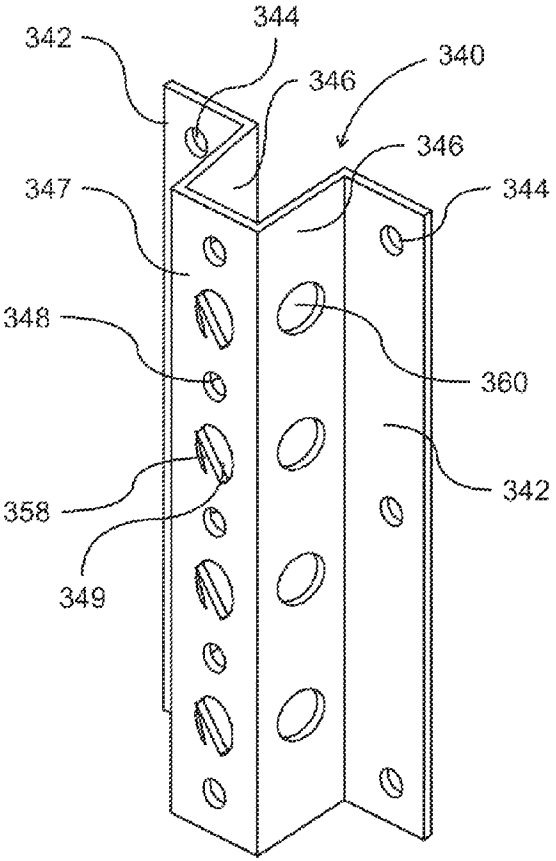
FIG. 14*a* is a perspective view of a trapezoidal attachment strip with teeth for use with cylindrical insulation.
Figure 14E:
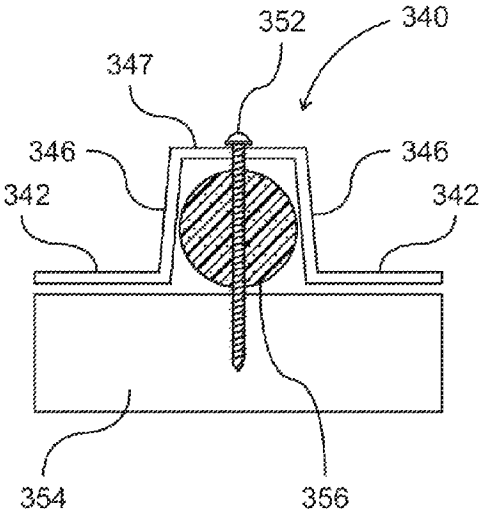
FIG. 14*e* is a top view of a trapezoidal attachment strip with teeth for use with cylindrical insulation.
Figure 14D:
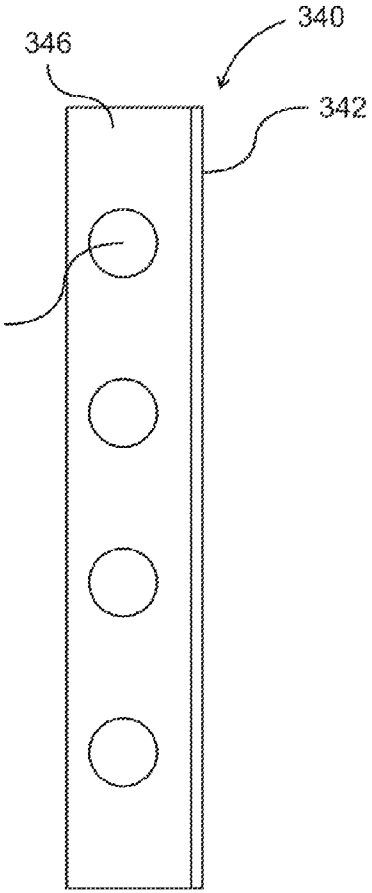
FIG. 14*d* is a side view of a trapezoidal attachment strip with teeth for use with cylindrical insulation.
Figure 14C:
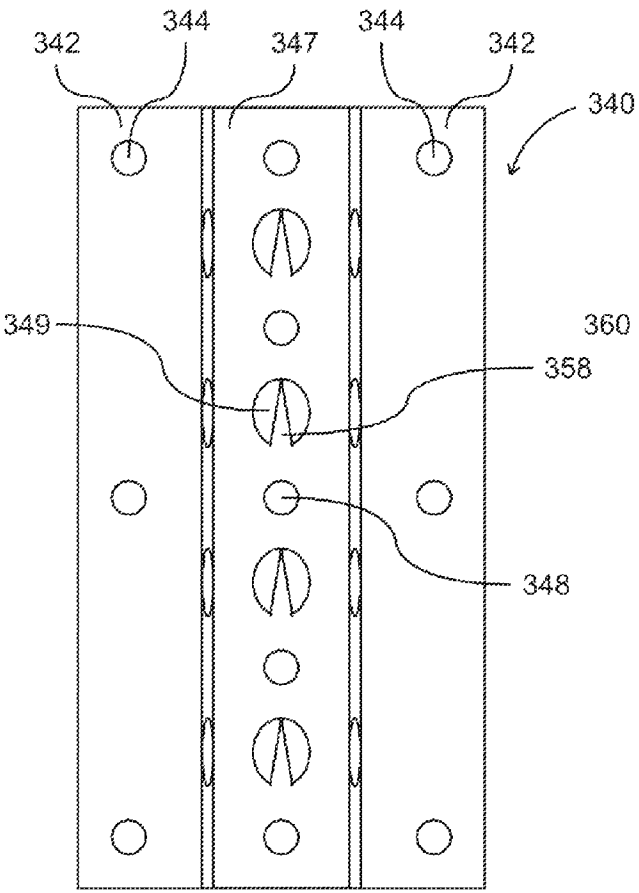
FIG. 14*c* is a front view of a trapezoidal attachment strip with teeth for use with cylindrical insulation.
Figure 15:
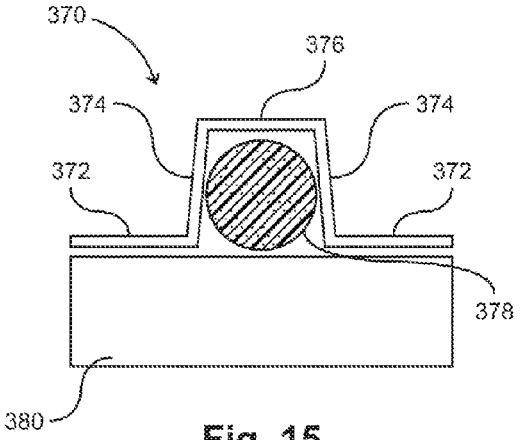
FIG. 15 is a top view of an attachment strip for use with cylindrical insulation.
Figure 16:
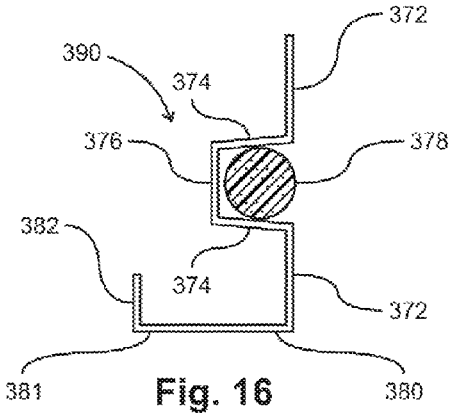
FIG. 16 is a top view of an attachment strip for use on an inside corner with cylindrical insulation.

FIG. 16 depicts another embodiment of an attachment strip 390, which is configured to fit a single piece of cylindrical insulation 378 with a termination stop 380. The termination stop 380 is substantially perpendicular to the pair of mounting plate 372 and comprises a termination stop plate 381 extending substantially perpendicular from one of the mounting plates 372, and extending substantially perpendicular from the termination stop plate is a termination stop leg 382. This configuration of an attachment strip 390 allows water to drip from the plaster on the lath away from a wall. This type of structure is used where the plastering of a wall ends and other material begins, and prevents water from seeping into a wall. This shape of an attachment strip 390 can also be used to fit the attachment strip 390 around the inside corner of a wall.

Figure 17:
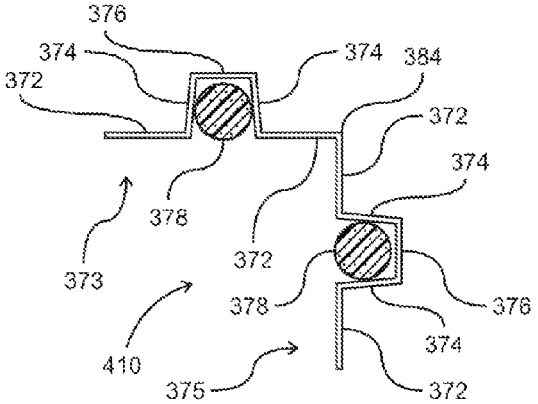
FIG. 17 is a top view of an attachment strip for use on an outside corner with two cylindrical insulation pieces.

FIG. 17 depicts an attachment strip 410 configured to be placed on an outside corner of a wall. The attachment strip 410 is comprised of a first attachment strip 373 and a second attachment strip 375 (each depicted and described in FIG. 15, integrated with each other at a corner 384 to create an integrated attachment strip from the first attachment strip 373 and second attachment strip 375. The two attachment strips 373, 375 create an open L-like structure, with the exposed insulation 378 facing inward.

Figure 18:
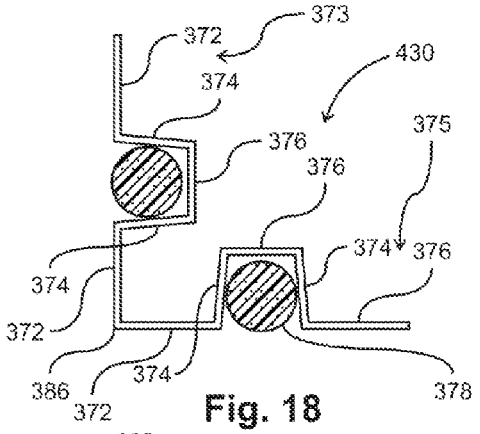
FIG. 18 is a top view of an attachment strip for use on an inside corner with two cylindrical insulation pieces.

FIG. 18 depicts attachment strip the attachment strip 410 configured to be placed on an inside corner of a wall. The attachment strip 410 is comprised of two attachment strips as depicted and described in FIG. 15, integrated with each other at a corner 386 which creates two attachment strips perpendicular to each other. When installed around an inside wall corner, each piece of cylindrical insulation 378 is adjacent to a wall. The two attachment strips 373, 375 create an open L-like structure, with the exposed insulation 378 facing outward.

Figure 19:
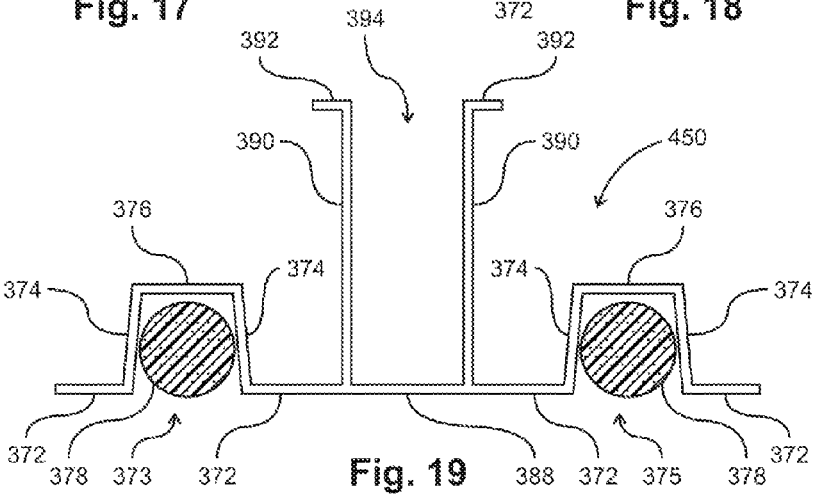
FIG. 19 is a top view of an attachment strip integrated with a channel screed and two cylindrical insulation pieces.

FIG. 19 depicts an attachment strip integrated with a channel screed. It is comprised of a first attachment strip 373 and a second attachment strip 375 as depicted and described in FIG. 15. Connecting the first attachment strip 373 and second attachment strip 375 is a channel screed 394 having a base 388 integral and along the same plane as the mounting plates 372 of the first attachment strip 373 and the second attachment strip 375. The channel screed element 394 is comprised of a pair of parallel channel screed plates 390, each perpendicular to the mounting plates 372 and between each attachment strip 373, 375. Extending substantially perpendicular from each channel screed plate 390 is a channel screed leg 392. This design of a channel screed can be used in an attachment assembly to create a recessed reveal that offers an architectural accent while providing a control joint to help minimize cracking.

Figure 20:
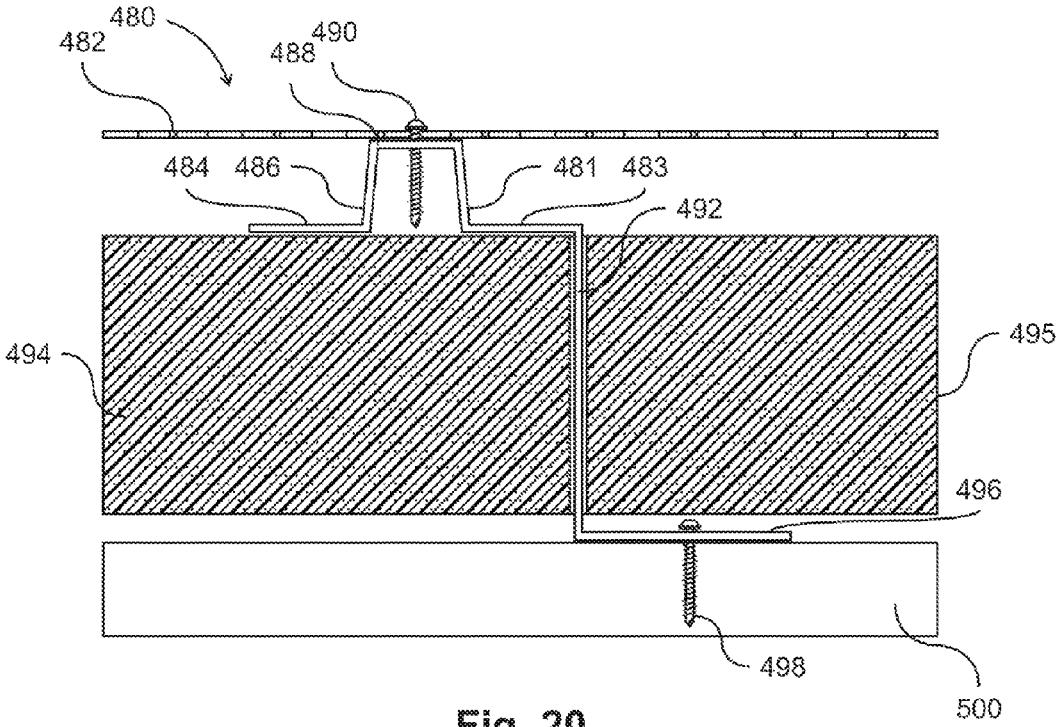
FIG. 20 is a side view of an attachment strip assembled with a lath and insulation to a wall using two screws.

FIG. 20 depicts an embodiment of an assembled attachment strip 480 with a lath 482, a first piece of insulation 494, and a second piece of insulation, 495, secured to a wall 498. In this embodiment a lath 482 is secured to an attachment strip having a first mounting plate 484 to be placed on a piece of insulation 494. The attachment strip comprises a first side attachment plate 486, a front attachment plate 488, a second side attachment plate 488, and a second mounting plate 490. The first and second side attachment plates 486, 488 are obtusely angled from the first and second bottom mounting plates 484, 490. The front attachment plate 488 is substantially parallel to the first and second mounting plates 484, 490. A screw 490 secures the lath 482 to the front attachment plate 488. Extending substantially parallel to the second mounting plate 490 is a lath insulation plate 492, and extends toward a wall 500, through a first piece of insulation 494 on one side and a second piece of insulation 495 on the other side. Extending substantially perpendicular from the lath insulation plate 492 and substantially parallel, but not overlapping with the first and second mounting plate 484, 490, is a wall mounting plate 496. A screw 498 secures the wall mounting plate 496 to the wall 498. The design of this type of attachment strip allows for thicker layers of insulation 494, 495 to be placed between the lath 482 and the wall 500.

Figure 21:
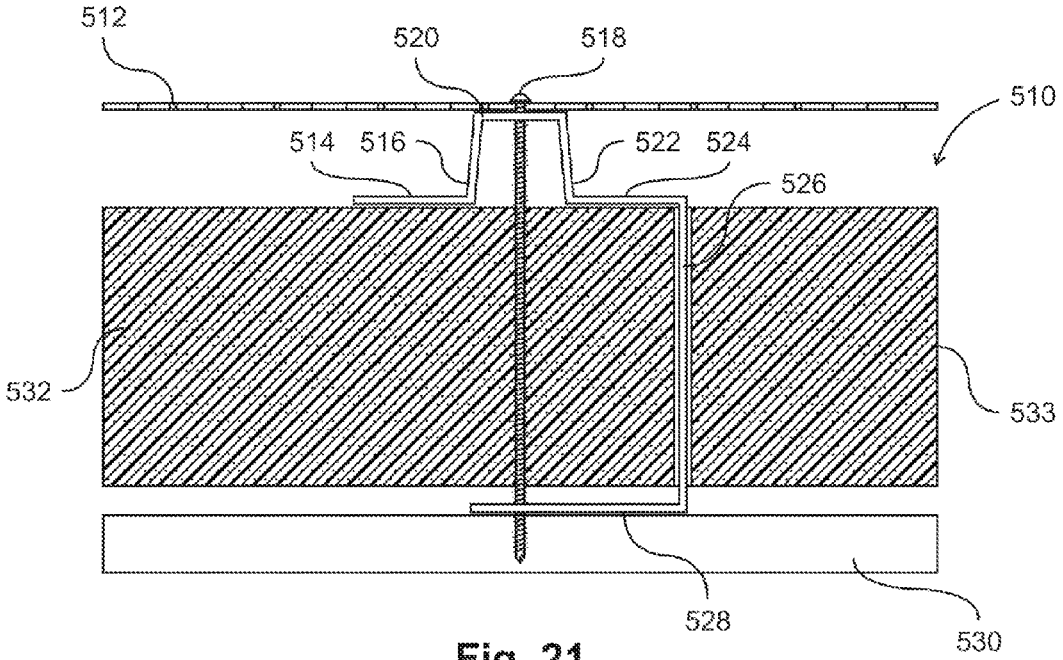
FIG. 21 is a side view of an attachment strip assembled with a lath and insulation to a wall using a single screw.
Figure 22B:
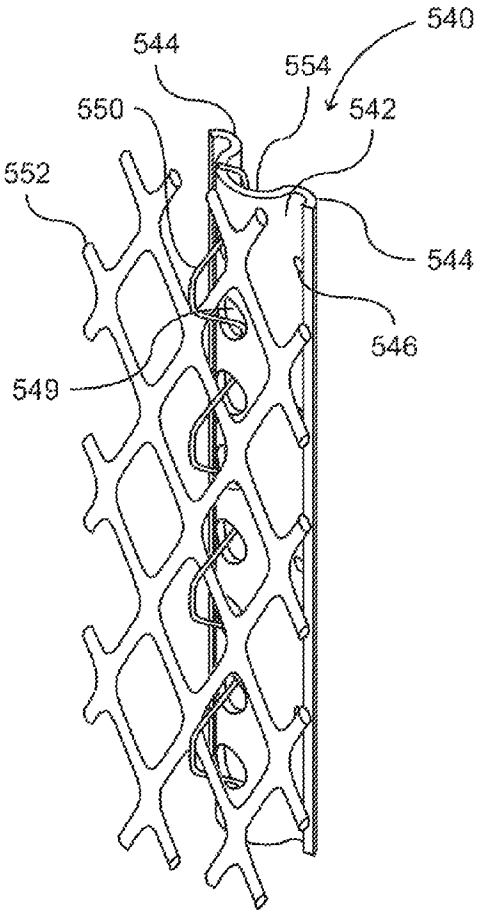
FIG. 22*b* is a perspective view of a U-shaped attachment strip having a lath securing wire traversing through attachment holes assembled with a lath.
Figure 22A:
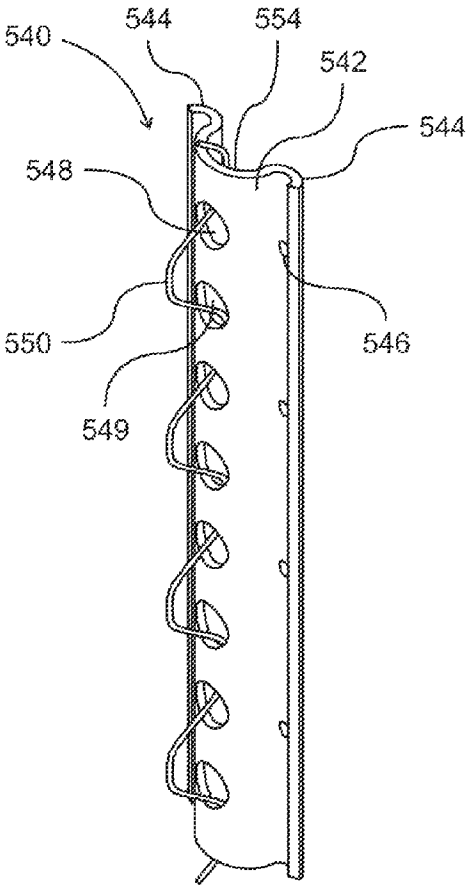
FIG. 22*a* is a perspective view of a U-shaped attachment strip having a lath securing wire traversing through attachment holes.
Figures 22C, 22D, 22E, 22F:
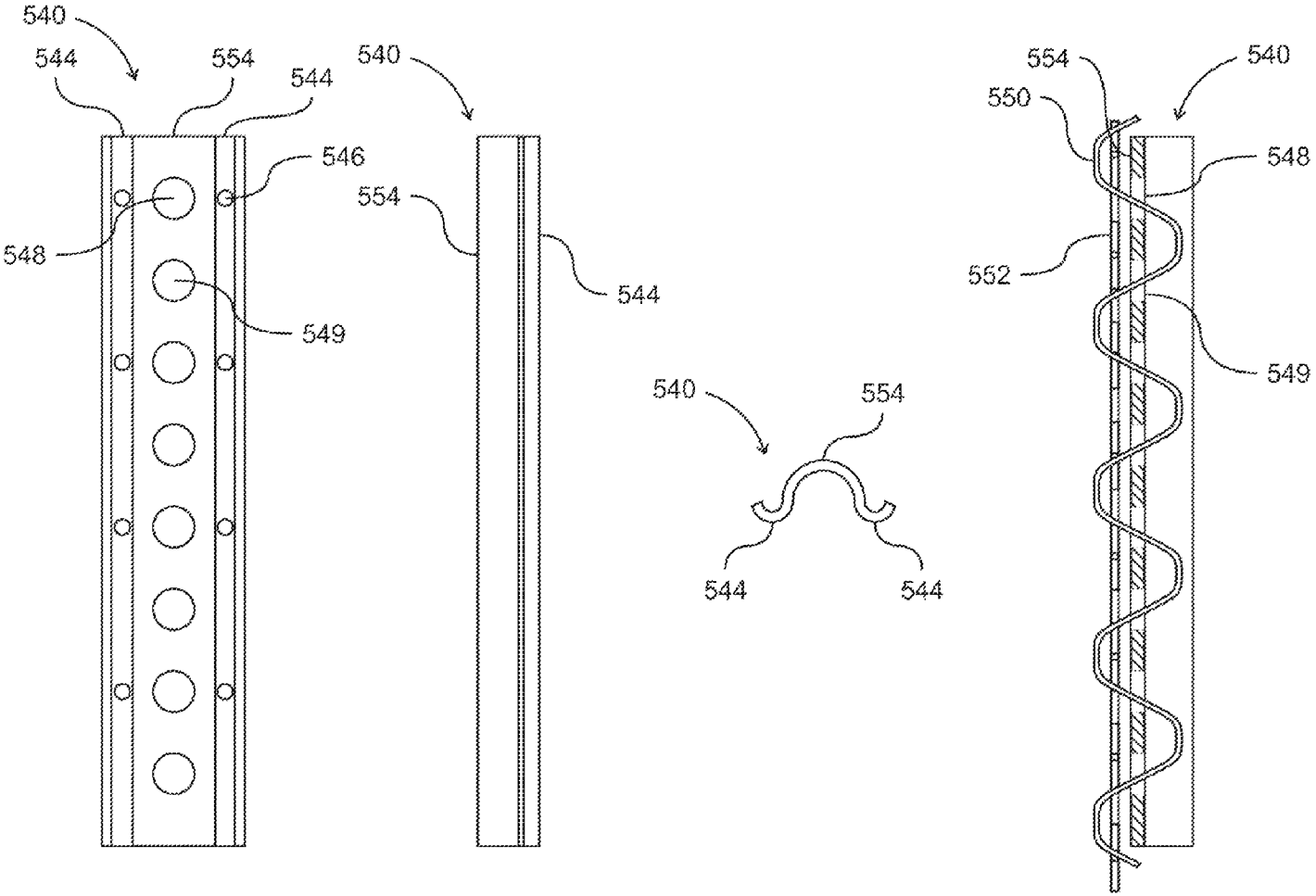
FIG. 22*c* is front view of a U-shaped attachment strip designed for having a lath securing wire traversing through attachment holes to secure a lath to the attachment strip.
FIG. 22*d* is side view of a U-shaped attachment strip designed for having a lath securing wire traversing through attachment holes to secure a lath to the attachment strip.
FIG. 22*e* is top view of a U-shaped attachment strip designed for having a lath securing wire traversing through attachment holes to secure a lath to the attachment strip.
FIG. 22*f* is cross sectional view of a U-shaped attachment strip having a lath securing wire traversing through attachment holes assembled with a lath.
Figure 23B:
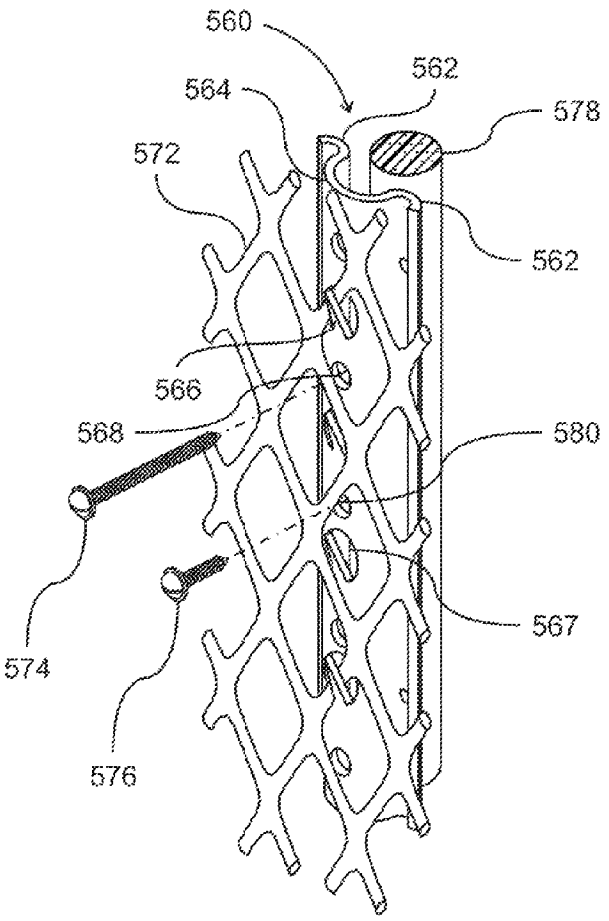
FIG. 23*b* is a perspective view of a U-shaped attachment strip having teeth assembled with an attachment strip around cylindrical insulation.
Figure 23A:
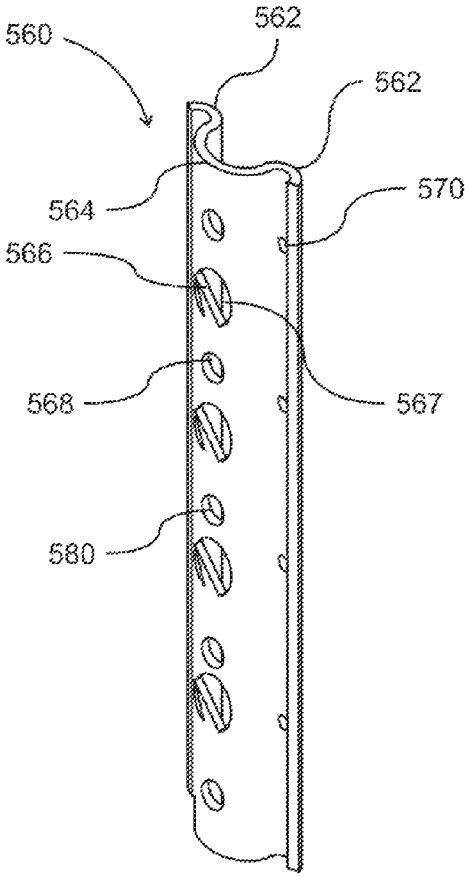
FIG. 23*a* is a perspective view of a U-shaped attachment strip with teeth.
Figure 23E:
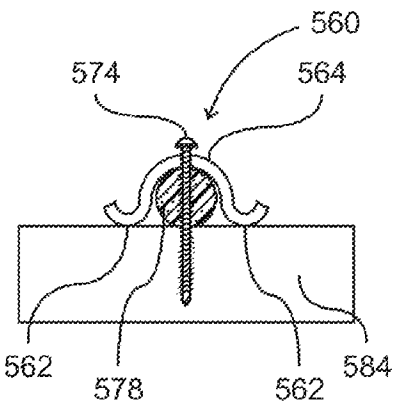
FIG. 23*e* is a top view of a U-shaped attachment strip having teeth assembled with cylindrical insulation and screwed to a wall.
Figure 23D:
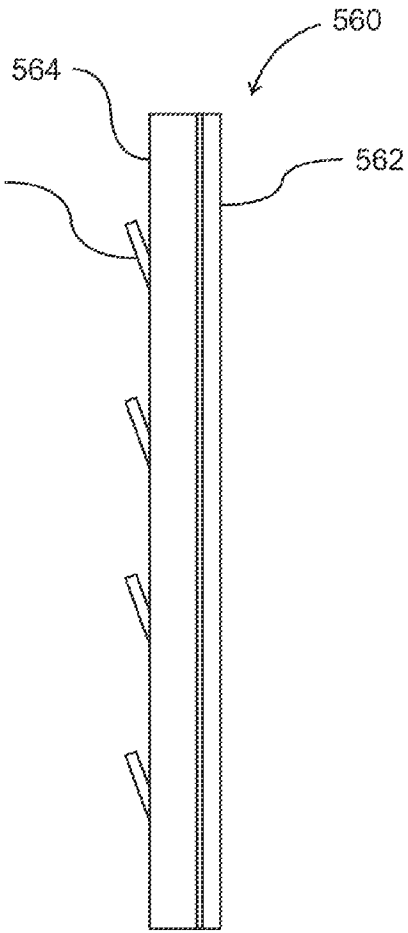
FIG. 23*d* is a side view of a U-shaped attachment strip having teeth.
Figure 23C:
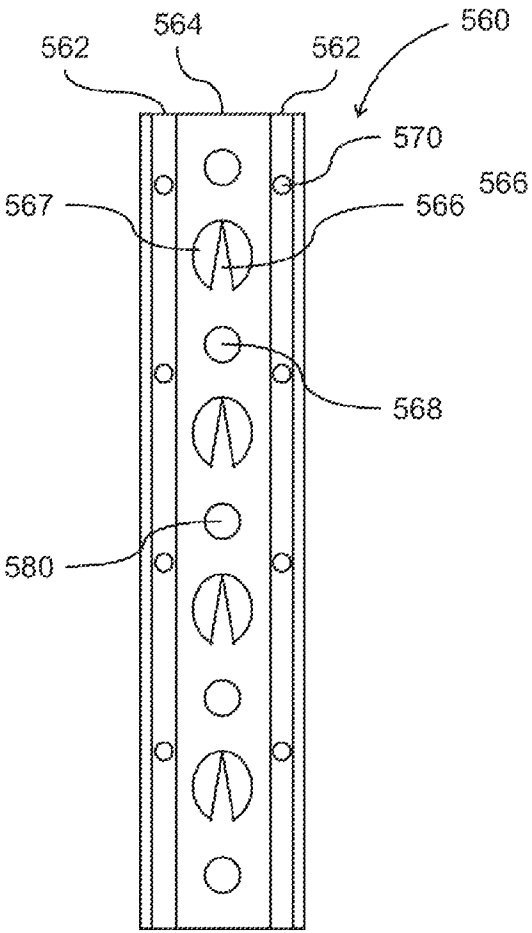
FIG. 23*c* is a front view of a U-shaped attachment strip having teeth.

FIG. 21 depicts an embodiment of an assembled attachment strip 510 with a lath 512, a first piece of insulation 532, and a second piece of insulation, 533, secured to a wall 530. In this embodiment a lath 512 is secured to an attachment strip 510 having a first mounting plate 484 to be placed on a piece of insulation 532. The attachment strip 510 also has a first side attachment plate 516, a front attachment plate 520, a second side attachment plate 522, and a second mounting plate 524. The first and second side attachment plates 486, 488 are obtusely angled from the first and second bottom mounting plates 484, 490. The front attachment plate 488 is substantially parallel to the first and second mounting plates 484, 490. A screw 518 secures the lath 512 to the front attachment plate 520. Extending substantially parallel to the second mounting plate 524 is a lath insulation plate 526, and extends toward a wall 530, through a first piece of insulation 532 on one side and a second piece of insulation 533 on the other side.

Extending substantially perpendicular from the lath insulation plate 526 and substantially parallel, and substantially overlapping with the second mounting plate 524 and the front attachment plate 520, is a wall mounting plate 528. In this embodiment, a single screw can secure the lath 512 to the front attachment plate 520. A screw 498 secures the wall mounting plate 496 to the wall 498. The design of this type of attachment strip allows for thicker layers of insulation 494, 495 to be placed between the lath 482 and the wall 500.

FIGS. 22*a-f* depict an embodiment of an attachment strip 540 having a interwoven wire 540 to secure a lath 552 to an attachment strip 540. The attachment strip 540 is U-shaped, having a curved attachment plate 554 formed at the bottom of the U and a pair of curved bracing legs 544 at edges of the attachment strip 540. This shape allows a cylindrical piece of insulation to be placed between the attachment strip 540 and a wall. An interwoven wire 550 is threaded up through a first attachment hole 548 and down through a second attachment hole 549 to secure a lath 552 by interweaving between the spaces and the metal of the lath 552. The interwoven wire 540 continues to interweave through the lath 552 and other attachment holes on the attachment strip 540. The attachment strip 540 can be secured to a wall via a screw through a screw hole 546.

FIGS. 23*a-e* depict an embodiment of an attachment strip 560 having the U-shaped features of FIG. 22 and the circumscribed pronged tooth features of FIG. 14. The attachment strip 560 is U-shaped, having a nadir 564 formed at the bottom of the U with a pair of curved top legs 562. On the nadir 564, running lengthwise down the attachment strip 560 are a series of triangular shaped pronged teeth 566, each formed from a cut portion from the front attachment strip 560. Each pronged tooth 566 is bent an angle such that the point of the pronged tooth 566 extends away from a wall 584. A pronged tooth hole 567 circumscribes each pronged tooth 566. The pronged tooth hole 567 aids in keying the plaster to the lath 572 and attachment strip 560 since the plaster, when wet, molds itself into the pronged tooth holes 567, providing extra connection support when the plaster keys. Additional, along the nadir 562 of the attachment strip 560, in between each pronged tooth 566 are a series of attachment holes 568, 580. These attachment holes 568, 580 can be used to attach a lath 572 to the attachment strip 560 through a piece of insulation 570 and into a wall 584 via a long screw 574 able to penetrate each of these items. Small screws 576 can be used to attach the lath 572 to the attachment strip 560, without penetrating the wall 584 and/or insulation 578.

Figure 24:
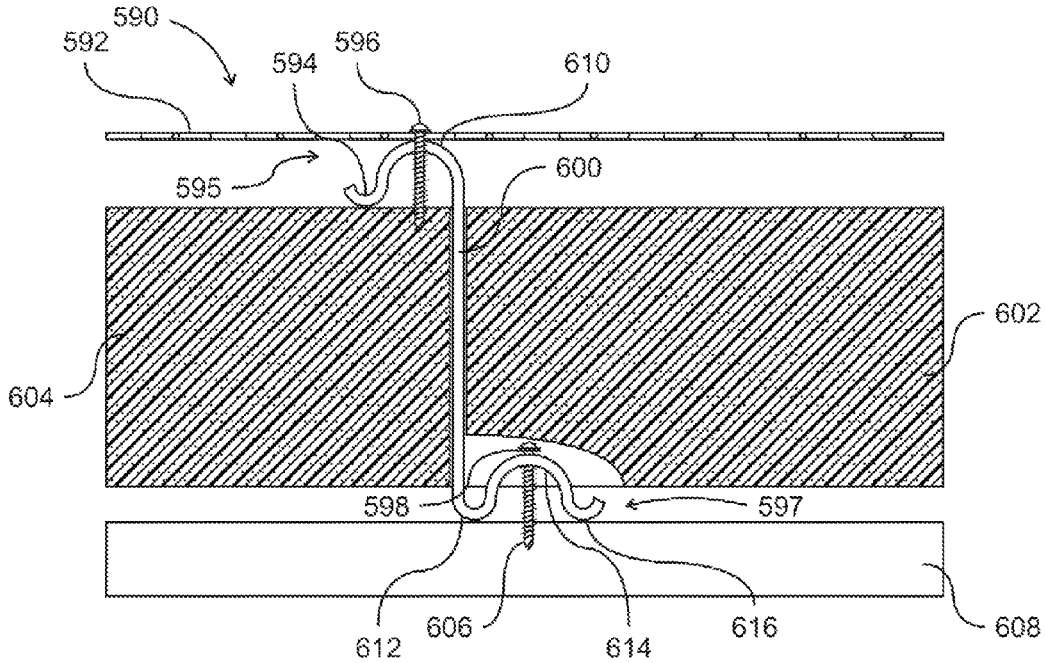
FIG. 24 is a side view of a non-overlapping double U-shaped attachment strip assembled with lath, insulation and two screws.

FIG. 24 depicts an embodiment of two non-overlapping U-shaped attachment strips 590 integrated with each other via an insulation plate 600 for use with thick pieces of insulation 602, 604. The first attachment strip 595 and the second attachment strip are each substantially in the same U-shape as previously described in FIG. 23. The attachment strip has a first curved leg 594, bracing against a first piece of insulation 604, and curves to form a first nadir 610 that a lath 592 can be secured to via a screw 596 that penetrates the first nadir 610 of the attachment strip 590. The nadir 610 then curves down forming an insulation plate 600, where a first piece of insulation 604 can be placed on a first side of the insulation plate 600 and a second piece of insulation 602 can be placed on a second side of the insulation plate 600. At the opposite end of the insulation plate 600 from the first nadir 596 is a second curved leg 612, which braces against a wall 608.

Figure 25:
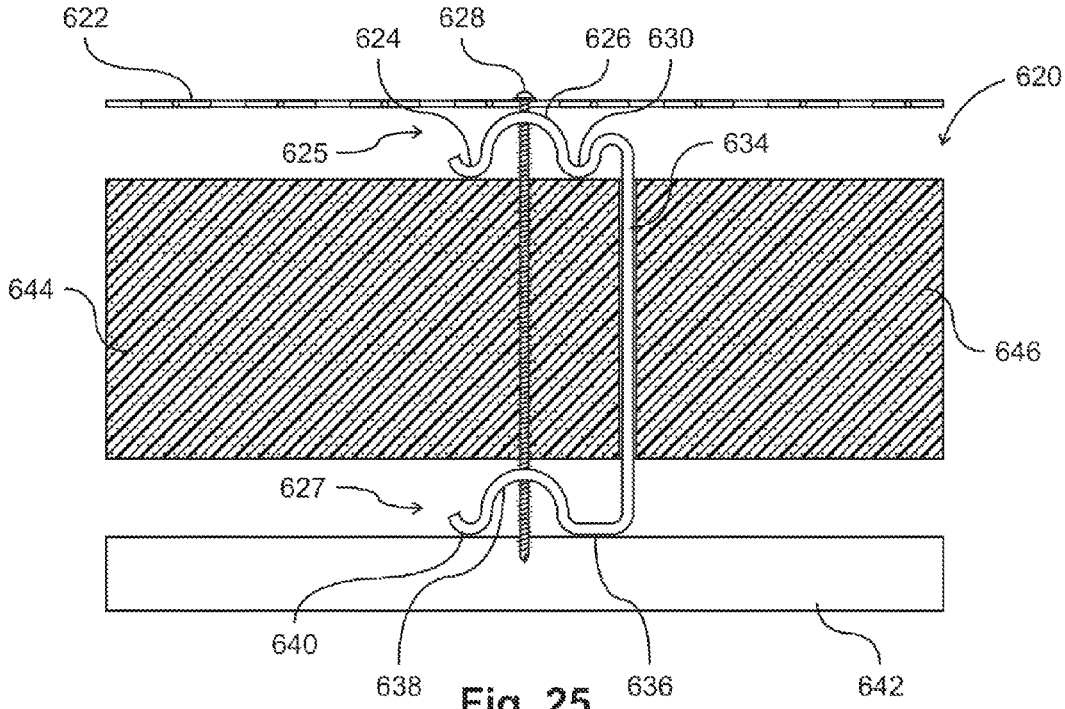
FIG. 25 is a side view of an overlapping double U-shaped attachment assembled with lath, insulation, and a single screw.

FIG. 25 depicts an embodiment of two overlapping U-shaped attachment strips 620 integrated with each other via an insulation plate 634 for use with thick pieces of insulation 644, 646. The first attachment strip 625 and second attachment strip 627 are each substantially in the U-shape previously described in FIG. 23. The first attachment strip 595 has a pair of curved bracing legs 624, 630 and the second attachment strip 627 also has a pair of curved bracing legs 640, 636. Between each pair of curved bracing legs 624, 630, 636, 640 is a raised region forming the nadir 628, 638 of the U-shape. An insulation plate 634 connects the first attachment strip 625 with the second attachment strip 627 via two of the bracing legs 630, 636, one from each attachment strip 625, 627. To secure a lath 622 to the integrated attachment strip 620, a screw 628 is inserted from the lath 622, through the nadir 626 of the first attachment strip 625, continuing through first piece of insulation 644, enters the nadir 638 of the second attachment strip 627, through a wall 642. The second attachment strip 627 overlap and is aligned with the first attachment strip 625 such that a single screw 628 can penetrate both the first attachment strip 625 and second attachment strip 627. This design allows thick pieces of insulation 644, 646 to be placed in between a lath 622 and a wall 642.

Figures 26A, 26B, 26C, 26D:
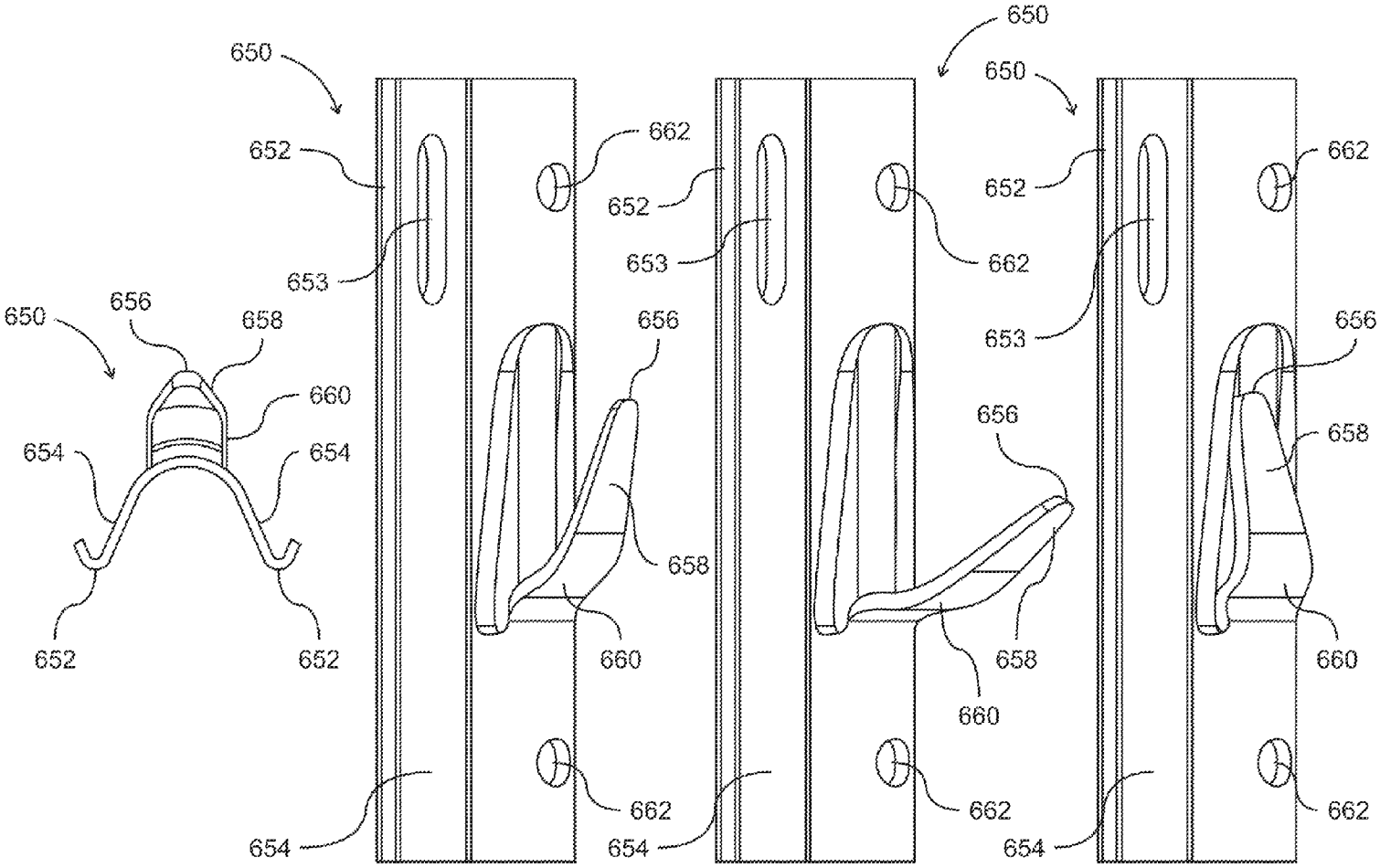
FIG. 26*a* is a top view of an attachment strip having a curved protrusion tooth to grasp a lath.
FIG. 26*b* is a perspective view of an attachment strip having a curved protrusion tooth to grasp a lath.
FIG. 26*c* is a perspective view of an attachment strip having a curved protrusion tooth angled approximately 70 degrees from the vertical plane of the attachment strip.
FIG. 26*d* is a perspective view of attachment strip having a curved protrusion tooth bent in to secure a lath.

FIGS. 26*a-d* depict another embodiment of an attachment strip having teeth 650 capable of securing lath to a wall. The attachment strip 650 is U-shaped, having a curved attachment plate 654 and curved bracing legs 652. The protrusion tooth 658 extends beyond the edge of the U-shape to catch and secured lath as it is being installed. The protrusion tooth 658 has a curved top 656 and a curved base 660 that angles away form the attachment plate 654 and attachment holes 662 where a screw or other mounting device can secure the attachment strip 650 to the wall. FIG. 26*b* is an illustration of a protrusion tooth 658 protruding in a substantially vertical direction in relation to the vertical placement of the attachment strip 650. In a preferred embodiment, the protrusion tooth 658 is angled between 45 degrees and 90 degrees from vertical plane of the attachment strip 650 when the attachment strip 650 is placed vertically against a wall. This angling of the protrusion tooth 658 enables the protrusion tooth 658 to catch and hold a lath that is placed over the attachment strip 650. In another preferred embodiment, the protrusion tooth 658 is angled between 50 and 90 degrees perpendicular from the vertical plane of the attachment strip 650 when placed against a wall, as depicted. In another preferred embodiment the protrusion tooth 658 is angled approximately 70 degrees perpendicular from the vertical plan of the attachment strip 650 when placed against a wall, as depicted in FIG. 26*c*. The attachment strip 650 has keying holes 653 to aid in securing the lath to the attachment strip 650, when the wet plaster seeps through the lath into the keying hole 653 and forms a hardened continuous plastered connection when wet plaster keys in the keying hole 653. The keying holes 653 and attachment holes 662 create thermal breaks to prevent thermal transmission of heat or cold. Between the attachment strip 652 and a wall can be insulation, as depicted by previously described embodiments, such as the insulation 356 in FIG. 14*e*, and the insulation 578 in FIG. 23. The lath (depicted in several embodiments, such as in the lath 592 in FIG. 24 and the lath 573 in FIG. 23*b*), is inserted over the protrusion teeth 658 and once the lath is secured by the protrusion teeth 658, the teeth 658 are bent down, such as by hammering, as depicted by the bent tooth 658 in FIG. 26*d*, to further secure the lath to the attachment strip 650.

Figure 27A:
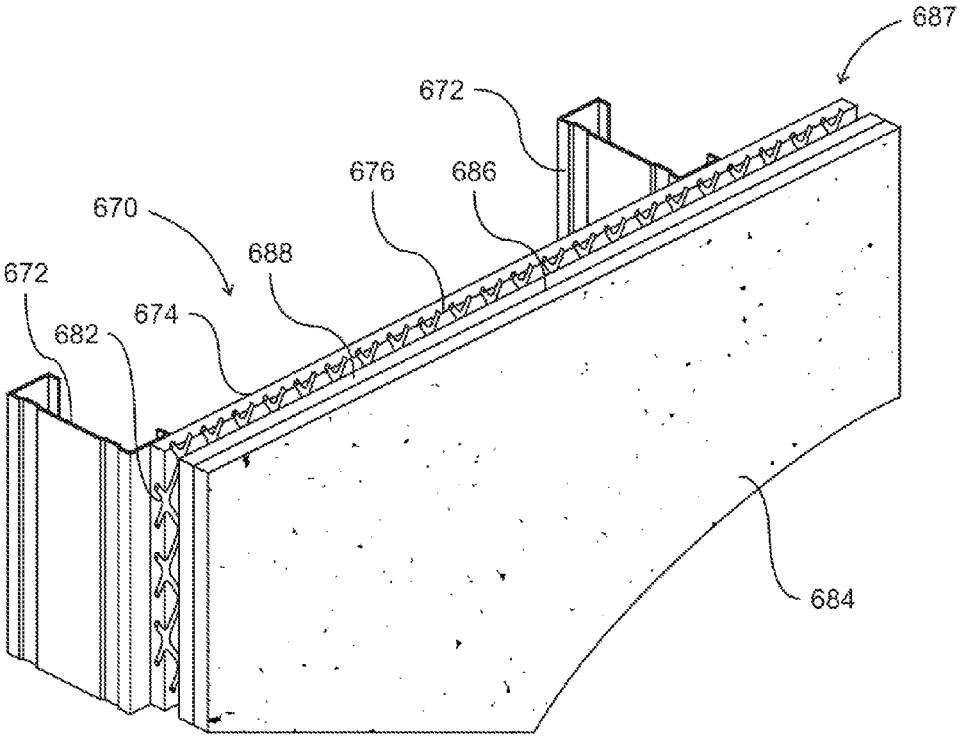
FIG. 27*a* is a perspective view of a system for securing a lath to a wall having a water drainage region.
Figure 27B:
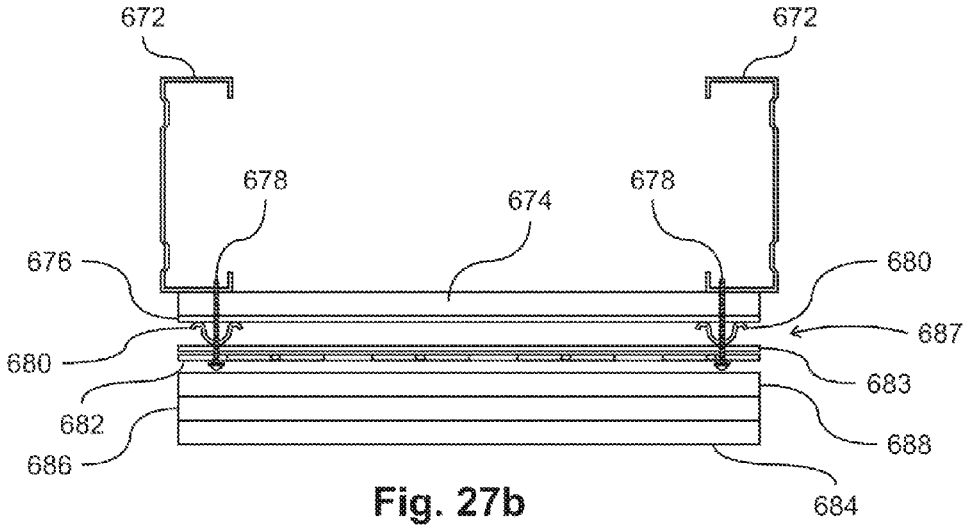
FIG. 27*b* is a top view of a system for securing a lath to a wall having a water drainage region.
Figure 27C:
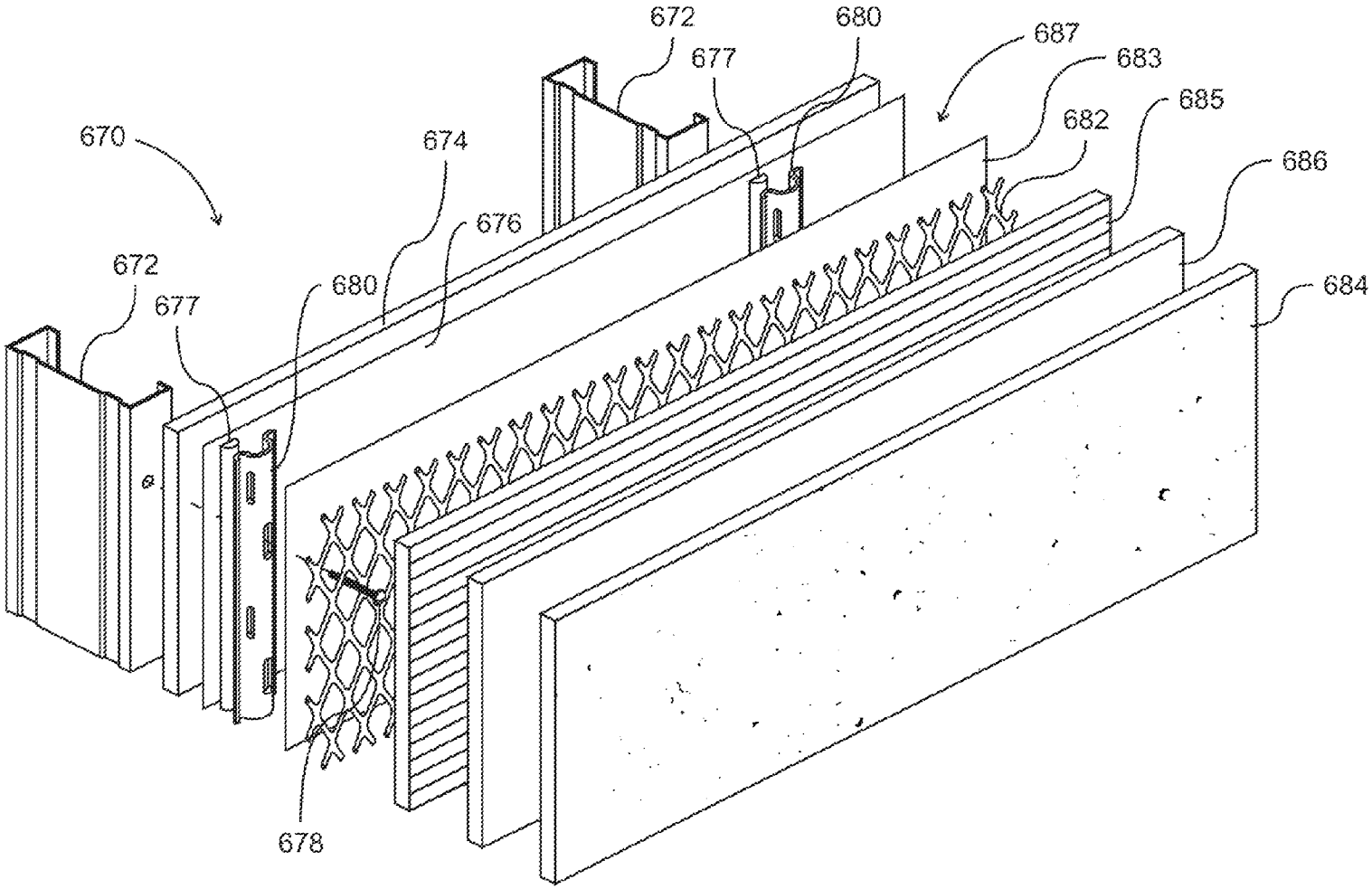
FIG. 27*c* is an exploded view of a system for securing lath to a wall with a having a water drainage region.

FIGS. 27*a-c* depict an embodiment of a system for attaching lath to a wall having a drainage system 670. Attached to framing 672 is sheathing or an approved substrate for a wall 674. Lath 682 is secured to the wall 674 which has a first water resistive barrier 676 that prevents water from entering the wall 674. The lath 682 is secured via a screw 678 that secures an attachment strip 680, the attachment strip 680 can have any of the embodiments of lath furring strips previously described in FIGS. 1-26. One side of the lath 682 has a second water resistive barrier 683. The space in between the first water resistive barrier 676 and second water resistive barrier 683 is an air space/drainage channel 687, which aids in preventing water from penetrating the inner layers of the wall 674 from the outer layers of the wall 684, 685, 686 by acting as a drainage channel 687 for any moisture that happens to get trapped between the first water resistive barrier 676 and second water resistive barrier 683. The water resistive barriers 676, 683 also act as thermal breaks to aid in insulation. In between the attachment strip 680 and the first water resistive barrier 676 can be insulation or a foam core 677, which aids in insulation by providing a thermal break, but also at least partially seals in any holes created by the screw 678 that penetrates through the first water resistive barrier 676 into the sheathing 674. The air barrier 687 may be of a variety of depths, but preferably is ¼ to ⅜ of an inch. Additional layers of insulation may be inserted between the first and second water resistive barriers 676, 687, as depicted in other embodiments, such as in FIGS. 24 and 25.

Adjacent to the attachment strip 680 are several plaster coats 684, 686, 688, which include a plaster scratch coat 688, a plaster brown coat 686 and a plaster finish coat 684. Between the lath 682 and the water resistive barrier 676 is an air barrier/drainage channel 687 which acts as a drainage area where water can migrate down if the water passes through the plaster coats 684, 686, 688 before the water can reach the water resistive barrier 676, thus providing additional protection against water damage. The attachment strip 680 can have layers of insulation within the attachment strip 680 depicted and described in FIGS. 15-21, 24, 25.

Figure 28:
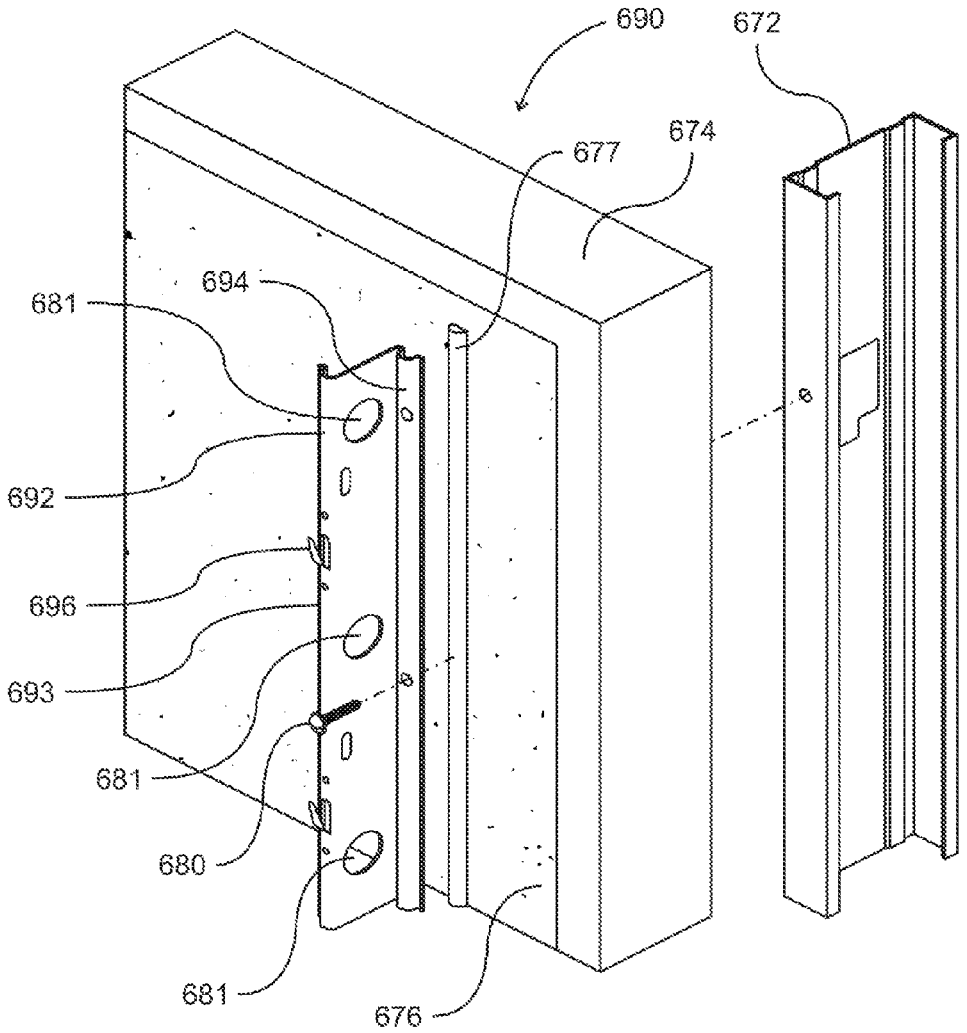
FIG. 28 is an exploded view of a system for securing lath to a wall with a Z shaped attachment strip to provide a spaced region for increasing water drainage.

FIG. 28 depicts another embodiment of a system for attaching lath to a wall having a draining system 690. Sheathing 674 is secured to a framing 672 via a screw 680 that secures an attachment strip 692, insulation layer 677 (which can be a foam core, as depicted, or any insulation layer as previously described in FIGS. 15-21, 24, 25) and a water resistive barrier 676. In this embodiment, the attachment strip 692 has a Z shape which has a first portion forming an upper first curved attachment plate 693 that is able to create an increased depth of the air barrier 687 (as depicted in FIG. 27) and a second lower curved attachment plate 694 that and can fit over an optional foam core 676, An increase in the height of the attachment strip can be accomplished by any of the embodiments in FIG. 20, 21, 24, or 25. In the embodiment of FIG. 28, the increased height of the Z-shaped attachment strip 692, having protrusion teeth 696 creates a system with improved water resistance since any water that is able to seep through past the plaster layers (as depicted in FIGS. 27*a-c*) has a greater amount of air space for the water to drip down. In addition, the attachment strip 692 has keying holes 681 where plaster seeps into once applied to the lath, and keys the lath to the attachment strip 692 via the applied plaster.

Figure 29C:
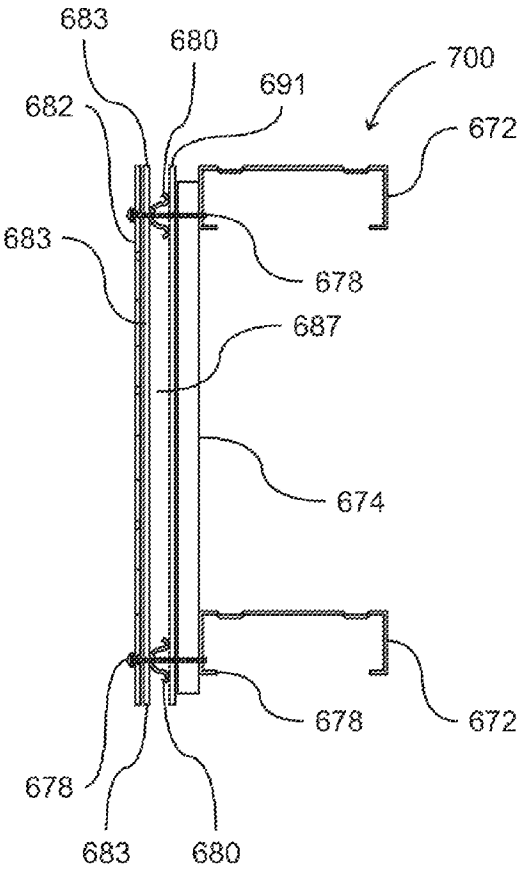
FIG. 29*c* is a top view of a system for applying plaster to a wall without separated water resistive barriers.
Figure 29B:
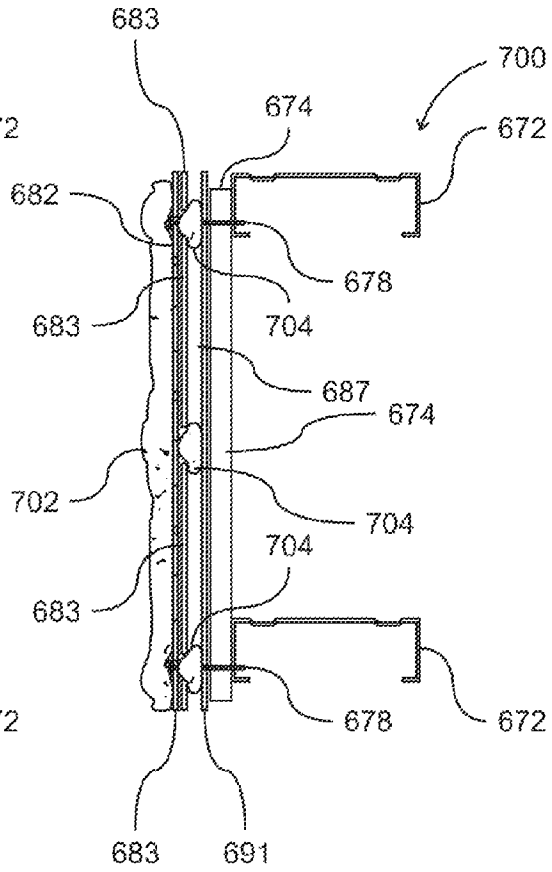
FIG. 29*b* is a top view of a system for attaching lath to a wall with separated water resistive paper and plaster applied that forms a plaster layer on top of a lath and keys to a wall.
Figure 29A:
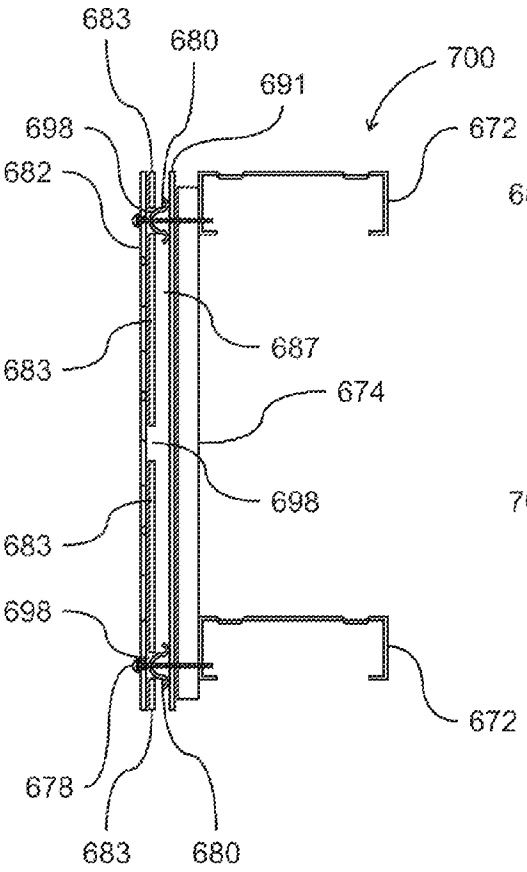
FIG. 29*a* is a top view of a system for attaching lath to a wall with separated water resistive paper to allow plaster to migrate from a lath to a wall.

FIGS. 29*a* and 29*b* depict top views of an embodiment of a system for applying plaster to a wall. In FIG. 29*a*, several sheets of water resistive barriers 683 are applied as backing to a lath 682. In the prior art, these water resistive barriers have been applied horizontally along a lath in relation to the wall that the system is placed on, however in this embodiment, the sheets of the water resistive barriers 683 are applied vertically to the lath 682. Between each water resistive barrier sheet 683 is a gap 698 that separates each water resistive barrier sheet, which creates a space where plaster can seep through from the lath 682 to a water resistive barrier 691 adjacent the sheathing or approved substrate 674. A gap between the water resistive barrier 683 and the attachment strips 680 such that plaster can seep through the lath 682 and key to the attachment strips 680 directly. Preferably, there is a 0.75 inch gap between each water resistive barrier sheet 683, and each sheet is preferably 7.75 inches in width. The attachment strips 680 and framing 672 are preferably 16 inches apart. This system has the advantage of having a two layers of water resistive barriers 683, 691, that prevent water from seeing into the more expensive sheathing 674. The first water resistive barrier 683 is adjacent the lath 682, and the second water resistive barrier 691 is adjacent the sheathing 674. The water resistive barriers 683, 691 not only prevent water from seeping into the sheathing 674, but are the boundaries that create an air space 687 that aids in insulation and water drainage, should water seep though the plaster 702.

FIG. 29*b* depicts the system of the attachment strip 700 after plaster has been applied to the lath 682. Here, the purpose of gaps 698 depicted in FIG. 29*a* is shown. The plaster 702 seeps through the gaps 698 and bonds to the attachment strips 680 (as shown in FIG. 29*a*) and water resistive barrier 691 adjacent to the sheathing 674. This creates a plaster rib 704 way between the attachment strips 680, such that the plaster 702 forms a hardened plaster rib 704 formed when the wet plaster 702 is applied to the lath 682, seeps through to the back substrate or sheathing 674, and then hardens. These plaster ribs 704 create additional support that helps prevent bowing of the plaster wall 702 between the attachment strips 680. Applied on top of the plaster 702 can be finishing coats such as the plaster scratch coat 685, plaster brown coat 686 and plaster finishing coat 684, as depicted in FIGS. 27*a-c*. The lath 682 can be secured to attachment strips that have a variety of embodiments, such as, but not limited to, the embodiments depicted and described in FIGS. 1-28. The gaps 698 of the water resistive barrier 683 do not cover the attachment strip 680 so that plaster can seep through the lath 682, bind and key to the attachment strip 680, thus encasing the attachment strip 680 in plaster, providing further support of the structure, and also creating additional plaster ribs 704 that give support to the attachment strip system, all while maintaining an air barrier 691, which aids in water drainage and insulation of the system.

FIG. 29*c* depicts an embodiment of a system for applying plaster to a wall without separated water resistive barriers 683 (the separate water resistive barrier depicted in FIGS. 29*a* and 29*b*). Here, the water resistive barrier 683 is a single sheet between the attachment strips 680. Because there are no gaps 698 (as depicted in FIG. 29*a*), the embodiment of system does not allow the passage of plaster 702 to form a plaster rib 704 along the water resistive barrier 691 adjacent to the sheathing 674. Although there is no plaster rib 704, this embodiment still has the double water resistive barriers 683, 691 that aid in water resistance still form an air space 687 for drainage and insulation.

Figure 30:
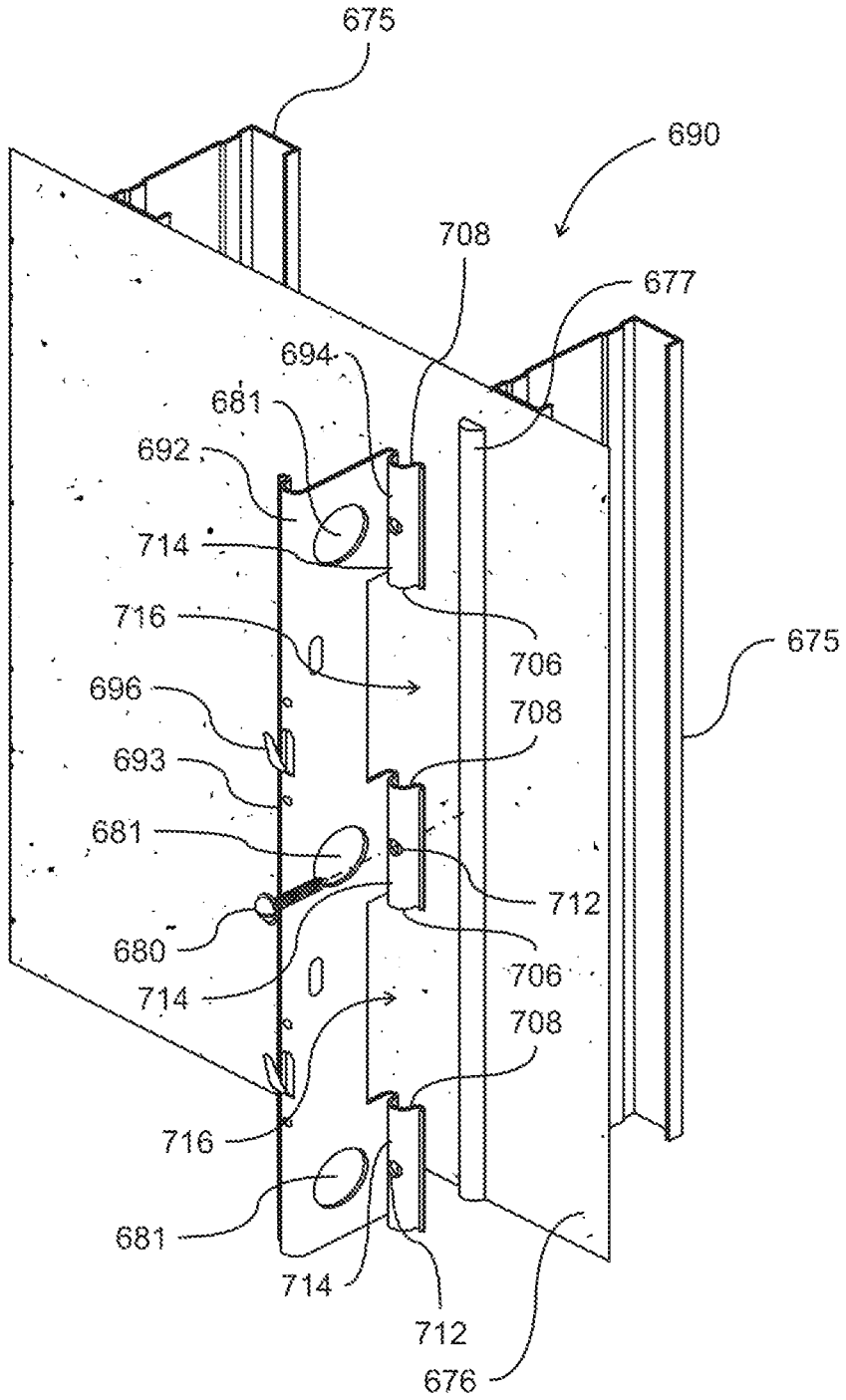
FIG. 30 is a perspective view of a system for securing lath to a wall with a Z-shaped attachment strip to provide for recued thermal transfer by having cut-out sections.

FIG. 30 depicts an embodiment of a system for attaching lath to a wall 690 similar the system depicted in FIG. 28. In FIG. 30 the system comprises a Z-shaped attachment strip 692 having cut-out portions 716 to reduced thermal transfer. The cut-out portions 716 include regions formerly part of the lower second curved attachment plate 694 and the lower region of the upper first curved attachment plate 693. By only having the metal of the attachment strip 692 contact the areas where studs 675 are present near the attachment positions, instead of the entire length of the attachment strip 692 (as depicted in FIG. 28), there is less thermal transfer due to less contact area of the attachment strip 720. In a preferred embodiment, the cut-out portions 716 are 10 inches in length between attachment portion 706 and the next nearest attachment portion 708. In this preferred embodiment, each attachment portion 706, 708 is six inches in length, and the mounting hole 712 is centered in each six inch section 714. Users of ordinary skill in the art will recognize that these distances can be varied. In a preferred embodiment, in addition to the cutout portions 716 reducing thermal transfer by reducing the amount of metal in contact with a water resistive barrier 676, insulation core 677 and/or studding 675, portions of the attachment strip 692 may be cut out, such as keying and/or thermal eliminator holes 681 located near the juncture between the upper first curved attachment plate 693 and lower second curved attachment plate 694. By having less metal in the attachment plate, especially near contact surface of the attachment portions 706, 708, 714, less thermal transfer will occur. Details concerning the attachment strip 692 in FIG. 30 correspond with the detailed description of previously described in FIG. 28.

FIGS. 31-34 depict four embodiments of a device and assembly for securing insulation and/or lath to a wall. In one embodiment, illustrated in FIGS. 31*a-f*, a first insulation panel 830 and a second insulation panel 802 are secured to an attachment strip 770. The completed and assembled attachment strip 770 with the two insulation panels 802, 830 is illustrated in FIG. 31*a*. To assemble the insulation panels 802, 830 on each side of the attachment strip 770, a first insulation panel is pressed against a first side 820 of an insulation plate 850 as illustrated in FIG. 31*b*. The insulation plate 850 has a first side 820 and a second side 848 for transecting two insulation panels 802, 830, and a first mounting flange 824 for mounting the attachment strip 770 against a wall.

Figures 31D, 31E, 31F, 31G:
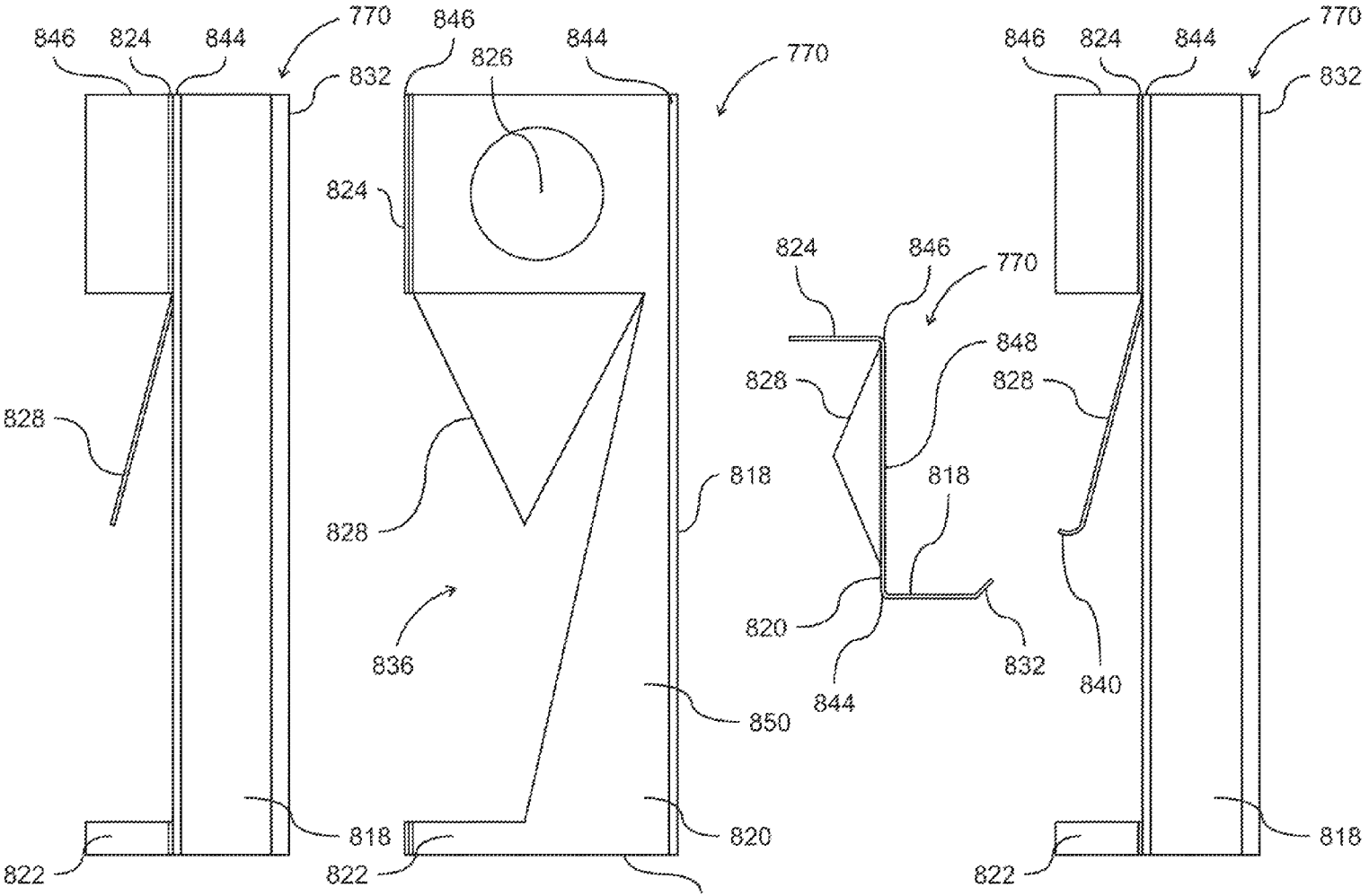
FIG. 31*d* is a front view of an attachment strip having an insulation retention arm projecting from the insulation plate.
FIG. 31*e* is a side view of an attachment strip having an insulation retention arm projecting from the insulation plate.
FIG. 31*f* is a top view of an attachment strip having an insulation retention arm projecting from the insulation plate.
FIG. 31*g* is a front view of an attachment strip having a hooked insulation retention arm.
Figures 32A, 32B, 32C:
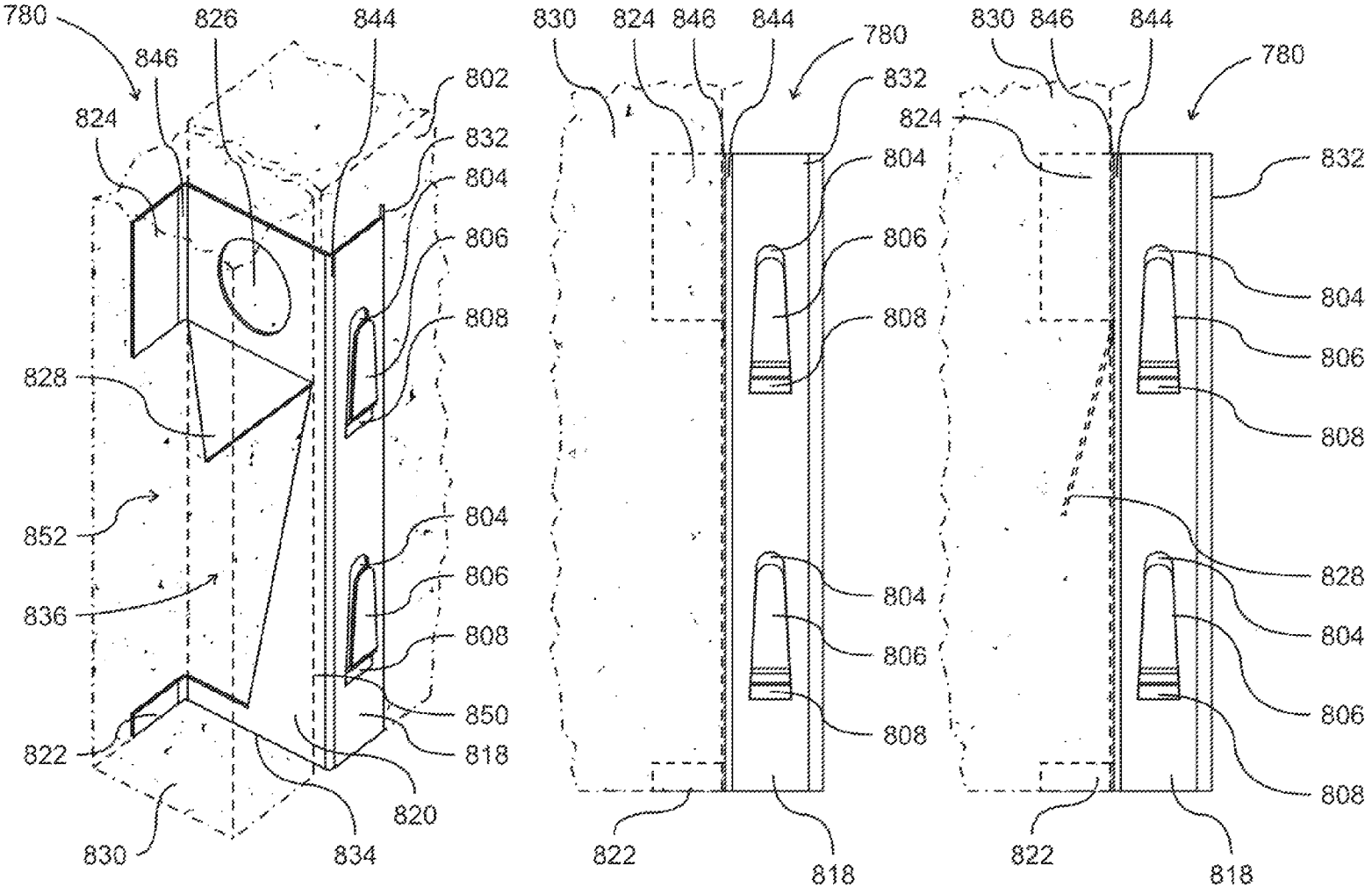
FIG. 32*a* is a perspective view of an attachment strip having an insulation retention arm and lath retention arms, assembled with two insulation panels.
FIG. 32*b* is a front view of an attachment strip having lath retention arms and an insulation retention arm flush with the insulation plate, assembled with a first insulation panel not yet retained by the insulation retention arm.
FIG. 32*c* is a front view of an attachment strip having lath retention arms, and an insulation retention arm projecting into a first insulation panel after the insulation retention arm has been hammered out to retain the first piece insulation panel.
Figure 32F:
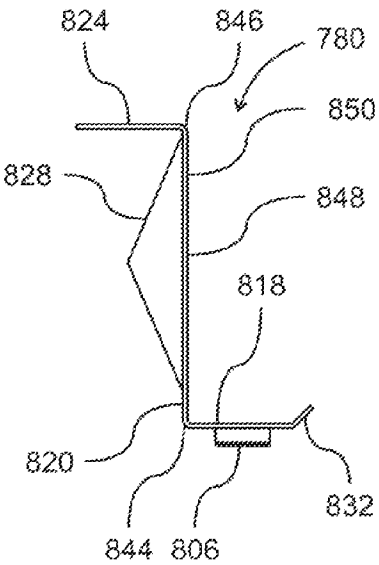
FIG. 32*f* is a top view of an attachment strip having lath retention arms and an insulation retention arm projecting from the insulation plate.
Figure 32E:
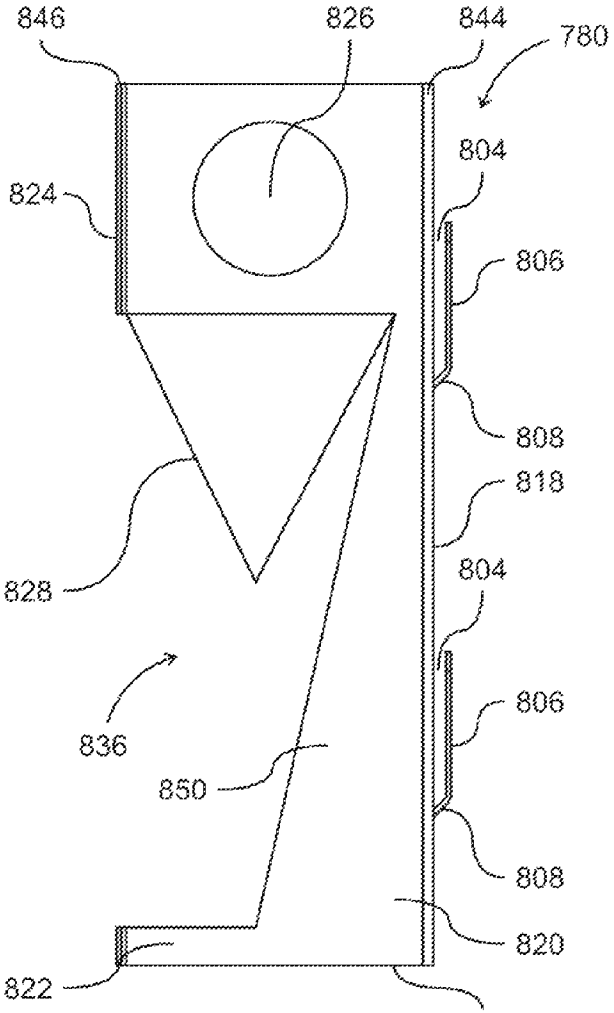
FIG. 32*e* is a side view of an attachment strip having lath retention arms and an insulation retention arm projecting from the insulation plate.
Figure 32D:
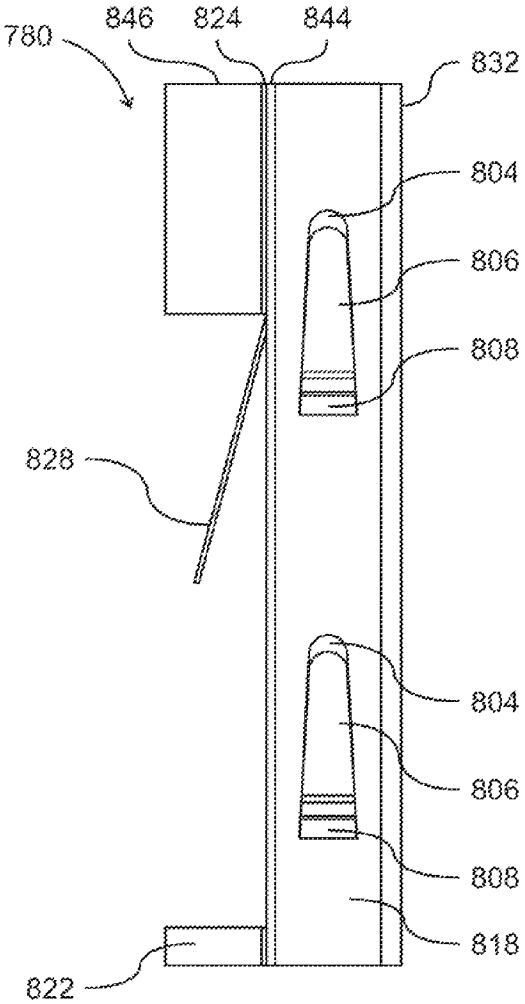
FIG. 32*d* is a front view of an attachment strip having lath retention arms and an insulation retention arm projecting from the insulation plate.

The insulation plate 850 also has an insulation retention arm 828 that is capable of projecting away from the insulation plate 850 for retaining insulation 830 against the attachment strip 770. Prior to assembling the two insulation panels 802, 830, the insulation retention arm 828 remains flush with insulation plate 850. After the first insulation panel 830 is pressed against the insulation plate 850, the insulation retention arm 828 is hammered out from the second side 848 of the insulation plate, thereby creating a projecting insulation retention arm 828 as depicted in FIG. 31*c*. The top view, illustrated in FIG. 31*f*, best illustrates the first side of the insulation plate 820 and second side of the insulation plate 848 from where the user hammers out the insulation retention arm 828. FIG. 31*d* depicts the front view of the attachment strip 770 without any insulation panels 802, 803, while FIG. 31*e* depicts the side view of the attachment strip 770 without any insulation panels 802, 830.

When the insulation retention arm 828 projects into the first insulation panel 830, as shown in FIG. 31*c*, the insulation retention arm 828 pierces and retains the insulation 830 against attachment strip 770. In some embodiments, the insulation retention arm may be triangular shaped and/or have a hooked end 840 (as depicted in FIG. 31*g*), which further aids in retaining the first insulation panel 830 to the attachment strip 770. This hooked end 840 may be incorporated into any of the other insulation retention arms 828 depicted throughout this specification.

After the first insulation panel 830 is secured to the attachment strip 770, a second insulation panel 802 is placed on the second side 848 of the insulation plate 850. The second insulation panel 802 is retained by a retention flange 818 (also described in previous embodiments as a mounting plate) which extends substantially perpendicular from the interior edge 844 of the second side 848 of the insulation plate 820, best depicted in top view in FIG. 31*f*. In some embodiments the retention flange 818 may have an insulation grasping flange 832 opposing and substantially parallel to the insulation plate interior edge 844, which helps to grasp and hold the second insulation panel 802 in place.

In some embodiments, a second mounting flange 822 may be spaced apart from the first mounting flange 824, creating a mounting flange void 852 between the first and said second mounting flanges 824, 822. This void 852 minimizes the amount of metal in the attachment strip 770. By minimizing the amount of metal in the attachment strip 770, the attachment strip 770 conducts less heat, thereby providing greater insulation compared to if the entire attachment strip 770 had no void between the first and second mounting flanges 824, 822. Like the first mounting flange 824, the second mounting flange also extends substantially perpendicular from the inner edge 846 of the mounting flange 824.

To further reduce the metal content of the attachment strip 770, and thereby improving the insulating characteristics of the attachment strip 770, voids may be introduced into various regions of the attachment strip 770. In a preferred embodiment, the insulation plate 850 has an upper region with an insulation plate aperture 826 where no metal exists. Another voided area may include a middle region insulation plate void 836. The middle insulation plate void 836 may be of a various shapes to increase insulative properties. Preferably, this void 836 is trapezoidally shaped having the small base of the trapezoid on the near the bottom of the insulation plate 850 and the long base of the void near the top of the insulation plate 850. This shape has the advantage having more metal near the lower base region 834 of the insulation plate 850. By having more metal near the lower base region 834 of the insulation plate 850, the attachment strip 770 can bear more weight than if the middle region insulation plate void 836 had the same width throughout the length of the insulation plate 850.

FIGS. 32*a-f* illustrate additional advantageous features of an attachment strip 780. This embodiment is identical to the embodiment described and illustrated in FIGS. 31*a-g*, but has lath retention arms 806 (also described as protruding teeth throughout the specification). Each lath retention arm 806 has a base 808 where the arm 806 is attached to the retention flange 818. The lath retention arms 806 project out from the retention flange 818 creating a lath space 804 where a lath can be inserted and secured over the lath retention arms 806. A variety of lath retention arm shapes and configuration will work in this embodiment. One such embodiment that describes how the lath retention arms hold a lath and are secured an attachment strip is illustrated and described above in FIG. 26. By placing the lath on lath retention arm 806 instead on the wall directly, heat loss and water intrusion is minimized because fewer holes are created when the lath is secured to an attachment strip compared to when a lath is directly attached to a wall or insulation.

FIGS. 33*a-f* illustrate an additional advantageous feature of an attachment strip 790 for securing insulation panels 802, 830. The embodiment is the same as the embodiment illustrated in FIGS. 31*a-e*, except this embodiment has a retention flange aperture 810 positioned within the retention flange 818. By having this aperture 810, this feature aids in reducing heat loss by reducing the amount of metal on the attachment strip 790 without reducing the structural stability of the attachment strip 790.

FIGS. 34*a-f* illustrate still another additional advantageous feature of an attachment strip 800 for securing insulation panels 802, 830. Here, the advantageous features of FIGS. 32*a-f* and FIGS. 33*a-f* are combined into a single attachment strip 800, such that this embodiment has both lath retention arms 806 and a retention flange aperture 810 on the attachment strip 800. The combination of all these features on a single attachment strip 800 decrease heat loss through the attachment strip 800.

Thus it is appearing that there has been provided, in accordance with the invention, an attachment strip and system for securing lath to a wall in an easier manner, which uses fewer penetrating devices, thus increasing water resistance, that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

I claim:

1. A wall insulation system for securing insulation, the system comprising:

at least one insulation panel, wherein the at least one insulation panel is a pierced insulation panel;

an attachment strip having:

i) an insulation plate for transecting insulation, said insulation plate having an interior edge and an exterior edge, said insulation plate having an insulation plate void;

ii) a first mounting flange projecting substantially perpendicular from said insulation plate and in proximity to said interior edge;

iii) a retention flange projecting from a first side of said insulation plate in proximity to said exterior edge, said retention flange substantially parallel to said first mounting flange, said retention flange is non-overlapping with said first mounting flange;

iv) a second mounting flange, said second mounting flange substantially coplanar with said first mounting flange, wherein said second mounting flange is spaced from said first mounting flange creating a mounting flange void between said first mounting flange and said second mounting flange, said mounting flange void at least partially continuous with said insulation plate void;

v) an insulation retention arm projecting from a second side of said insulation plate between said interior and exterior edges, said insulation retention arm having a tapered piercing tip designed to pierce said at least one insulation panel, said insulation retention arm at least partially disposed within said at least one insulation panel; and, wherein said retention flange being configured to retain insulation on said first side of said insulation plate and said insulation retention arm being configured to retain insulation on said second side of said insulation plate;

whereby said mounting flange void decreases heat conductivity of said attachment strip while maintaining support along an upper and lower portion of said attachment strip.

2. The system of claim 1, wherein said insulation plate further comprises at least one aperture extending through said first side of said insulation plate and said second side of said insulation plate.

3. The system of claim 1, wherein said insulation plate is characterized by having an upper region, a middle region, and a lower base region;

said upper region comprising an aperture disposed within said upper region and said insulation retention arm;

said middle region adjacent to and below said upper region and comprising said insulation plate void, said insulation plate void characterized as being at least partially continuous with said mounting flange void;

said lower base region adjacent to and below said insulation plate void, whereby said insulation plate void reduces heat conductive properties of said attachment strip and said lower base region supports the weight of said attachment strip and any objects loaded onto said attachment strip.

4. The system of claim 3, wherein said middle insulation plate void is characterized as being a trapezoidally shaped void having an upper base of said void greater in width than a lower base of said void, whereby said trapezoidally shaped void decreases heat conductivity of said attachment strip, and said lower base region maintains structural stability of said attachment strip.

5. The system of claim 1, wherein said insulation retention arm is triangular shaped.

6. The system of claim 1, wherein said insulation retention arm has a hooked end.

7. The system of claim 1, wherein said retention flange comprises at least one aperture for reducing heat loss through said attachment strip.

8. The system of claim 1, wherein said retention flange comprises at least one lath retention arm for securing a lath to said attachment strip.

9. The system of claim 8, wherein said retention flange further comprises at least one aperture for reducing heat loss through said attachment strip.

10. The system of claim 1, wherein said retention flange is characterized by having an insulation grasping flange projecting at an angle from said retention flange.

* * * * *